US008123461B2

(12) United States Patent
Yoshida et al.

(10) Patent No.: US 8,123,461 B2
(45) Date of Patent: Feb. 28, 2012

(54) AXIAL FLOW FAN UNIT

(75) Inventors: Yusuke Yoshida, Kyoto (JP); Shinya Kaneoya, Kyoto (JP)

(73) Assignee: Nidec Corporation, Kyoto (JP)

( * ) Notice: Subject to any disclaimer, the term of this patent is extended or adjusted under 35 U.S.C. 154(b) by 504 days.

(21) Appl. No.: 12/392,248

(22) Filed: Feb. 25, 2009

(65) Prior Publication Data

US 2009/0214337 A1 Aug. 27, 2009

(30) Foreign Application Priority Data

Feb. 26, 2008 (JP) ..... 2008-044127
Apr. 28, 2008 (JP) ..... 2008-117886

(51) Int. Cl.
*F01D 1/24* (2006.01)

(52) U.S. Cl. ..... 415/68; 415/214.1

(58) Field of Classification Search ..... 415/66, 415/68, 214.1; 361/695
See application file for complete search history.

(56) References Cited

U.S. PATENT DOCUMENTS 6,343,014 B1 * 1/2002 Lin ..... 361/697
6,547,540 B1 4/2003 Horng et al.
6,827,549 B1 12/2004 Horng et al.
7,112,905 B2 9/2006 Chang et al.
7,156,611 B2 1/2007 Oosawa et al.
2005/0024829 A1 2/2005 Horng et al.
2005/0260065 A1 * 11/2005 Kikuichi et al. ..... 415/60
2007/0003413 A1 1/2007 Hsu et al.
2007/0059155 A1 * 3/2007 Ishihara et al. ..... 415/60

FOREIGN PATENT DOCUMENTS

CN 2177114 Y 9/1994
CN 1900535 A 1/2007
JP 2002-349476 A 12/2002
JP 2004-278370 A 10/2004
JP 2004-278371 A 10/2004
JP 2008-14147 A 1/2008

OTHER PUBLICATIONS

Yoshida; "Axial Flow Fan Unit"; US Appl. No. 12/392,243; filed Feb. 25, 2009.

* cited by examiner

*Primary Examiner* — Ross Gushi
(74) *Attorney, Agent, or Firm* — Keating & Bennett, LLP

(57) ABSTRACT

A fan frame includes a first housing having a first end portion in which a first protrusion is arranged, a second housing having a second end portion in which a second protrusion opposing the first protrusion along a specified axis is arranged, the second end portion being in an axially opposing relationship with the first end portion, and a fixing member attached to the first protrusion and the second protrusion to fix the first housing and the second housing together. Further, a first locking portion is arranged in the first end portion and a second locking portion engaging with the first locking portion is arranged in the second end portion.

24 Claims, 44 Drawing Sheets

AXIAL FLOW FAN UNIT

BACKGROUND OF THE INVENTION

1. Field of Invention

The present invention relates to a fan frame and an axial flow fan unit.

2. Description of the Related Art

Conventionally, a cooling fan is installed inside of a housing of various kinds of electronic devices to cool electronic parts thereof. Because the electronic parts suffer from increased heat generation due to high performance and have an increased arrangement density due to the reduction in size of the housing, there is a need to increase the static pressure and flow rate of the cooling fan. To meet this need, a serially connected axial flow fan unit has recently been used as a cooling fan that can secure a great enough static pressure and an increased flow rate. The serially connected axial flow fan unit includes a plurality of axial flow fans serially connected to one another by many different methods.

In a case where the axial flow fans are coupled together by screws, rivets or the like, however, there is a need to form through-holes in the housings of the axial flow fans, in addition to the through-holes used in attaching the axial flow fan unit to a device. With this structure, it is difficult to re-attach the axial flow fans even though the combination of axial flow fans is changed during the course of designing or installing the serially connected axial flow fan unit.

Once the axial flow fans are connected to one another, it is difficult to detach them without causing damage to the through-holes or the housings. Therefore, even if the combination of axial flow fans is changed during the course of designing or installing the serially connected axial flow fan unit, it is impossible to re-attach the axial flow fans without reducing the connection strength thereof.

SUMMARY OF THE INVENTION

Preferred embodiments of the present invention have been developed in order to overcome the above problems with conventional axial flow fan units as described above.

In one preferred embodiment, a fan frame includes, e.g., a first housing having a first end portion in which a first protrusion is arranged and a second housing having a second end portion in which a second protrusion opposing the first protrusion along a specified axis is arranged, the second end portion being arranged in an axially opposing relationship with the first end portion. A fixing member is attached to the first protrusion and the second protrusion to fix the first housing and the second housing together.

In another preferred embodiment, a fan unit includes a first impeller, a first housing, a second impeller and a second housing.

The first housing is arranged to accommodate the first impeller that is rotatable about a specified axis and has a first end portion in which a first protrusion is provided.

The second housing is arranged to accommodate the second impeller rotatable about the specified axis and has a second end portion in which a second protrusion axially opposing the first protrusion is provided. The second end portion is in an axially opposing relationship with the first end portion. A fixing member is attached to the first protrusion and the second protrusion to fix the first housing and the second housing together.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
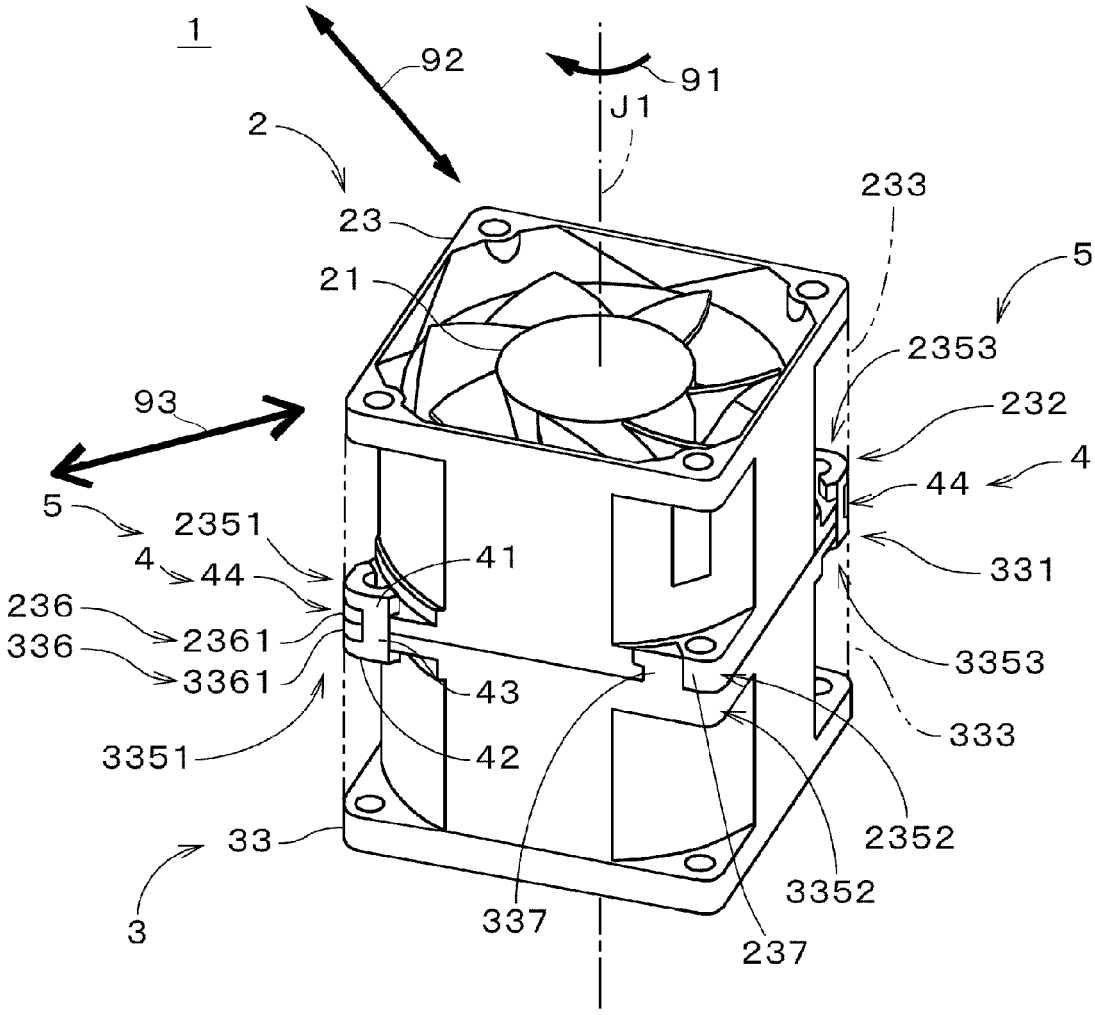
FIG. 1 is a perspective view showing a serially connected axial flow fan unit in accordance with a first preferred embodiment of the present invention.

Referring to FIGS. 1 through 43, preferred embodiments of the present invention will be described in detail. It should be noted that in the explanation of preferred embodiments of the present invention, when positional relationships among and orientations of the different components are described as being up/down or left/right, ultimately positional relationships and orientations that are in the drawings are indicated; positional relationships among and orientations of the components once having been assembled into an actual device are not indicated. Meanwhile, in the following description, an axial direction indicates a direction parallel or substantially parallel to an axis, and a radial direction indicates a direction perpendicular or substantially perpendicular to the axis. Further, in the drawings, like or similar elements are represented by the same or similar reference numerals to avoid confusion and repetitive description.

First Preferred Embodiment

FIG. 1 is a perspective view showing a serially connected axial flow fan unit 1 in accordance with a first preferred embodiment of the present invention. Preferably, the axial flow fan unit 1 includes a first axial flow fan 2, a second axial flow fan 3 and a plurality of, e.g., two, fixing members 4. As will be described below, the first and second axial flow fans 2 and 3 are respectively provided with a first housing 23 and a second housing 33. The first and second housings 23 and 33 are preferably fixed to each other through the fixing members 4 to define a hollow frame. In the axial flow fan unit 1, an air is admitted into the frame through the first axial flow fan 2 and then discharged to the outside.

Figure 2:
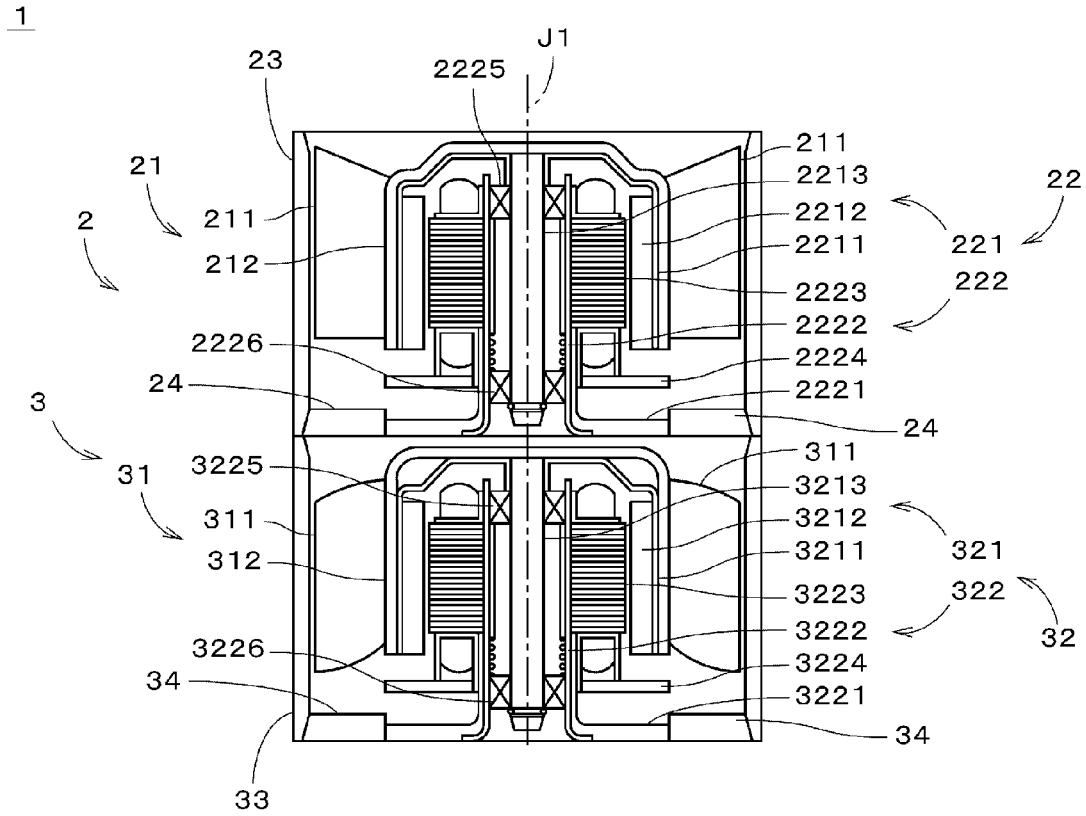
FIG. 2 is a vertical section view of the serially connected axial flow fan unit in accordance with the first preferred embodiment of the present invention.

FIG. 2 is a vertical section view of the axial flow fan unit 1 taken along a plane containing an axis J1 and extending parallel or substantially parallel to the upper end sides of the first axial flow fan 2. The axial flow fan unit 1 is preferably a so-called double contra-rotating axial flow fan unit. The rotating direction of a first impeller 21 is opposite to the rotating direction of a second impeller 31.

Preferably, the first axial flow fan 2 includes a first impeller 21, a first motor unit 22, a first housing 23 and a plurality of first support ribs 24. The first impeller 21 is arranged to be rotated about the axis J1 by the first motor unit 22. The first housing 23 has a wind tunnel portion defined by its inner circumferential surface surrounding the outer circumferences of the first impeller 21 and the first motor unit 22. The first support ribs 24 are arranged to support the first motor unit 22 and interconnect the first housing 23 and the first motor unit 22. In this preferred embodiment, the first housing 23 and the first support ribs 24 are preferably defined by a single unitary member that is preferably formed by, e.g., injection-molding a resin.

The first impeller 21 is preferably provided with a first cup 212 and a plurality of first blades 211. The cup 212 has a substantially cylindrical closed-top shape and preferably covers the outer circumference of the first motor unit 22. The first blades 211 extend radially outwards from the outer surface of the first cup 212 and are arranged at a uniform pitch in the circumferential direction. The first motor unit 22 is preferably provided with a first rotor portion 221 and a first stator portion 222.

The first rotor portion 221 is preferably provided with a first yoke 2211, a first field magnet 2212 and a first shaft 2213. The first yoke 2211 is preferably made of metal and has a substantially cylindrical closed-top shape so that it can cover the first cup 212. The first field magnet 2212 preferably has a substantially cylindrical shape and is fixed to the inner surface of the first yoke 2211. The first shaft 2213 is fixed to a cover portion of the first yoke 2211. The first rotor portion 221 is preferably defined by a single unitary member including the first impeller 21.

The first stator portion 222 is preferably provided with a first base portion 2221, a first bearing holder portion 2222, a first armature 2223 and a first circuit board 2224. The first base portion 2221 preferably has a substantially disk shape with an opening. The first bearing holder portion 2222 preferably has a substantially cylindrical shape and is arranged at the center of the first base portion 2221. The first armature 2223 is attached to the outer circumference of the first bearing holder portion 2222 and is in an opposing relationship with the first field magnet 2212. The first circuit board 2224 is arranged below the first armature 2223 and is electrically connected to the first armature 2223.

The first base portion 2221 is fixed to the substantially cylindrical inner surface of the first housing 23 through the first support ribs 24 to thereby hold the respective portions of the first stator portion 222 in place. If an electric current flows from an external power source (not shown) to the first armature 2223, a torque acting about the axis J1 is generated between the first armature 2223 and the first field magnet 2212. Ball bearings 2225 and 2226 are preferably arranged inside the first bearing holder portion 2222 at upper and lower positions thereof to rotatably support the first shaft 2213 inserted into the first bearing holder portion 2222. However, it is noted that any other desirable type of bearings could be used, for example, hydrodynamic bearings could be used.

The second axial flow fan 3 preferably has substantially the same structure as that of the first axial flow fan 2 and, preferably, includes a second impeller 31, a second motor unit 32, a second housing 33 and a plurality of second support ribs 34. The second impeller 31 has a plurality of second blades 311 arranged preferably at uniform intervals and in a reverse pitch with respect the first impeller 21.

The second motor unit 32 preferably has substantially the same structure as that of the first motor unit 22 and, preferably, includes a second rotor portion 321 and a second stator portion 322. The second rotor portion 321 preferably includes a second yoke 3211, a second field magnet 3212 and a second shaft 3213. The structures of the second yoke 3211, the second field magnet 3212 and the second shaft 3213 are substantially the same as those of the first motor unit 22.

Preferably, the second stator portion 322 includes a second base portion 3221, a second bearing holder portion 3222, a second armature 3223, a second circuit board 3224 and ball bearings 3225 and 3226, the structures of which are substantially the same as those of the first stator portion 222. Again, it is noted that any other desirable type of bearings could be used, for example, hydrodynamic bearings could be used.

The first motor unit 22 rotates the first impeller 21 to generate an air stream flowing along the axis J1. The second motor unit 32 rotates the second impeller 31 in a direction opposite to the rotating direction of the first motor unit 22, thereby generating an air stream flowing in the same direction as the flowing direction of the air stream caused by the first impeller 21. Accordingly, this makes it possible for the axial flow fan unit 1 to secure a great enough air flow rate.

Figure 3:
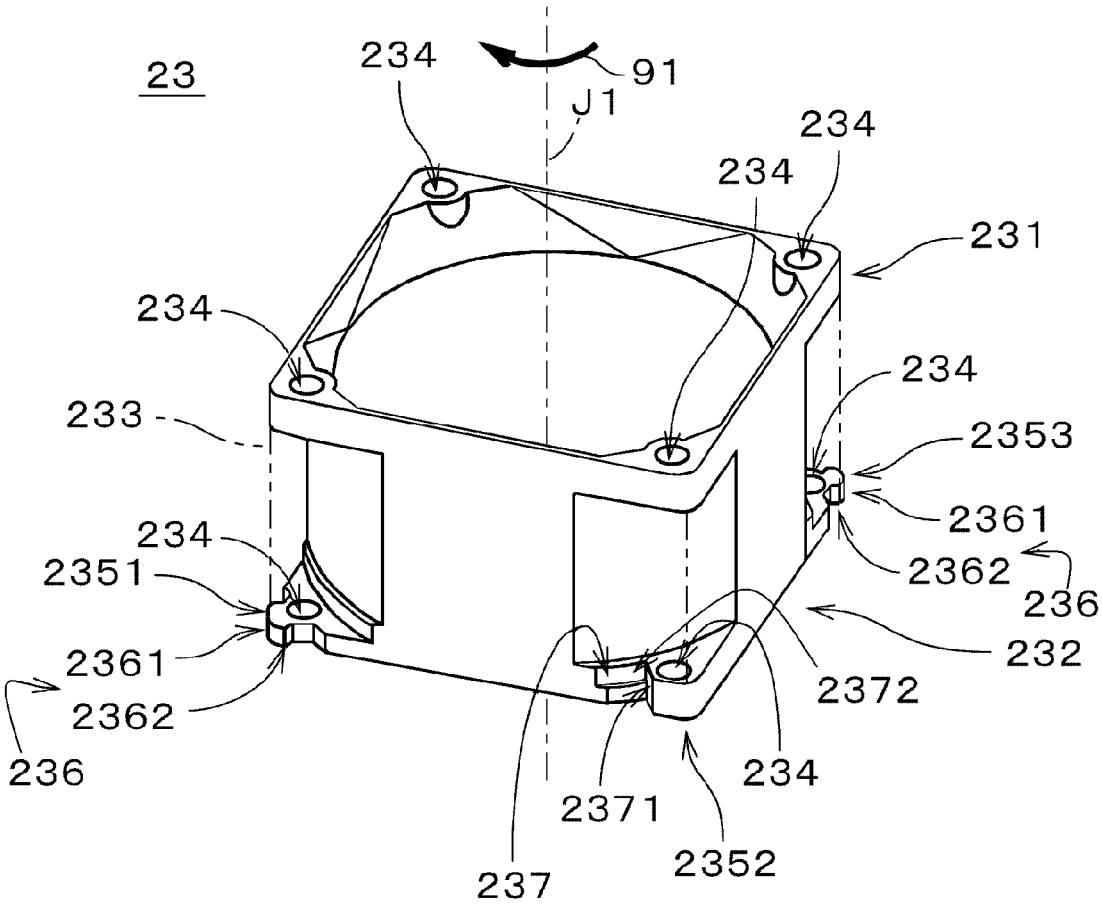
FIG. 3 is a perspective view showing a first housing employed in the axial flow fan unit of the first preferred embodiment of the present invention.
Figure 4:
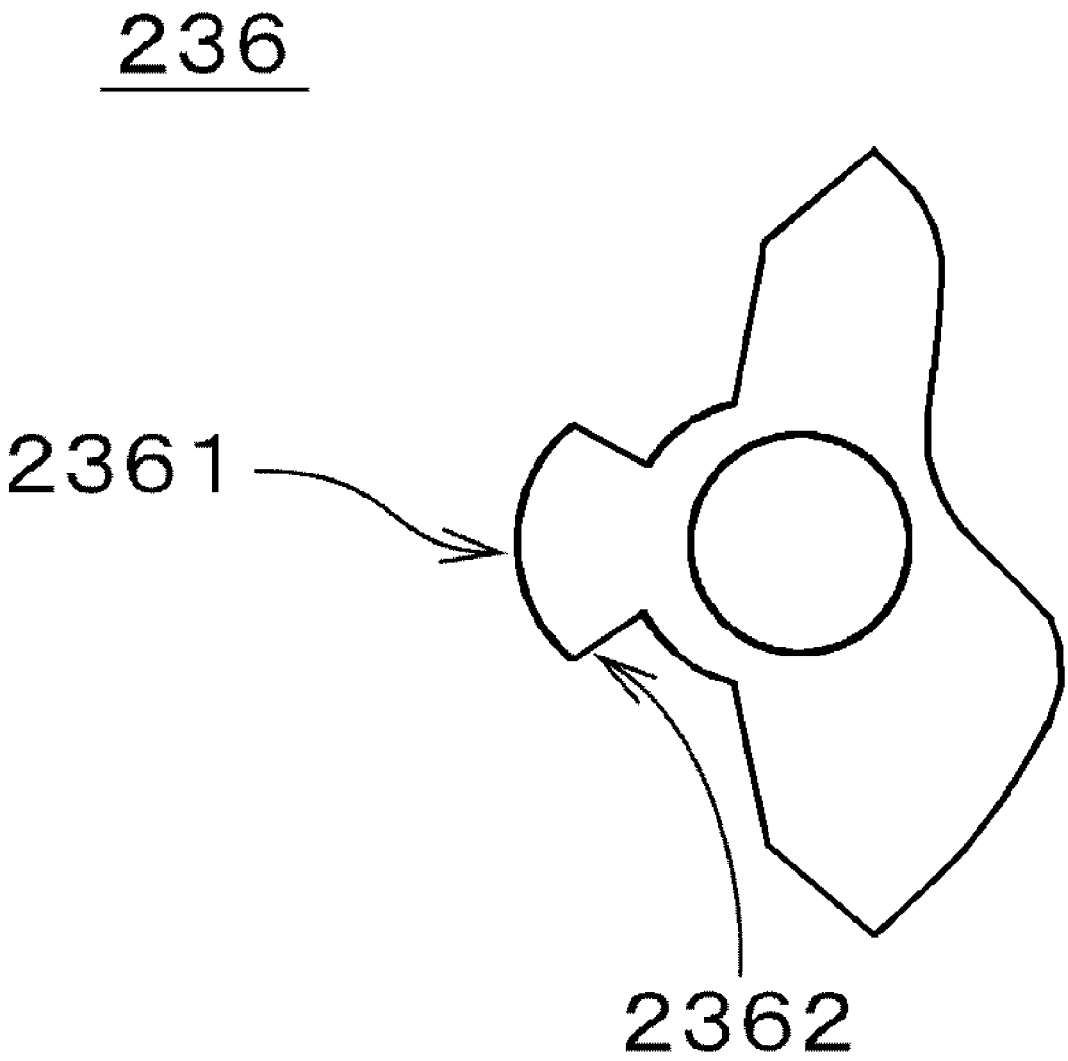
FIG. 4 is a plan view showing a corner portion of the first housing employed in the axial flow fan unit of the first preferred embodiment of the present invention.
Figure 5:
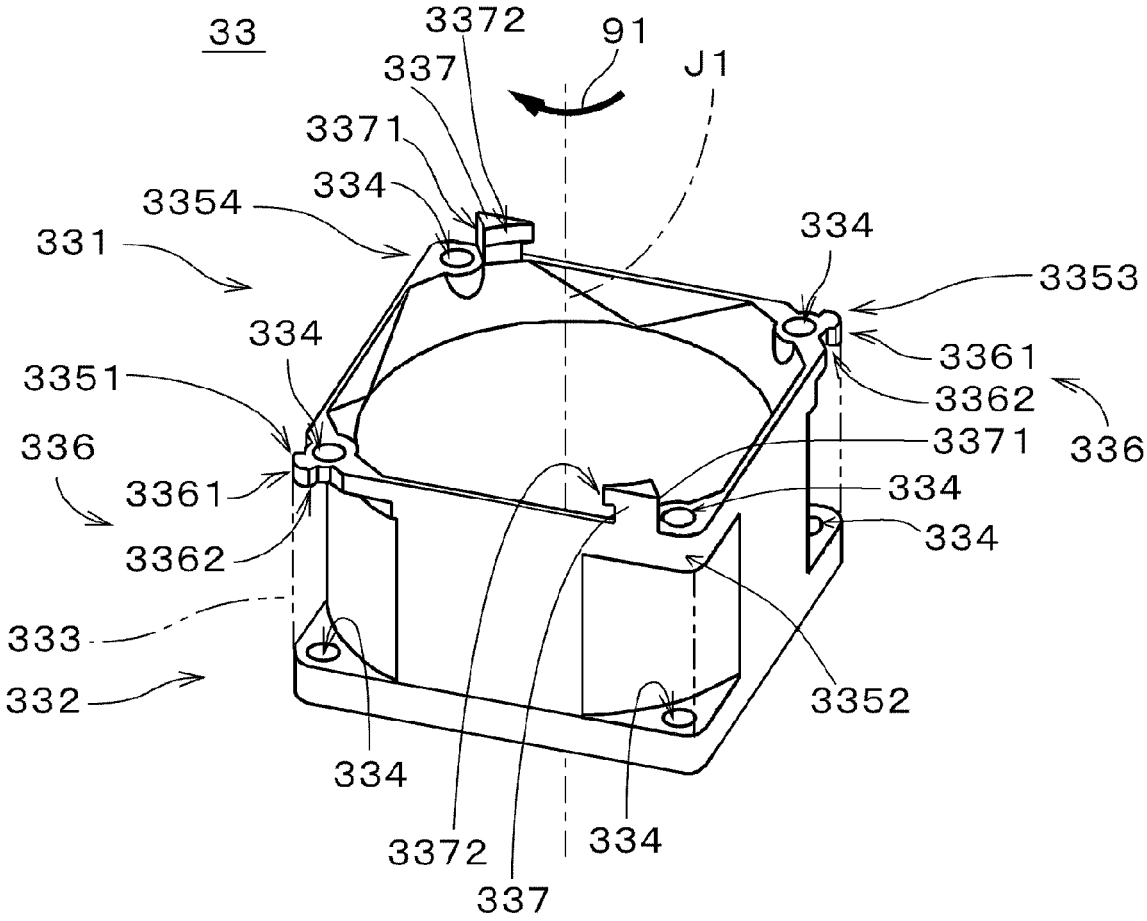
FIG. 5 is a perspective view showing a second housing employed in the axial flow fan unit of the first preferred embodiment of the present invention.

FIGS. 3 and 5 are perspective views showing the first housing 23 and the second housing 33, respectively. FIG. 4 is a plan view showing a first protrusion 236 of a corner portion 2351. In FIGS. 3 and 5, the circumferential direction about the axis J1 is indicated by an arrow 91. When assembling the axial flow fan unit 1, a lower end portion 232 of the first housing 23 comes into an opposing relationship with an upper end portion 331 of the second housing 33.

As shown in FIG. 3, an upper end portion 231 and the lower end portion 232 preferably have a generally square shape when seen in a plan view. Each of the upper end portion 231 and the lower end portion 232 has a plurality of (e.g., four) flange-shaped corner portions extending outwards generally perpendicularly to the axis J1. The contour 233 of the first housing 23, indicated by double-dotted chain lines, is in the shape of a generally square imaginary column defined by axially joining the upper end portion 231 and the lower end portion 232.

Through-holes 234 are defined in the four corner portions of the upper end portion 231 and in the four corner portions 2351 to 2354 of the lower end portion 232, respectively. Screws or other fastening elements or material will be preferably be inserted into the through-holes 234, e.g., when the axial flow fan unit 1 is to be mounted to a specified device.

Referring to FIG. 5, the second housing 33 preferably includes an upper end portion 331 and a lower end portion 332. In the second housing 33, the upper end portion 331 and the lower end portion 332 preferably have a generally square contour shape when seen in a plan view. As in the first housing 23, each of the upper end portion 331 and the lower end portion 332 of the second housing 33 has four generally flange-shaped corner portions with through-holes 334. The contour 333 of the second housing 33 is similar to the contour 233 of the first housing 23, and is also indicated by double-dotted chain lines is in the shape of a generally square imaginary column.

In the lower end portion 232, the corner portions 2351 and 2353 oppose each other with respect to the axis J1. Both of the corner portions 2351 and 2353 have a first protrusion 236 protruding radially outwards. Likewise, the corner portions 2352 and 2354 oppose each other with respect to the axis J1. Each of the corner portions 2352 and 2354 preferably has a first locking portion 237 cut along the circumferential direction.

As shown in FIGS. 3 and 4, the first protrusion 236 of the corner portion 2351 is preferably provided with an increased width portion 2362 whose circumferential width gradually increases radially outwards at its tip end 2361. Similarly, the first protrusion 236 of the corner portion 2353 is provided at its tip end 2361 with an increased width portion 2362.

As shown in FIG. 3, the first locking portion 237 is preferably defined by a first side surface 2371 and a second side surface 2372. The first side surface 2371 is perpendicular or substantially perpendicular to the circumferential direction. The second side surface 2372 extends along the circumferential direction and defines a portion of the substantially cylindrical outer surface of the first housing 23. The second side surface 2372 preferably has an upper region and a lower region protruding radially outwards relative to the upper region.

As can be seen in FIG. 5, the corner portions 3351 and 3353 are opposed to each other with respect to the axis J1. Each of the corner portions 3351 and 3353 has a second protrusion 336 protruding radially outwards. The second protrusion 336 preferably has the same shape as the first protrusion 236 and makes axial contact with the first protrusion 236 when assembling the axial flow fan unit 1. The second protrusion 336 is preferably provided with an increased width portion 3362 whose circumferential width gradually increases radially outwards at its tip end 3361.

Referring again to FIG. 5, the corner portions 3352 and 3354 oppose each other with respect to the axis J1. Each of the corner portions 3352 and 3354 has a second locking portion 337 extending in the axial direction. The second locking portion 337 is preferably defined by a first side surface 3371 and a second side surface 3372. The first side surface 3371 is perpendicular or generally perpendicular to the circumferential direction. The second side surface 3372 extends from the first side surface 3371 along the circumferential direction. The second side surface 2372 has a lower region and an upper region protruding radially inwards relative to the lower region.

If the axial flow fan unit 1 is arranged as shown in FIG. 1, the first locking portions 237 and the second locking portions 337 are locked against one another in the corner portions 2352, 2354, 3352 and 3354. At this time, the first side surface 2371 and the first side surface 3371 come into contact with each other in the circumferential direction, whereas the lower region of the second side surface 2372 and the upper region of the second side surface 3372 engage with each other in the axial direction.

Thus, the lower end portion 232 of the first housing 23 and the upper end portion 331 of the second housing 33 are prevented from relative movement in the axial direction and in the direction indicated by the arrow 92.

Figure 6:
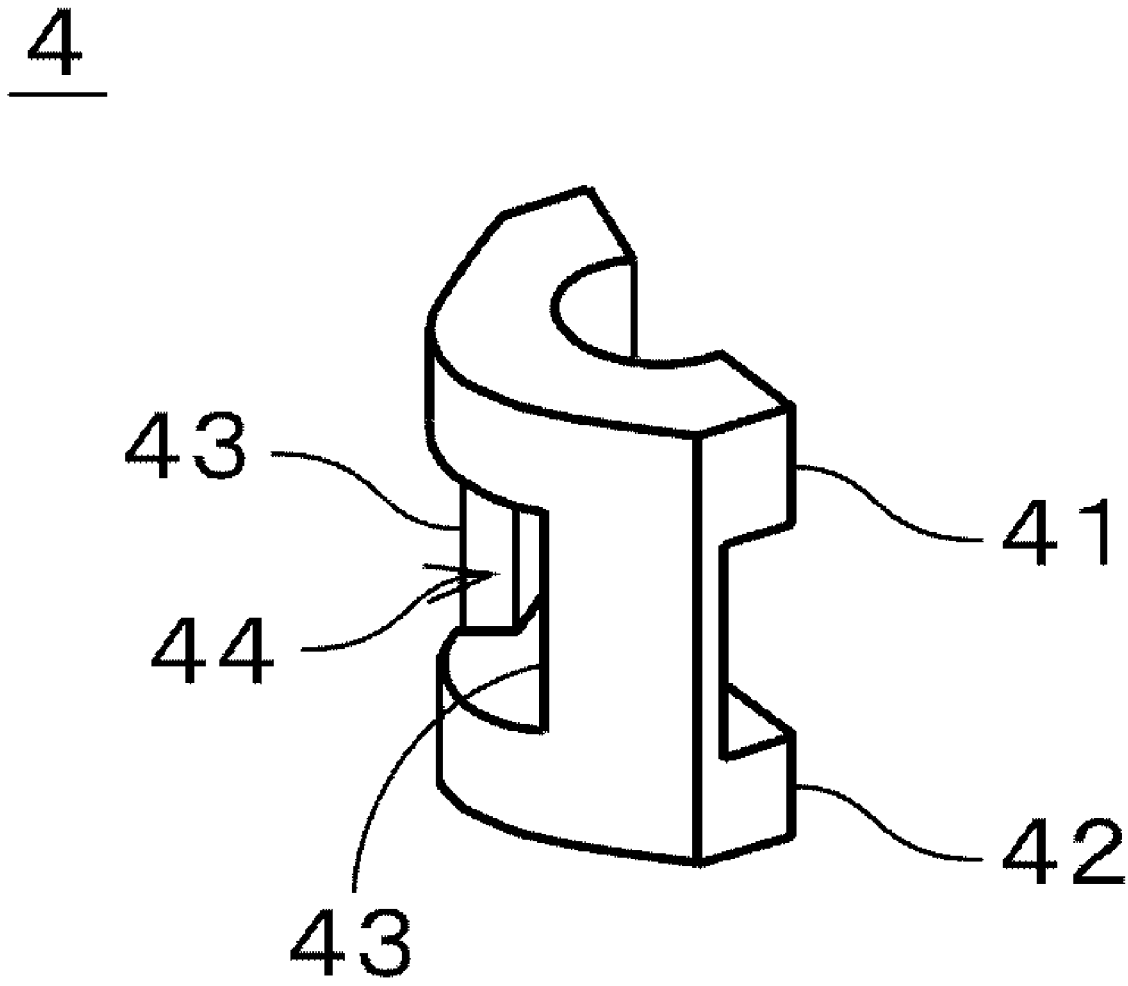
FIG. 6 is a perspective view showing a fixing member employed in the axial flow fan unit of the first preferred embodiment of the present invention.
Figure 7:
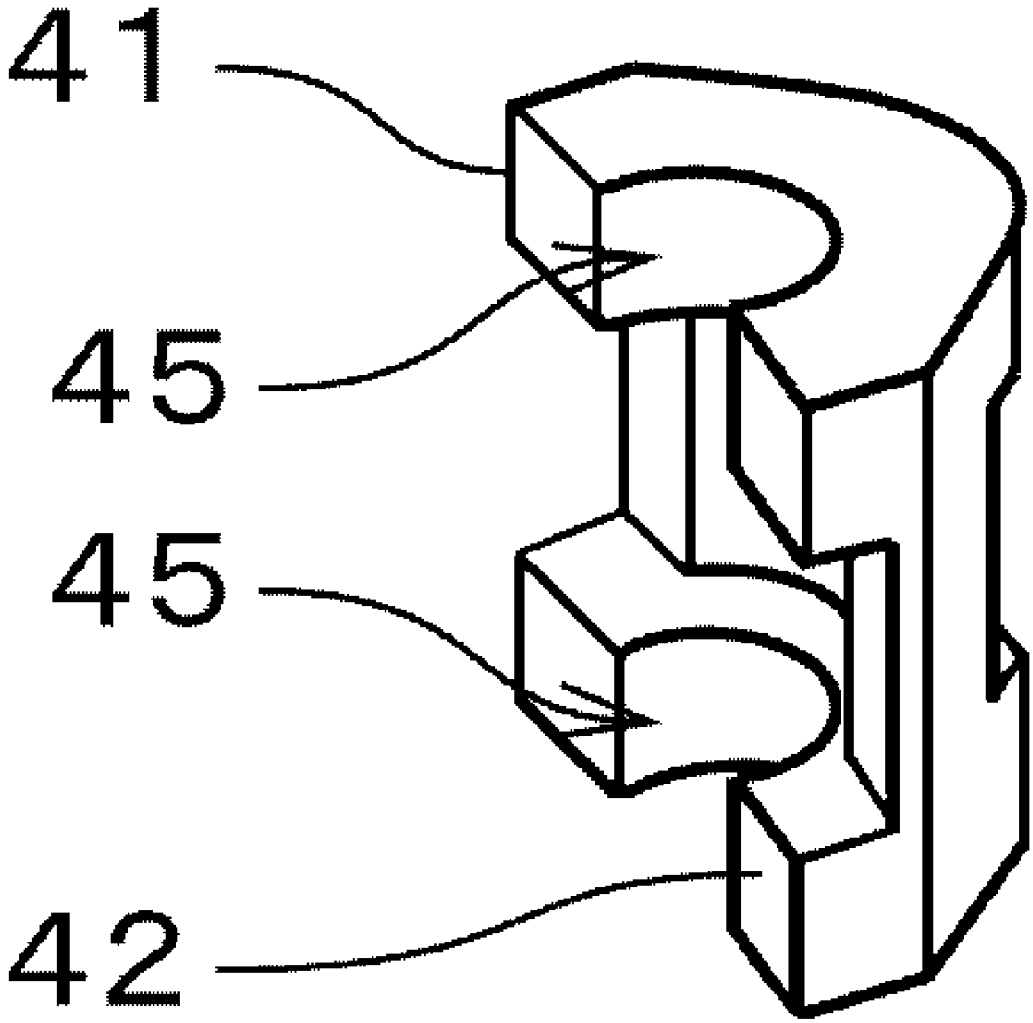
FIG. 7 is another perspective view showing the fixing member employed in the axial flow fan unit of the first preferred embodiment of the present invention.

FIG. 6 is a perspective view showing a fixing member 4. FIG. 7 is another perspective view of the fixing member 4, in which the fixing member 4 is horizontally inverted from the state shown in FIG. 6. The fixing member 4 is preferably made of, e.g., a resin material, and is preferably provided with an upper portion 41, a lower portion 42 and a plurality of (e.g., two) side portions 43 interconnecting the upper portion 41 and the lower portion 42. The fixing member 4 has a hole portion 44 surrounded by the upper portion 41, the lower portion 42 and the side portions 43. A generally semi-cylindrical groove portion 45 is defined on the inner surface of each of the upper portion 41 and the lower portion 42.

As shown in FIG. 1, the first protrusion 236 and the second protrusion 336 are inserted into the hole portion 44 such that they are overlapping with each other, thereby allowing the fixing member 4 to engage with the first protrusion 236 and the second protrusion 336. More specifically, once inserted into the hole portion 44, the overlapping first and second protrusions 236 and 336 are circumferentially interposed between the side portions 43 and axially interposed between the upper portion 41 and the lower portion 42.

Consequently, the lower end portion 232 is locked against the upper end portion 331, which prevents the lower end portion 232 and the upper end portion 331 relative movement in the axial direction and in the directions indicated by the arrows 91 and 93. Thus the first housing 23 is prevented from moving relative to the second housing 33 in the axial direction and in the direction perpendicular or substantially perpendicular to the axis J1.

Referring again to FIG. 1, the fixing member 4 defines a portion of the flange portion 5 in cooperation with the corner portions 2351, 2353, 3351 and 3353 and is attached to each of the corner portions in such a way as to not protrude outwards beyond either contour 233 or 333.

As a result, even when the fixing member 4 is attached to each of the corner portions, the flange portion 5 is kept inside a substantially cylindrical columnar imaginary contour defined by the contours 233 and 333. This makes it possible to reduce the size of the axial flow fan unit 1.

Figure 8:
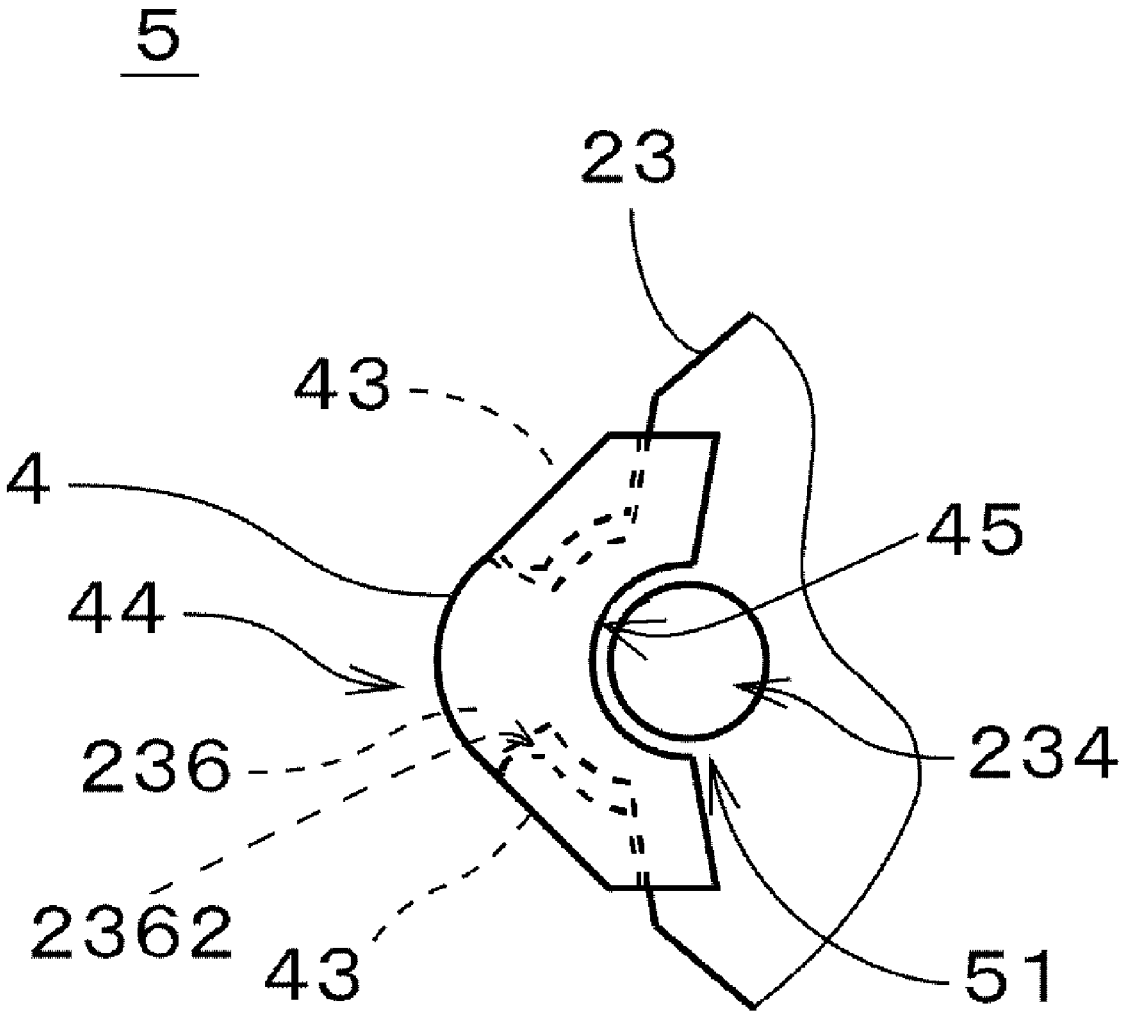
FIG. 8 is a plan view showing a corner portion employed in the axial flow fan unit of the first preferred embodiment of the present invention.

FIG. 8 is a plan view showing the flange portion 5 that corresponds to the corner portions 2351 and 3351 shown in FIG. 1. At the inner side of the flange portion 5, a through-hole 51 is preferably defined by the groove portion 45, the through-hole 234 and the through-hole 334.

In the through-hole 51, the radius of a semi-cylindrical surface of the groove portion 45 is greater than the radius of inner surfaces of the through-holes 234 and 334. Therefore, the screw or other fastening element preferably used in fixing the axial flow fan unit 1 to a specified device can be reliably inserted through the through-hole 51 with little likelihood of the through-holes 234 and 334 being blocked by the groove portion 45.

The through-hole 51 may be, e.g., a through-hole into which a screw is removably inserted to fix the first housing 23 to the second housing 33. However, the usage of the through-hole 51 is not particularly limited. The flange portion 5 corresponding to the corner portions 2353 and 3353 preferably has the same structure as set forth above.

Figure 9:
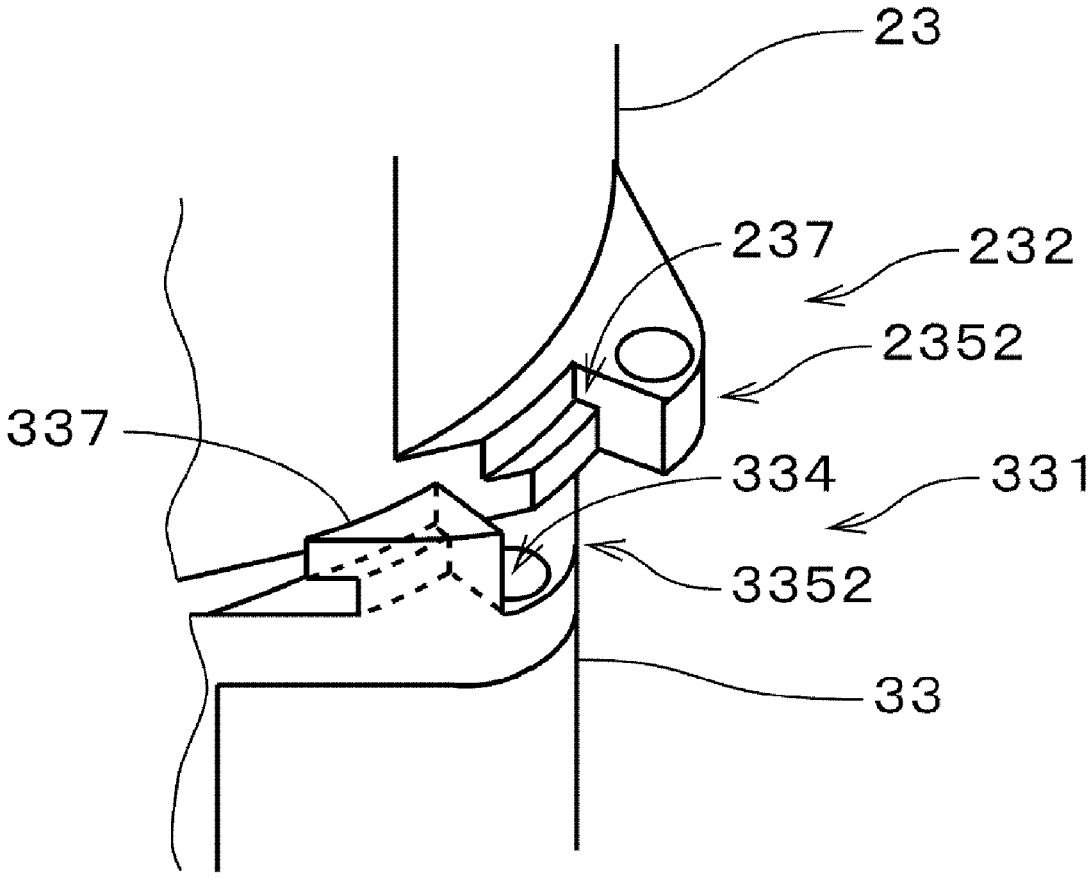
FIG. 9 is a perspective view showing a corner portion of the first housing and a corner portion of the second housing employed in the axial flow fan unit of the first preferred embodiment of the present invention.
Figure 10:
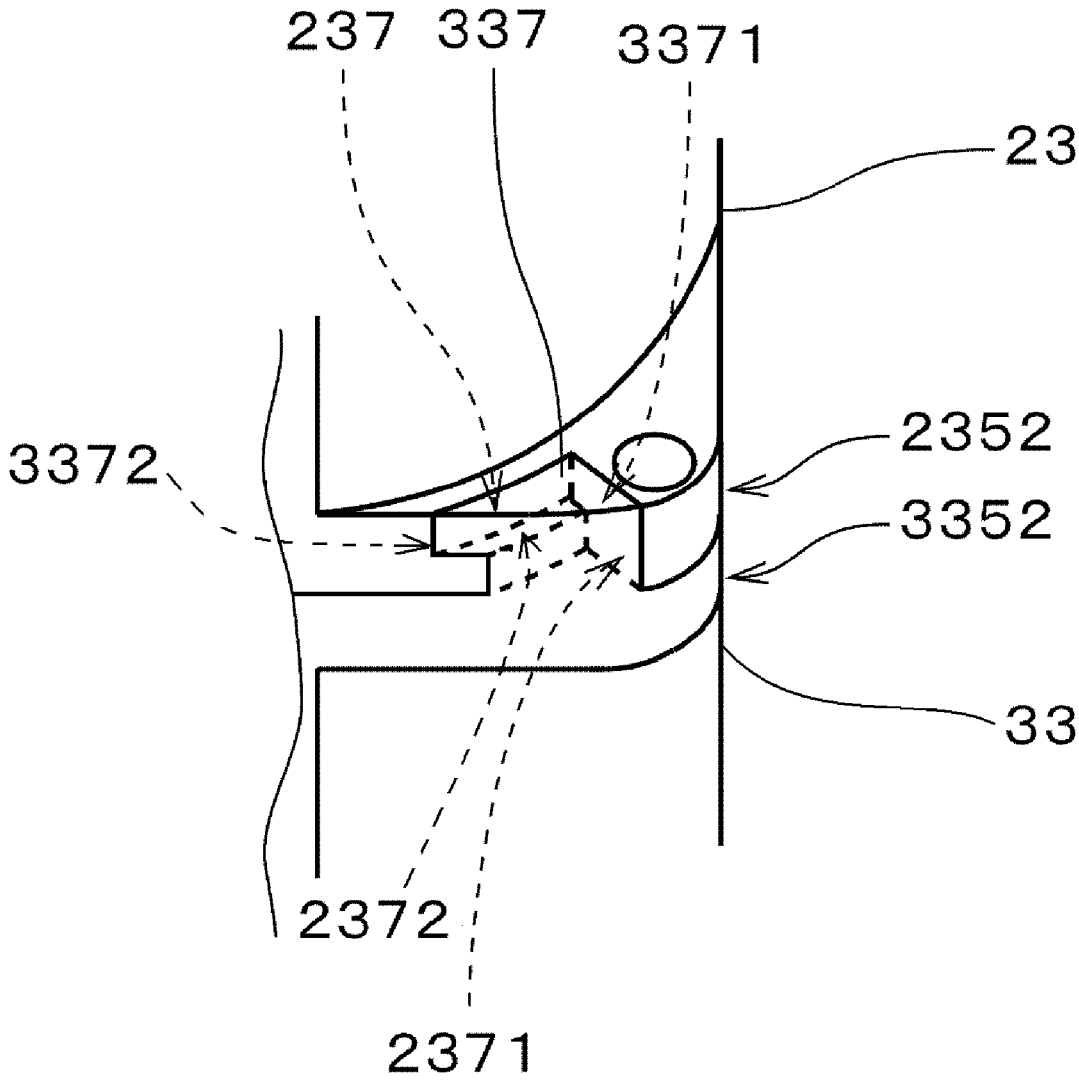
FIG. 10 is another perspective view showing the corner portion of the first housing and the corner portion of the second housing employed in the axial flow fan unit of the first preferred embodiment of the present invention.

Next, a description will be provided of an example of the fabrication process of the axial flow fan unit 1. FIGS. 9 and 10 are perspective views showing the corner portions 2352 and 3352. In order to assemble the axial flow fan unit 1, the first housing 23 and the second housing 33 are first brought into an axially opposing relationship so that the lower end portion 232 and the upper end portion 331 can oppose each other. At this time, each of the corner portions 2351 to 2354 are out of alignment with the corresponding corner portions 3351 to 3354 in the direction opposite to the direction indicated by the arrow 91.

Thereafter, the first housing 23 is axially moved toward the second housing 33 to make contact with the same. As can be seen in FIG. 9, the first locking portion 237 is positioned opposite to the second locking portion 337 with the through-hole 334 positioned therebetween.

If the lower end portion 232 is rotated relative to the upper end portion 331 in the direction indicated by the arrow 91, the first side surface 2371 comes into contact with the first side surface 3371 as shown in FIG. 10. In addition, the lower region of the second side surface 2372 comes into contact with the upper region of the second side surface 3372 in the axial direction.

As a result, the first locking portion 237 and the second locking portion 337 engage with each other in the axial direction and in the direction indicated by the arrow 91. This holds true with the corner portions 2354 and 3354 also.

Through the process noted above, the first housing 23 is locked against (i.e., tentatively fixed to) the second housing 33 and is prevented from movement relative to the second housing 33 in the direction indicated by the arrow 92 or making rotation relative thereto. This makes it possible to easily align the first housing 23 with the second housing 33 when attaching the fixing member 4 after this tentative fixing operation, thereby reducing the number of steps and the time required in the assembling process.

The engagement between the first housing 23 and the second housing 33 is released by rotating the first housing 23 relative to the second housing 33 in the direction opposite to the direction indicated by the arrow 91. This makes it possible to separate the first housing 23 and the second housing 33 from each other.

Figure 11:
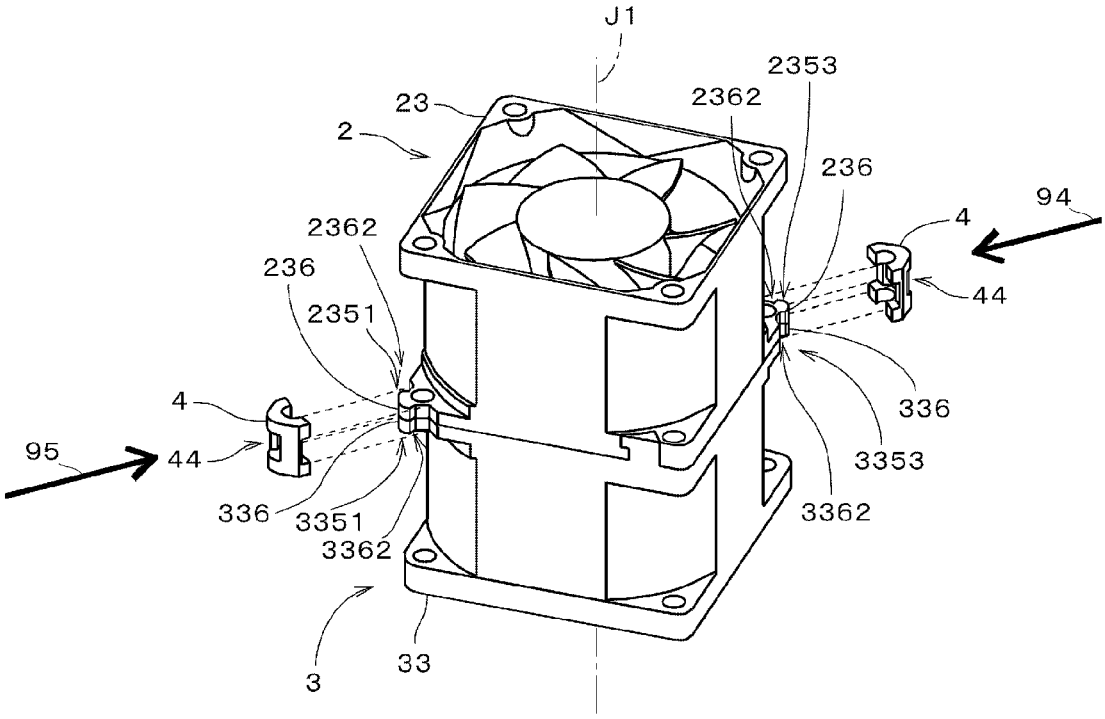
FIG. 11 is a view showing the manner in which the fixing members are attached to the first and second axial flow fans employed in the axial flow fan unit of the first preferred embodiment of the present invention.

FIG. 11 is a perspective view of the axial flow fan unit 1, illustrating the manner in which the fixing members 4 are attached to the first axial flow fan 2 and the second axial flow fan 3. After the first housing 23 is tentatively fixed to the second housing 33, the fixing members 4 are slid in the directions indicated by arrows 94 and 95 and are attached to the first and second protrusions 236 and 336.

As can be seen in FIG. 8, the minimum circumferential width of the hole portion 44 (i.e., the minimum distance between the two side portions 43) is preferably smaller than the maximum width of the increased width portions 2362 and 3362. Thus, the hole portion 44 is elastically deformed as the first and second protrusions 236 and 336 are inserted into the hole portion 44. Under the action of the restoring forces imparted by the surrounding portions of the hole portion 44, each of the fixing members 4 is firmly fixed to the first and second protrusions 236 and 336.

The axial flow fan unit 1 is completely assembled through the operation set forth above.

Next, a description will be provided of the operation of separating the first axial flow fan 2 and the second axial flow fan 3 from each other. With the axial flow fan unit 1 kept in the state shown in FIG. 1, the fixing members 4 are first removed from the first and second housings 23 and 33.

Then the first housing 23 is rotated relative to the second housing 33 in the direction opposite to the direction indicated by the arrow 91, thereby releasing the engagement between the first locking portion 237 and the second locking portion 337. Thereafter, the first housing 23 is axially moved away from the second housing 33 to separate the first and second housings 23 and 33 from each other.

This minimizes or prevents damage to the afore-mentioned engagement structures, which would otherwise be caused during the course of separating the first and second housings 23 and 33 from each other. This also makes it possible to easily dismantle the axial flow fan unit 1 assembled before. And as a result, it is possible to reuse the first axial flow fan 2 and the second axial flow fan 3.

In this preferred embodiment, the fixing members 4 are preferably made of resin, for example. This prevents damage of the first and second housings 23 and 33 which may be caused in the process of attaching the fixing members 4. Alternatively, the fixing members 4 may be made of any other desirable material other than resin.

Since the fixing members 4 and the first and second locking portions 237 and 337 are provided in the flange-shaped portions of the first and second housings 23 and 33, they are prevented from affecting the size of wind tunnel portions of the first and second housings 23 and 33. This prevents reduction of the static pressure and flow rate characteristics in the axial flow fan unit 1.

Second Preferred Embodiment

Figure 12:
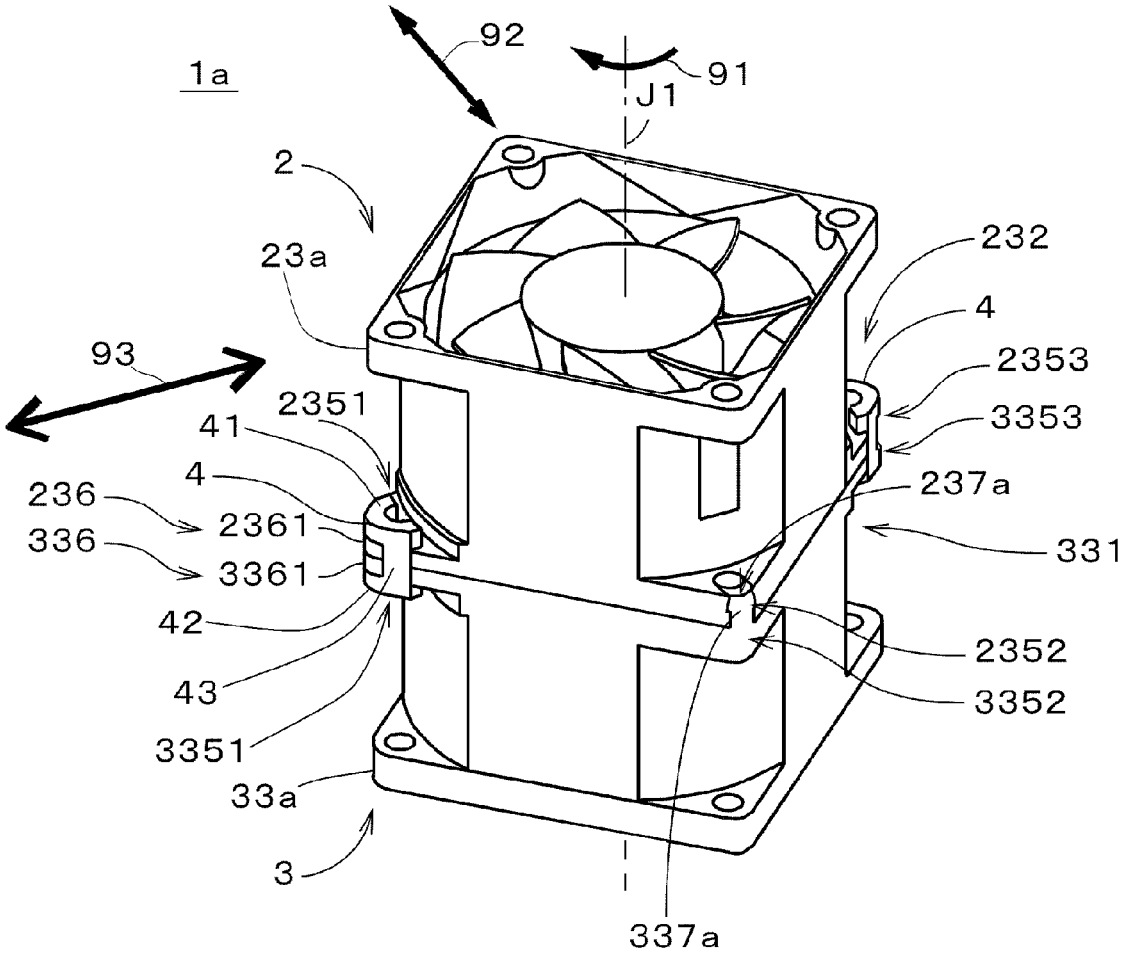
FIG. 12 is a perspective view showing a serially connected axial flow fan unit in accordance with a second preferred embodiment of the present invention.
Figure 13:
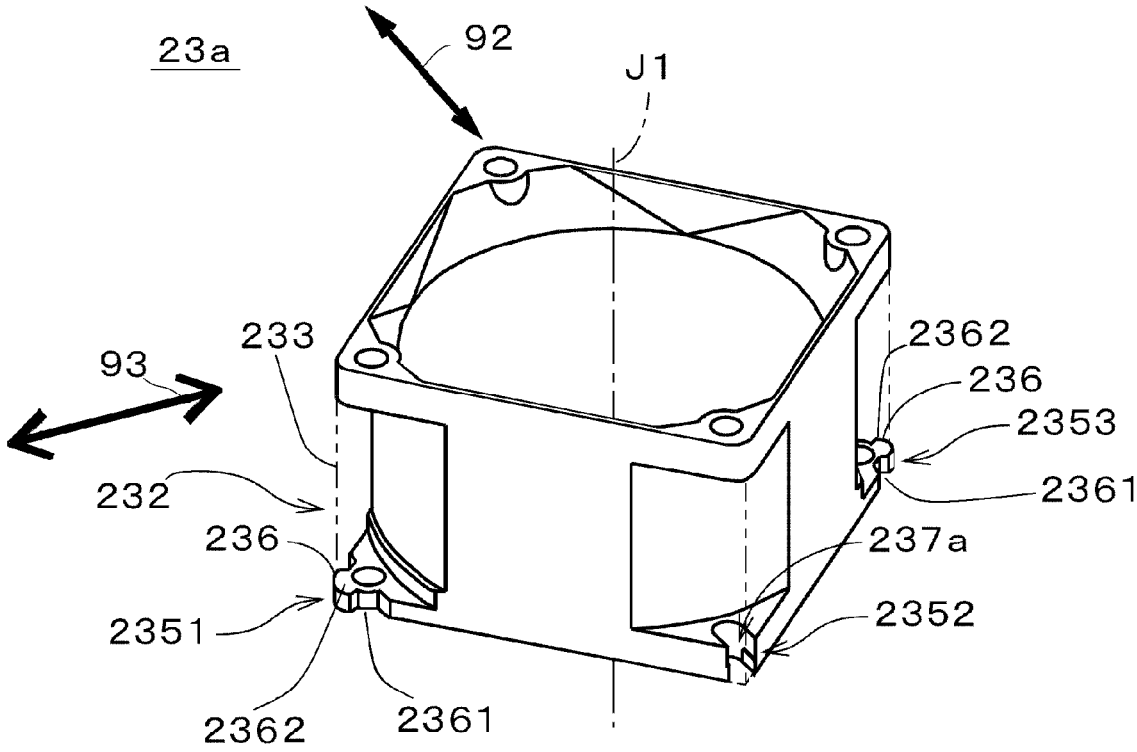
FIG. 13 is a perspective view showing a first housing employed in the axial flow fan unit of the second preferred embodiment of the present invention.
Figure 14:
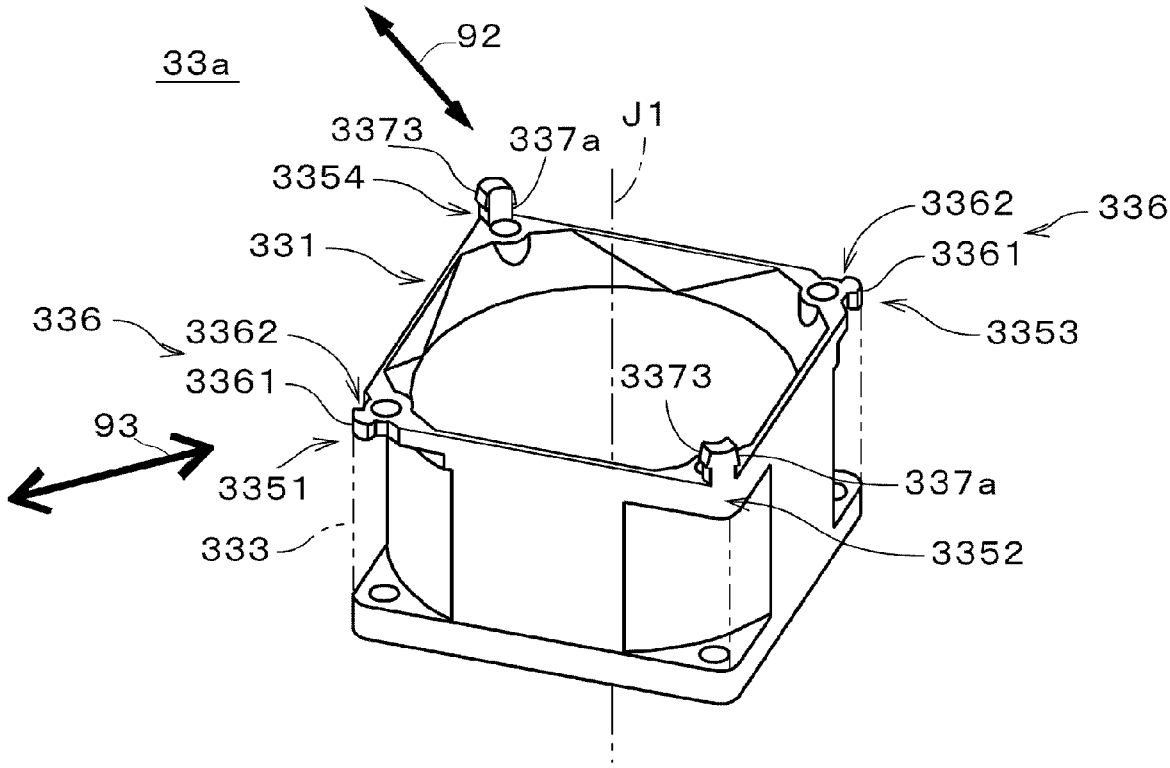
FIG. 14 is a perspective view showing a second housing employed in the axial flow fan unit of the second preferred embodiment of the present invention.
Figure 15:
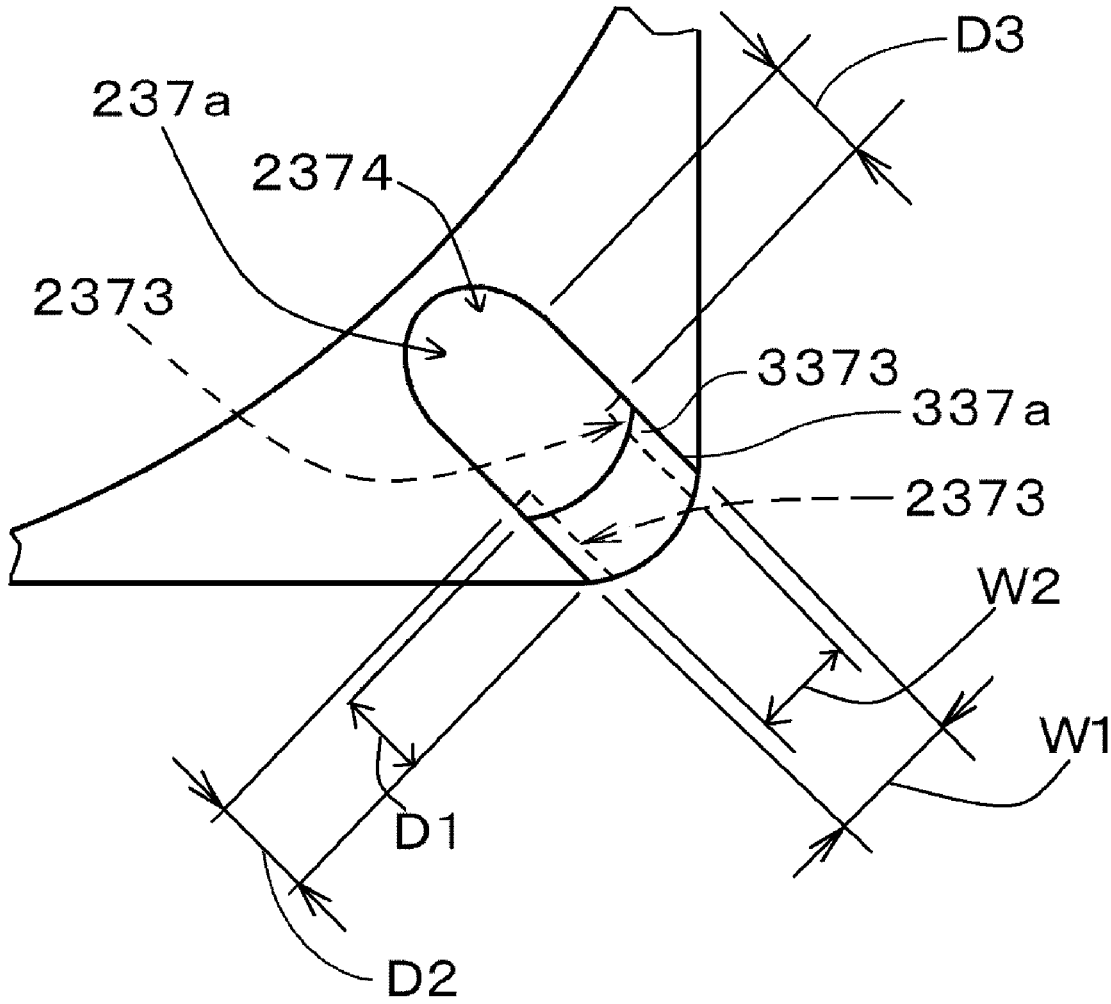
FIG. 15 is a plan view showing a corner portion employed in the axial flow fan unit of the second preferred embodiment of the present invention.

FIG. 12 is a perspective view showing a serially connected axial flow fan unit 1*a* in accordance with a second preferred embodiment of the present invention. FIGS. 13 and 14 are perspective views showing a first housing 23*a* and a second housing 33*a*. FIG. 15 is an enlarged plan view showing the corner portions 2352 and 3352 of the axial flow fan unit 1*a* shown in FIG. 12, in which view the corner portions 2352 and 3352 are illustrated in an axially overlapping state.

As shown in FIGS. 12, 13 and 15, a first protrusion 236 is defined in each of the corner portions 2351 and 2353, whereas a first locking portion 237*a* is defined in each of the corner portions 2352 and 2354.

The first locking portion 237*a* preferably has a general U-shape when seen in a plan view and includes a plurality of (e.g., two) step portions 2373 and an inner piercing portion 2374. The step portions 2373 are indicated by broken lines in FIG. 15 and are arranged radially outwards of the first locking portion 237*a* in a mutually opposing relationship. The inner piercing portion 2374 is arranged radially inwards of the step portions 2373 and is axially pierced through the corresponding one of the corner portions.

As shown in FIGS. 12 and 14, a second protrusion 336 is defined in each of the corner portions 3351 and 3353, whereas a second locking portion 337*a* is defined in each of the corner portions 3352 and 3354.

The second locking portion 337*a* has a tip end 3373 whose upper region protrudes outwards in the circumferential direction more than the lower region thereof. The tip end 3373 is preferably shaped such that the circumferential width thereof gradually increases as it moves downwards.

As can be seen in FIG. 15, the radial width D1 of the second locking portion 337*a* preferably is generally equal to the radial width D2 of the step portions 2373 and is preferably equal to or smaller than the radial width D3 of the inner piercing portion 2374.

The circumferential width W1 of the tip end 3373 is greater than the circumferential width W2 between the lower regions of the step portions 2373 and is equal to or smaller than the circumferential width between the upper regions of the step portions 2373 and the circumferential width of the inner piercing portion 2374.

When the first housing 23*a* and the second housing 33*a* are combined together as shown in FIG. 12, the second locking portion 337*a* is fit into the step portions 2373 in the corner portions 2352, 2354, 3352 and 3354 so that the first locking portion 237*a* and the second locking portion 337*a* can engage with each other.

This prevents the lower end portion 232 from movement relative to the upper end portion 331 in the axial direction and in the direction indicated by the arrow 92. As shown in FIG. 15, a through-hole is defined by the radially inwardly facing surface of the second locking portion 337*a* and the inner surface of the inner piercing portion 2374.

Referring again to FIG. 12, the fixing members 4 are attached to the first and second protrusions 236 and 336 in the corner portions 2351, 2353, 3351 and 3353. As in the first preferred embodiment, the lower end portion 232 is axially fixed relative to the upper end portion 331 and is prevented from relative movement in the axial direction and in the directions indicated by the arrows 91 and 93.

The use of the aforementioned structures in the second preferred embodiment prevents the first housing 23*a* from movement relative to the second housing 33*a* in the axial direction and in the direction perpendicular to the axis J1.

As in the first preferred embodiment, when coupling the first housing 23*a* and the second housing 33*a* together, the first housing 23*a* is moved toward the second housing 33*a* such that the contour 233 of the first housing 23*a* can be aligned with the contour 333 of the second housing 33*a*.

In the corner portions 2352, 2354, 3352 and 3354, the second locking portion 337*a* is inserted between the step portions 2373 from below while undergoing elastic deformation in the circumferential direction such that it comes into engagement with the step portions 2373 in the axial direction and in the direction indicated by the arrow 93.

Through the process set forth above, the first housing 23*a* is tentatively fixed to the second housing 33*a*. This makes it easy to perform the task of aligning the first housing 23*a* with the second housing 33*a* and to attach the fixing members 4 to the first and second housings 23*a* and 33*a*.

As in the first preferred embodiment, the fixing members 4 are attached to the first and second protrusion portions 236 and 336 after the first and second housings 23*a* and 33*a* have been tentatively fixed to each other.

The axial flow fan unit 1*a* is completely assembled through the operation set forth above.

When one wishes to bring the first locking portion 237*a* into engagement with the second locking portion 337*a* by sliding the first locking portion 237*a* within a plane perpendicular or substantially perpendicular to the axis J1, there would be a need to insert one of the two second locking portion 337*a* into the inner piercing portion 2374 of the corresponding first locking portion 237*a* and to cause the other to radially oppose the corresponding first locking portion 237*a* with increased accuracy. This may possibly make the operation complicated.

Next, description will be provided of the operation of separating the first housing 23*a* and the second housing 33*a* from each other. As in the first preferred embodiment, the fixing members 4 are first removed from the axial flow fan unit 1*a*. Then the first housing 23*a* is moved relative to the second housing 33*a* in the direction opposite to the direction indicated by the arrow 92. This releases the engagement between the first locking portion 237*a* and the second locking portion 337*a*, thereby making it possible to separate the first and second housings 23*a* and 33*a* from each other.

The radial width and circumferential width of the tip end 3373 is smaller than the radial width and circumferential width of the inner piercing portion 2374. This makes it possible to easily separate the first and second housings 23*a* and 33*a* from each other while minimizing damage thereto.

Third Preferred Embodiment

Figure 16:
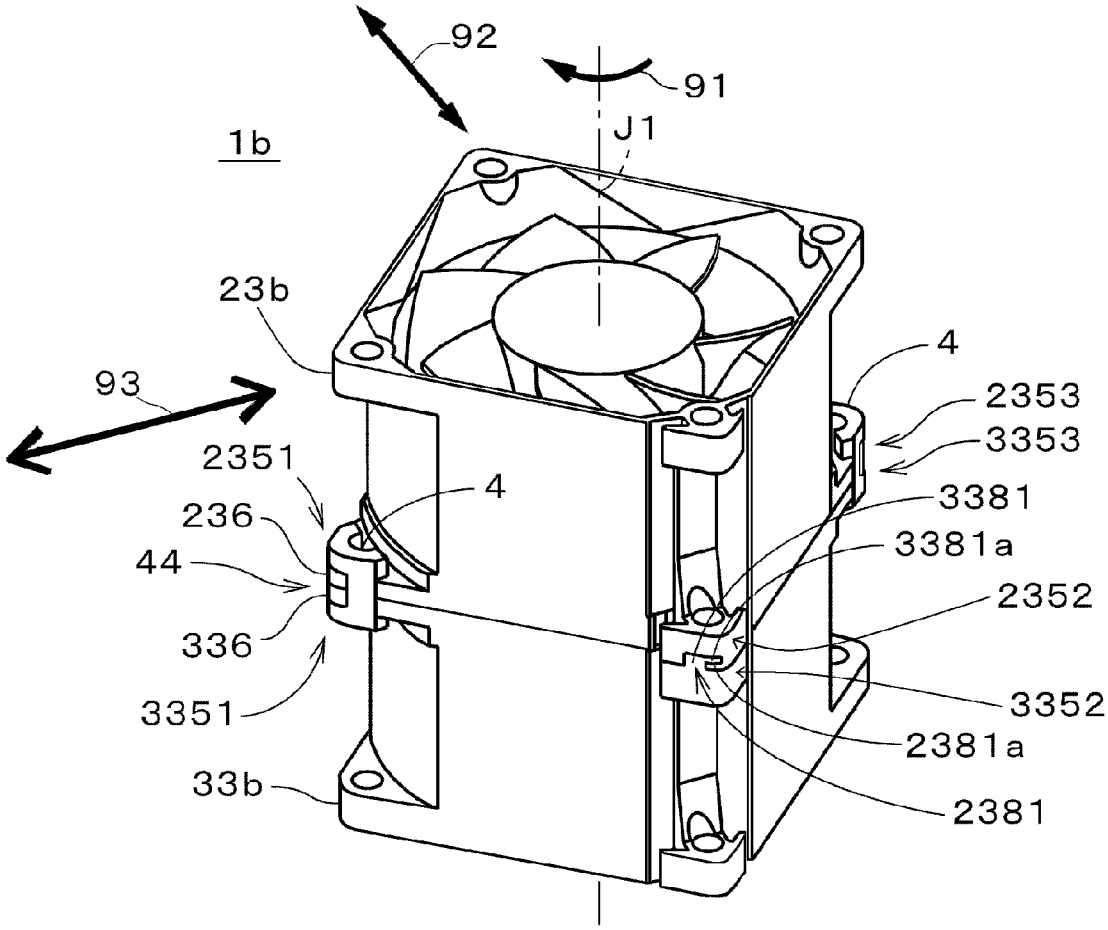
FIG. 16 is a perspective view showing a serially connected axial flow fan unit in accordance with a third preferred embodiment of the present invention.
Figure 17:
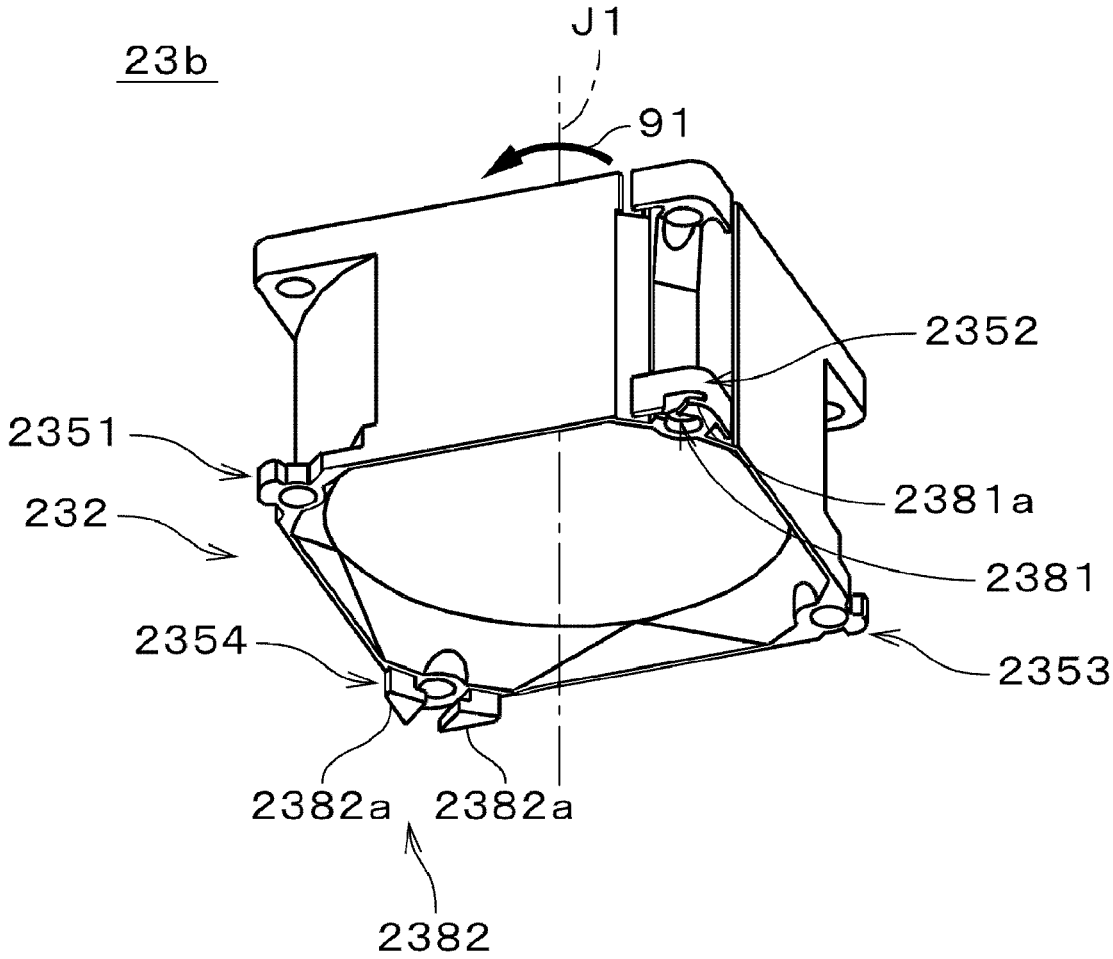
FIG. 17 is a perspective view showing a first housing employed in the axial flow fan unit of the third preferred embodiment of the present invention.
Figure 18:
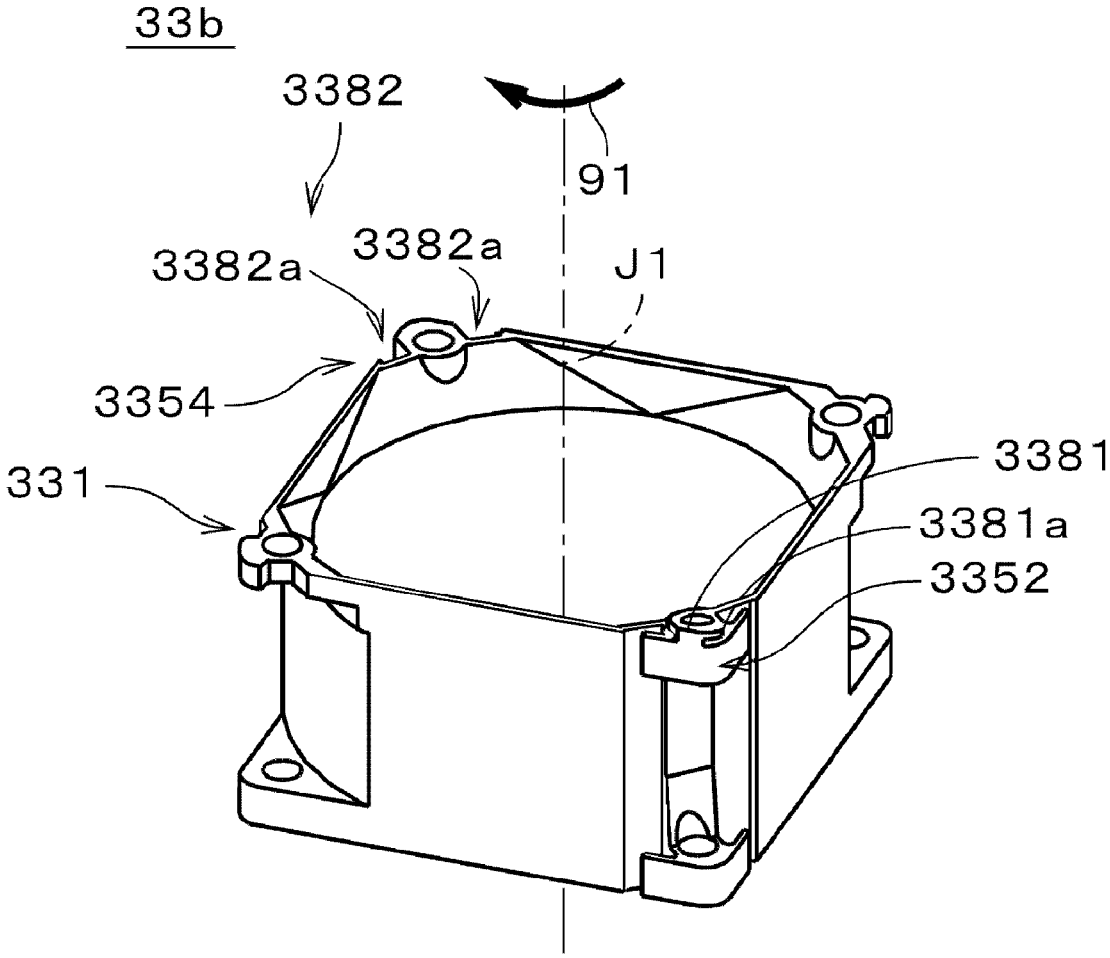
FIG. 18 is a perspective view showing a second housing employed in the axial flow fan unit of the third preferred embodiment of the present invention.
Figure 19:
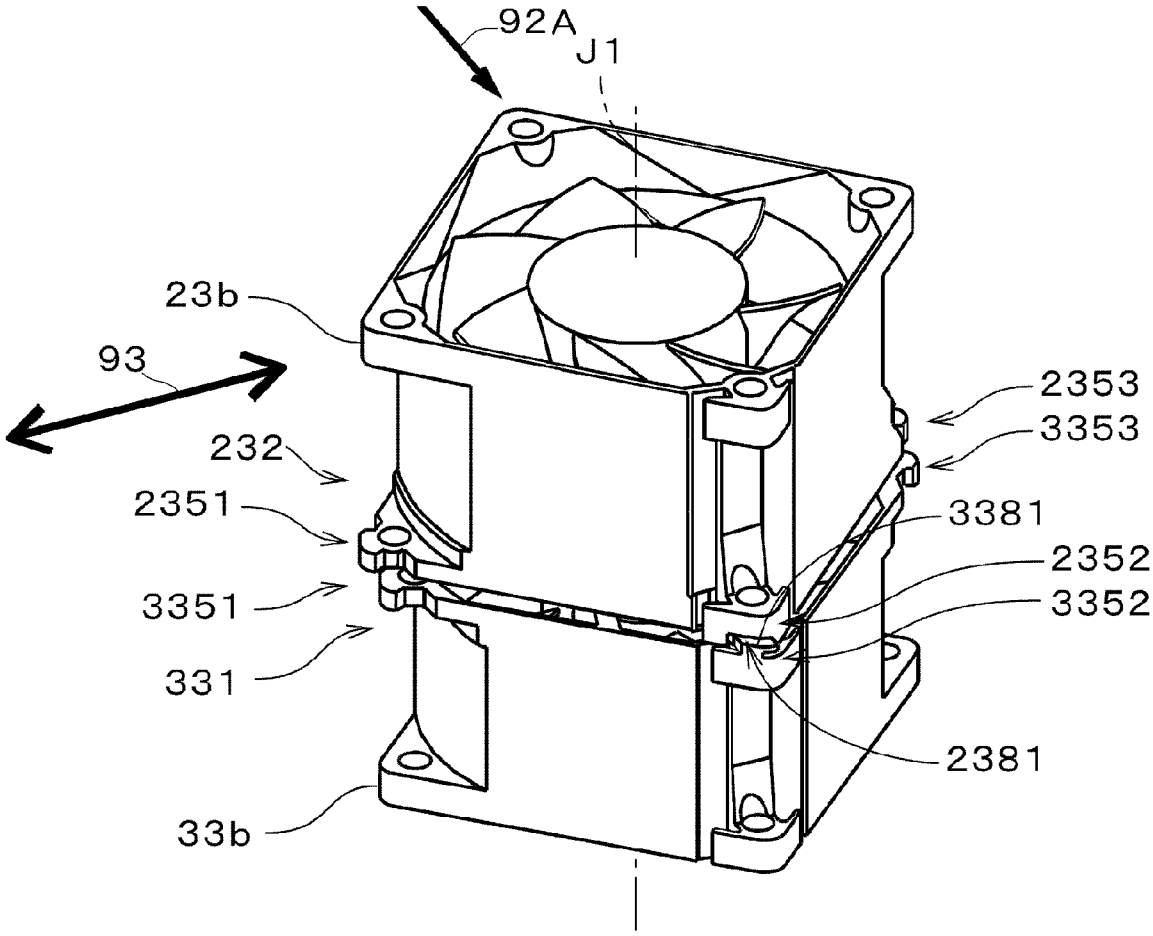
FIG. 19 is a perspective view showing a first axial flow fan and a second axial flow fan employed in the axial flow fan unit of the third preferred embodiment of the present invention.

FIG. 16 is a perspective view showing a serially connected axial flow fan unit 1*b* in accordance with a third preferred embodiment of the present invention. FIG. 17 is a perspective view showing a first housing 23*b*, in which a view of the lower end portion 232 is fully depicted. FIG. 18 is a perspective view showing a second housing 33*b*, in which view the upper end portion 331 is fully depicted.

As shown in FIGS. 16 and 17, a first protrusion 236 is defined in each of the corner portions 2351 and 2353.

A third locking portion 2381 having a circumferentially extending protrusion 2381*a* is arranged in the corner portion 2352.

A fourth locking portion 2382 including two raised portions 2382*a* is arranged in the corner portion 2354. The raised portions 2382*a* are arranged side by side in the circumferential direction and are preferably provided with generally L-shaped lower ends protruding toward each other.

As shown in FIGS. 16 and 18, a second protrusion 336 is defined in each of the corner portions 3351 and 3353.

A fifth locking portion 3381 having a tip end 3381*a* protruding in the direction opposite to the direction indicated by the arrow 91 is arranged in the corner portion 3352.

A sixth locking portion 3382 including two recessed portions 3382*a* is arranged in the corner portion 3354. When seen from the radial direction, the recessed portions 3382*a* have a generally L-like shape complementary to the shape of the raised portions 2382*a*.

Referring to FIG. 16, the fixing members 4 are attached to the first and second protrusions 236 and 336 as is the case in the preceding preferred embodiments.

In the corner portions 2352 and 3352, the third locking portion 2381 engages with the fifth locking portion 3381. More specifically, the protrusion 2381*a* makes contact with the tip end 3381*a* in the vertical direction and the fifth locking portion 3381 makes contact with the circumferential opposite sides of the third locking portion 2381. In the corner portions 2354 and 3354, the raised portions 2382*a* make contact with the recessed portions 3382*a* in the axial and circumferential directions.

This prevents the first housing 23*b* from making movement relative to the second housing 33*b* in the axial direction and in the directions perpendicular or substantially perpendicular to the axis J1 including the directions indicated by the arrows 91, 92 and 93.

Next, a description will be provided of the task of coupling the first housing 23*b* and the second housing 33*b* together. As in the preceding preferred embodiments, the upper end portion 331 is first arranged in an opposing relationship with the lower end portion 232 but out of alignment with the lower end portion 232 in the direction indicated by an arrow 92A. Then the lower end portion 232 is moved in the direction indicated by the arrow 92A to oppose the upper end portion 331.

Subsequently, the third locking portion 2381 and the fifth locking portion 3381 engage with each other in the axial direction and in the direction indicated by the arrow 92. In the corner portions 2354 and 3354, the raised portions 2382*a* and the recessed portions 3382*a* engage with each other in the axial direction and in the direction indicated by the arrow 91. As in the preceding preferred embodiments, the fixing members 4 are then attached to the first and second protrusions 236 and 336 overlapping with each other.

With the structures set forth above, the first housing 23*b* is easily and firmly fixed relative to the second housing 33*b* in the axial direction and in the direction perpendicular or substantially perpendicular to the axis J1.

Erroneous coupling of the first and second housings 23*b* and 33*b* is prevented by the difference in shape between the third locking portion 2381 and the fourth locking portion 2382 and the difference in shape between the fifth locking portion 3381 and the sixth locking portion 3382.

When separating the first housing 23*b* and the second housing 33*b* from each other, the fixing members 4 are first removed as in the preceding preferred embodiments. Then the first housing 23*b* is moved relative to the second housing 33*b* in the direction opposite to the direction indicated by the arrow 92. Consequently, the respective locking portions are disengaged so that the first and second housings 23*b* and 33*b* can be separated from each other.

Fourth Preferred Embodiment

Figure 20:
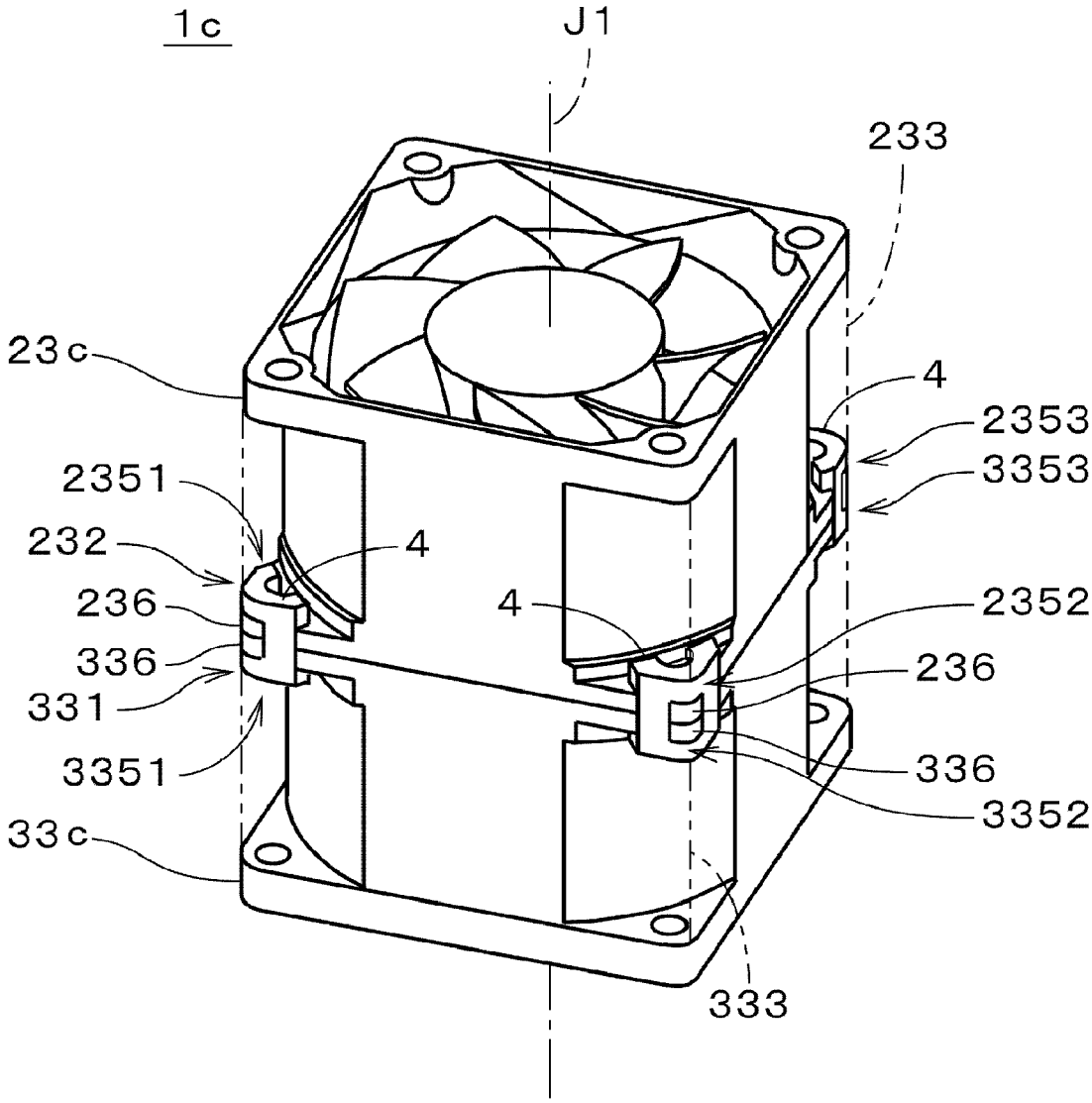
FIG. 20 is a perspective view showing a serially connected axial flow fan unit in accordance with a fourth preferred embodiment of the present invention.

FIG. 20 is a perspective view showing a serially connected axial flow fan unit 1*c* in accordance with a fourth preferred embodiment of the present invention. First and second protrusions 236 and 336 are located in the respective corner portions 2351 to 2354 and 3351 to 3354 of the first and second housings 23*c* and 33*c*. Fixing members 4 are attached to the first and second protrusions 236 and 336 of the respective corner portions 2351 to 2354 and 3351 to 3354.

Since the fixing members 4 are arranged in the respective corner portions mutually opposed with respect to the axis J1, it is possible, as in the preceding preferred embodiments, to prevent the first housing 23*c* from moving relative to the second housing 33*c* in the axial direction and in the direction perpendicular or substantially perpendicular to the axis J1.

When coupling the first and second housings 23*c* and 33*c* together, the lower end portion 232 and the upper end portion 331 are brought into contact with each other in a state that the contour 233 and the contour 333 are aligned in the axial direction as in the preceding preferred embodiments. Then the fixing members 4 are attached to the respective corner portions, thereby coupling the first and second housings 23*c* and 33*c* together.

The first and second housings 23*c* and 33*c* can be separated from each other by removing the fixing members 4 and moving the first housing 23*c* relative to the second housing 33*c* as in the preceding preferred embodiments.

Fifth Preferred Embodiment

Figure 21:
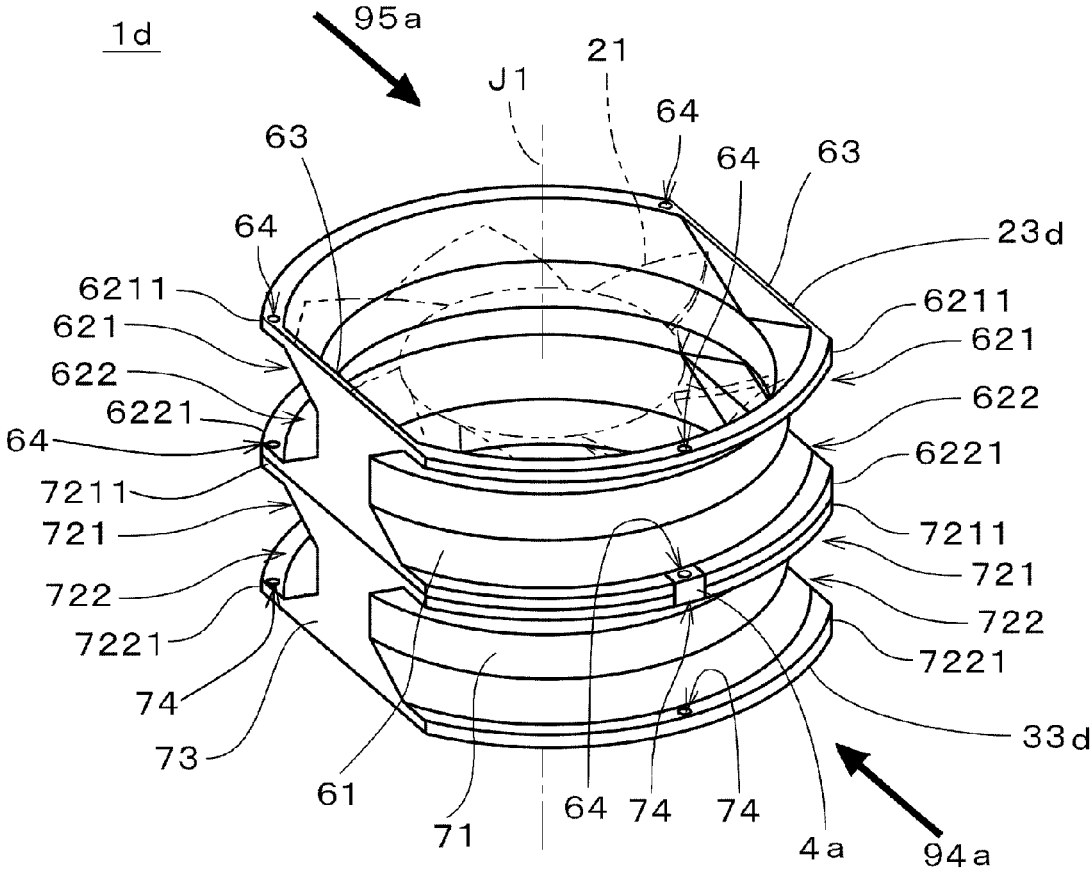
FIG. 21 is a perspective view showing a serially connected axial flow fan unit in accordance with a fifth preferred embodiment of the present invention.
Figure 22:
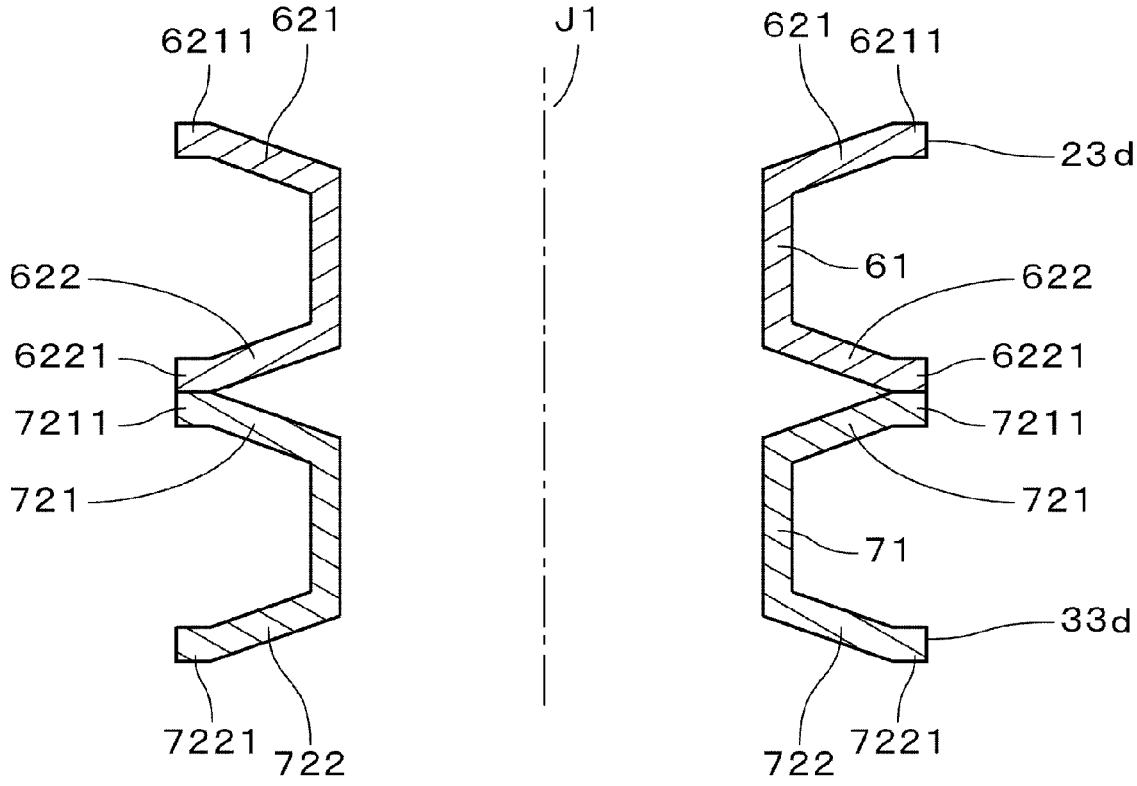
FIG. 22 is a section view showing a first housing and a second housing employed in the axial flow fan unit of the fifth preferred embodiment of the present invention.

FIG. 21 is a perspective view showing the first and second housings 23*d* and 33*d* of a serially connected axial flow fan unit 1*d* in accordance with a fifth preferred embodiment of the present invention. In FIG. 21, the impeller 21 is depicted by double-dotted chain lines. FIG. 22 is a section view of the first and second housings 23*d* and 33*d* taken along a plane containing the axis J1 and extending from the front side to the rear side in FIG. 21.

The lower end portion of the first housing 23*d* makes contact with the upper end portion of the second housing 33*d*. A plurality of (e.g., two) fixing members 4 is attached to the first and second housings 23*d* and 33*d* in an opposing relationship with respect to the axis J1.

Preferably, the first and second housings 23*d* and 33*d* include cylinder portions 61 and 71, upper increased diameter portions 621 and 721, lower increased diameter portions 622 and 722, and thin wall portions 63 and 73.

The upper increased diameter portions 621 and 721 extend upwards from the upper ends of the cylinder portions 61 and 71 in an inclined relationship with the axis J1. Similarly, the lower increased diameter portions 622 and 722 extend downwards from the lower ends of the cylinder portions 61 and 71 in an inclined relationship with the axis J1.

The thin wall portions 63 have a generally rectilinear shape when seen in a plan view and interconnect the upper increased diameter portions 621 and 621 while interconnecting the lower increased diameter portions 622 and 622. This holds true in case of the thin wall portions 73. The thin wall portions 73 interconnect the upper increased diameter portions 721 and 721 while interconnecting the lower increased diameter portions 722 and 722.

As shown in FIGS. 21 and 22, end portions 6211, 6221, 7211 and 7221 extending in the direction generally perpendicular to the axis J1 are provided in the upper increased diameter portions 621 and 721 and the lower increased diameter portions 622 and 722. The end portions 6211, 6221, 7211 and 7221 include a generally arc-like region and a generally rectilinear region when seen in a plan view and have a plurality of through-holes 64 and 74. The through-holes 64 are aligned in position with the through-holes 74 when seen in a plan view. Screws or other fastening elements may be inserted through the through-holes 64 and 74 when fixing the axial flow fan unit 1*d* to a specified device.

Figure 23:
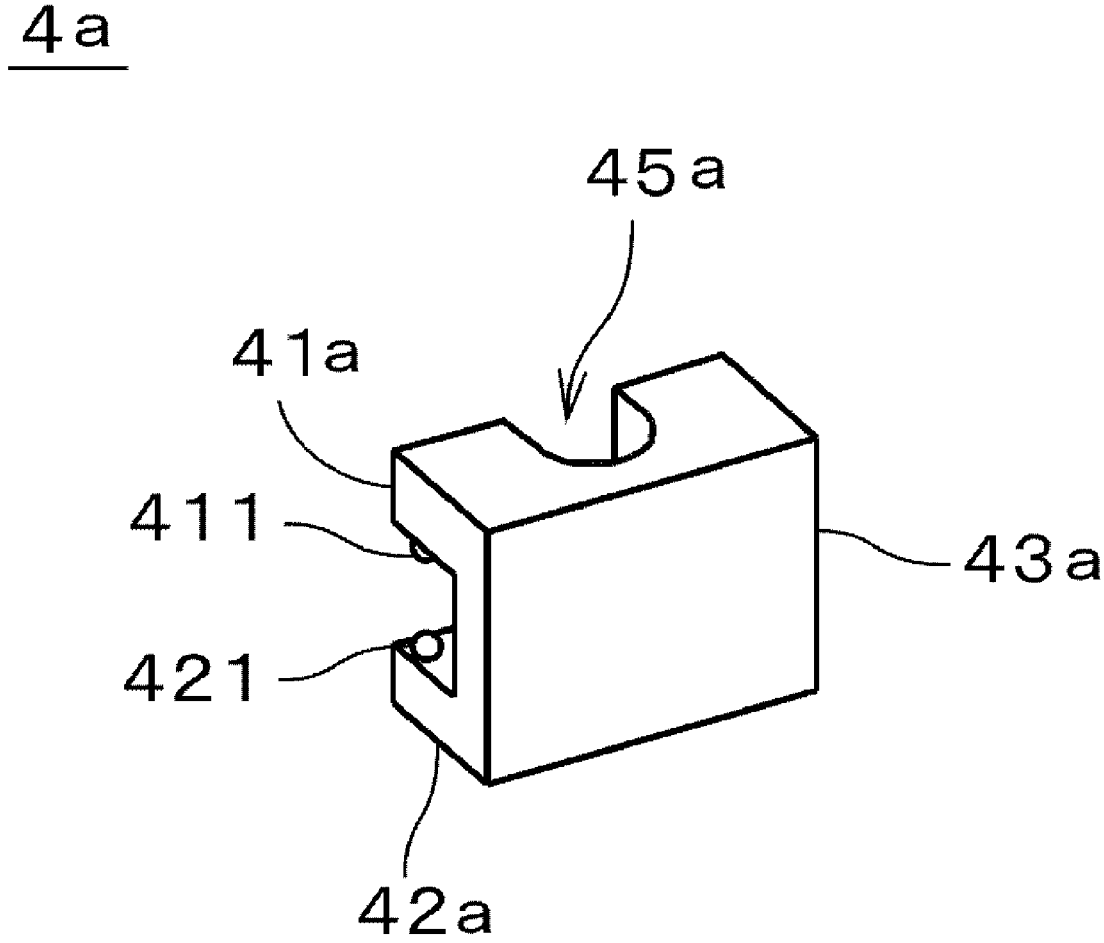
FIG. 23 is a perspective view showing a fixing member employed in the axial flow fan unit of the fifth preferred embodiment of the present invention.

FIG. 23 is a perspective view showing a fixing member 4*a*. Preferably, the fixing member 4*a* includes side portions 43*a*, an upper portion 41*a*, a lower portion 42*a*, a groove portion 45*a* and raised portions 411 and 421. The upper portion 41*a* is joined to the lower portion 42*a* by way of the side portions 43*a*. The groove portion 45*a* preferably has a semi-cylindrical shape that is preferably formed by axially cutting out the upper portion 41*a* and the lower portion 42*a*. The raised portions 411 and 421 are respectively located at the circumferential opposite sides of tip ends of the upper portion 41*a* and the lower portion 42*a*.

Figure 24:
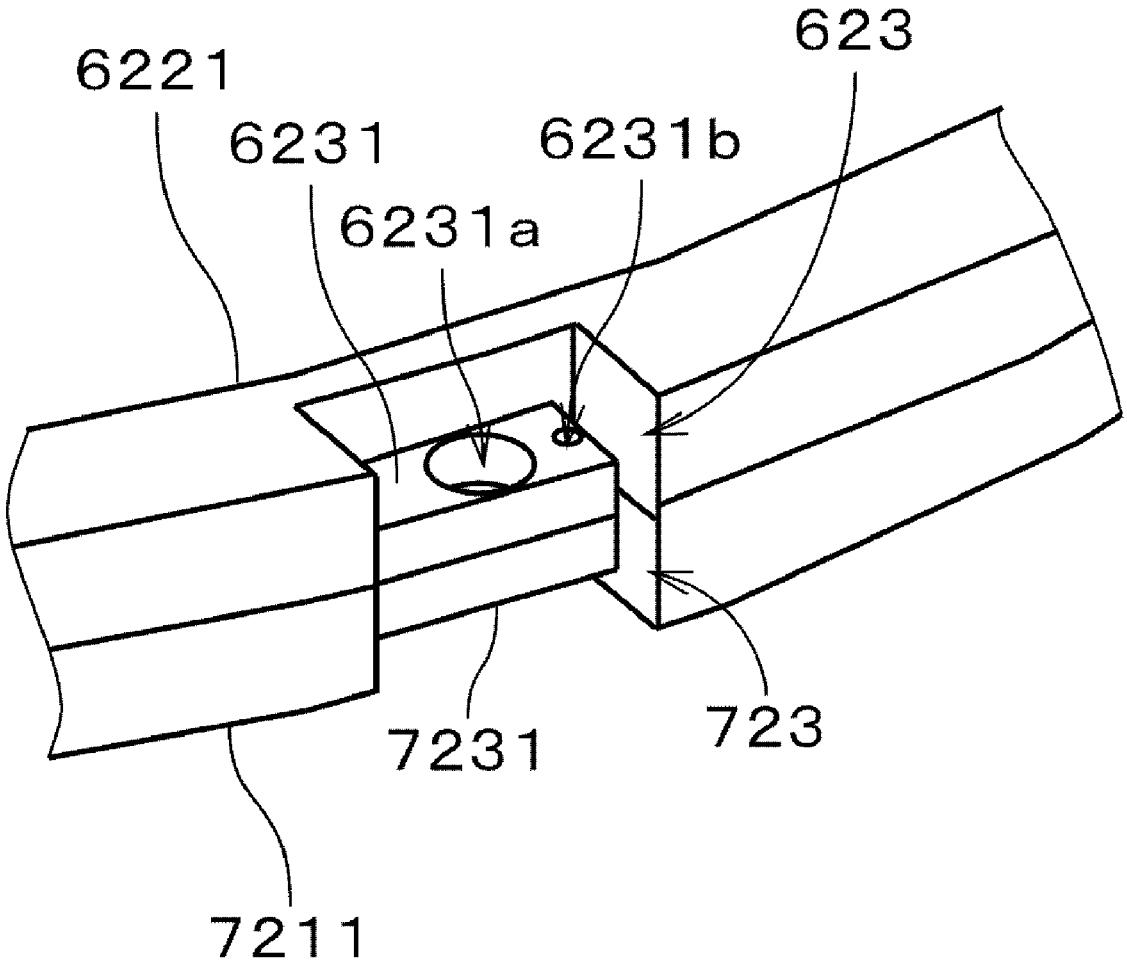
FIG. 24 is a perspective view showing an end portion of the first housing and an end portion of the second housing employed in the axial flow fan unit of the fifth preferred embodiment of the present invention.

FIG. 24 is an enlarged view showing the end portions 6221 and 7211.

An axially extending cutout 623 is formed in each of the end portions 6221 mutually opposing with respect to the axis J1. In the lower region of the cutout 623, there is formed a protrusion 6231 that protrudes radially outwards. The protrusion 6231 has an axially extending through-hole 6231*a* and a recessed portion 6231*b* formed on the upper surface thereof.

As shown in FIG. 24, a cutout 723 overlapping with the cutout 623 is formed in each of the end portions 7211 mutually opposing with respect to the axis J1. In the upper region of the cutout 723, there is formed a protrusion 7231 that protrudes radially outwards. At the center of the protrusion 7231, there is formed a through-hole overlapping with the through-hole 6231*a*. Recessed portions are provided at the circumferential opposite sides of the lower surface of the protrusion 7231.

Figure 25:
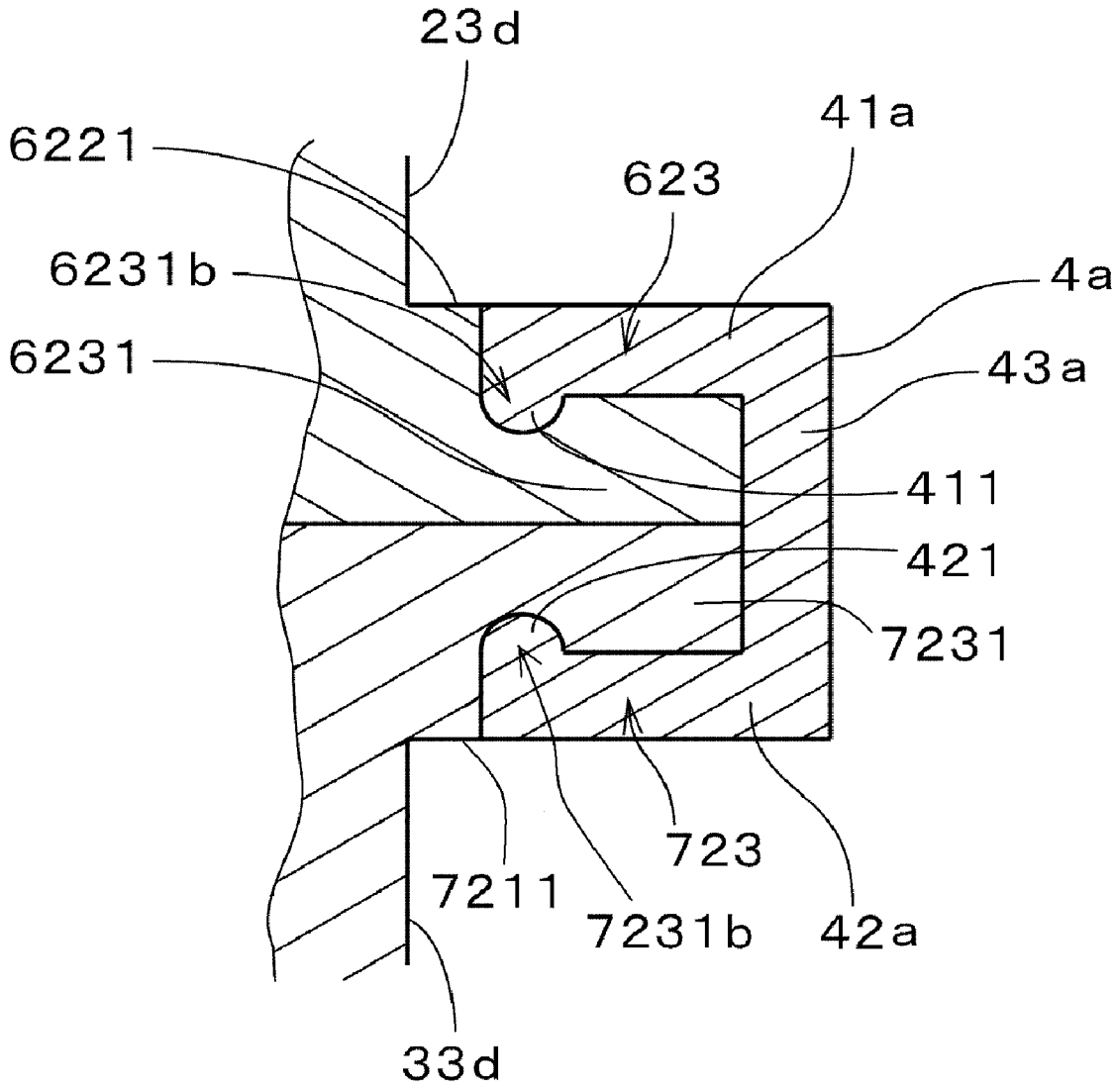
FIG. 25 is a section view showing the first housing, the second housing and the fixing member employed in the axial flow fan unit of the fifth preferred embodiment of the present invention.

FIG. 25 is a section view of the axial flow fan unit 1*d* taken along a plane containing the axis J1. The positions of the raised portions 411 and 421 of the fixing member 4*a* shown in FIG. 21 are clearly illustrated in FIG. 25.

The fixing members 4*a* are slid as indicated by arrows 94*a* and 95*a* in FIG. 21 and then attached to the protrusion 6231 and 7231, at which time the raised portions 411 and 421 are fitted to the recessed portions 6231*b* and 7231*b*, respectively.

Thus, the first and second housings 23*d* and 33*d* are coupled together with ease. This prevents the first housing 23*d* from making movement relative to the second housing 33*d* in the axial direction and in the direction perpendicular or substantially perpendicular to the axis J1. At the same time, the downwardly extending through-holes 64 and 74 are defined by the groove portion 45*a*, the through-hole 6231*a* and the through-hole of the cutout 723.

The axial height of the side portions 43*a* is equal to the sum total of the height of the end portion 6221 and the height of the end portion 7211. The radial width of the upper portion 41*a* and the lower portion 42*a* is equal to the radial width of the cutouts 623 and 723.

This prevents the fixing member 4 from protruding beyond the end portions 6221 and 7211.

Sixth Preferred Embodiment

Figure 26:
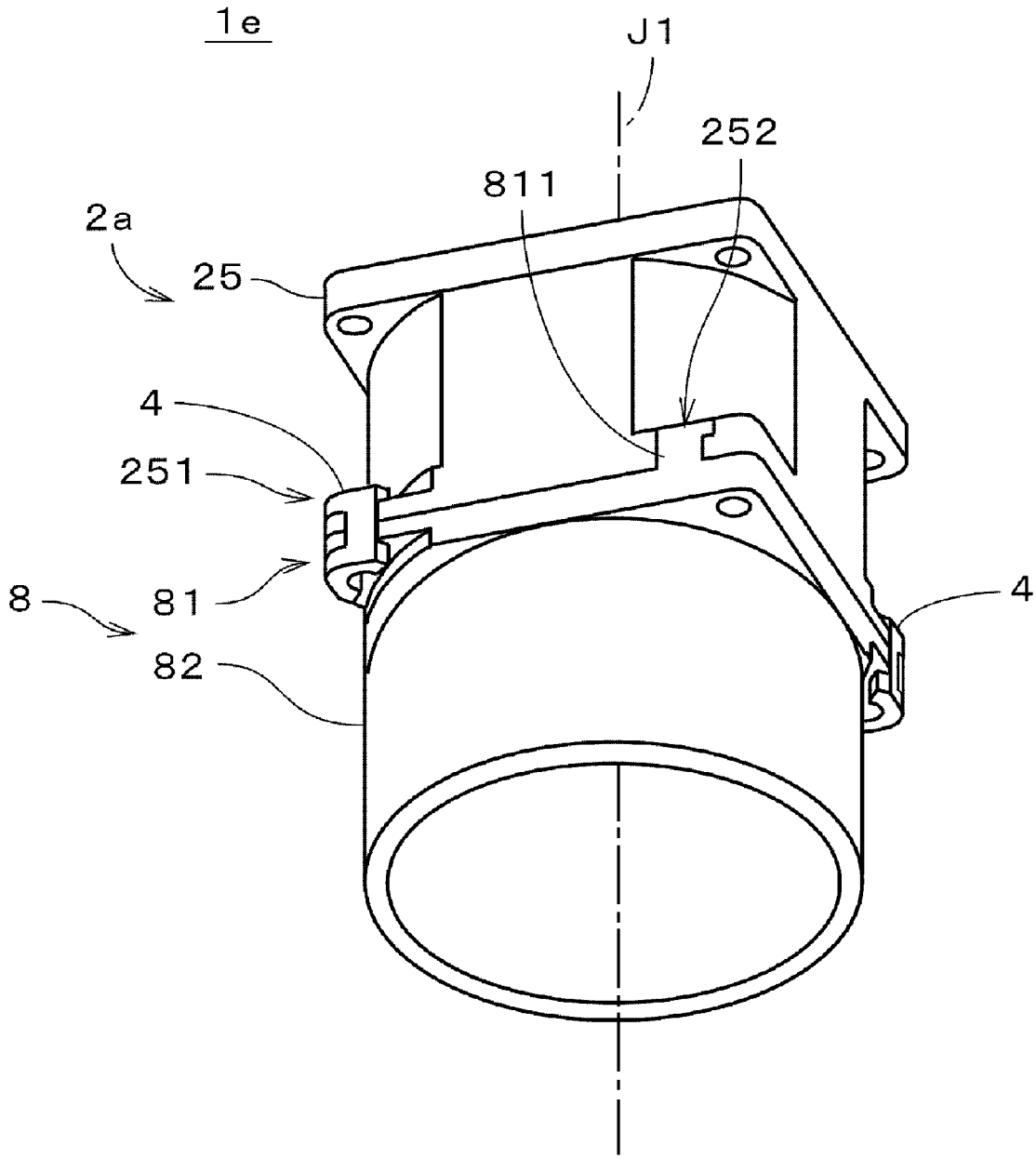
FIG. 26 is a perspective view showing a serially connected axial flow fan unit in accordance with a sixth preferred embodiment of the present invention.

FIG. 26 is a perspective view showing the frame of an axial flow fan unit 1*e* in accordance with a sixth preferred embodiment of the present invention. Preferably, the axial flow fan unit 1*e* includes an axial flow fan 2*a* with a third housing 25, a fourth housing 8 and a plurality of (e.g., two) fixing members 4.

The fourth housing 8 has a wind tunnel portion through which the air sent from the axial flow fan 2*a* flows and makes contact with the lower end portion 251 of the third housing 25 in the axial direction. The fixing members 4 are preferably made of resin and are capable of fixing the third housing 25 and the fourth housing 8 together.

The axial flow fan 2*a* preferably has substantially the same structure as that of the first axial flow fan 2 described above. A seventh locking portion 252 is formed in each of the corner portions of the lower end portion 251 mutually opposing with respect to the axis J1.

The fourth housing 8 is preferably provided with an upper end portion 81 and a cylinder portion 82. The upper end portion 81 has a generally square flange-like shape when seen in a plan view and is joined to the cylinder portion 82. An eighth locking portion 811 having the same shape as the second locking portion 337 described above is formed in each of the corner portions of the upper end portion 81 mutually opposing with respect to the axis J1.

Referring again to FIG. 26, protrusions having the same shape as the first and second protrusions 236 and 336 described above are formed in the left and right corner portions of the lower end portion 251 and the upper end portion 81. The fixing members 4 are attached to these protrusions.

The inner surface of the cylinder portion 82 has a shape obtainable by extending the inner surface of the lower end portion 251 parallel or substantially parallel to the axis J1.

As in the preceding preferred embodiments, the axial flow fan unit 1*e* is assembled by moving the third housing 25 and the fourth housing 8 toward each other and causing the seventh locking portion 252 and the eighth locking portion 811 to engage with each other. Then the fixing members 4 are attached to the lower end portion 251 and the upper end portion 81.

This makes it possible to easily and firmly fix the fourth housing 8 to the third housing 25, which prevents the lower end portion 251 from making movement relative to the upper end portion 81 in the axial direction and in the direction perpendicular or substantially perpendicular to the axis J1.

The method of fixing the third housing 25 and the fourth housing 8 together is not limited to the one shown in FIG. 26. As an alternative example, it may be possible to use the fixing members 4*a* shown in FIG. 21 or to use the different kinds of fixing methods set forth earlier with respect to the preceding preferred embodiments.

Seventh Preferred Embodiment

Figure 27:
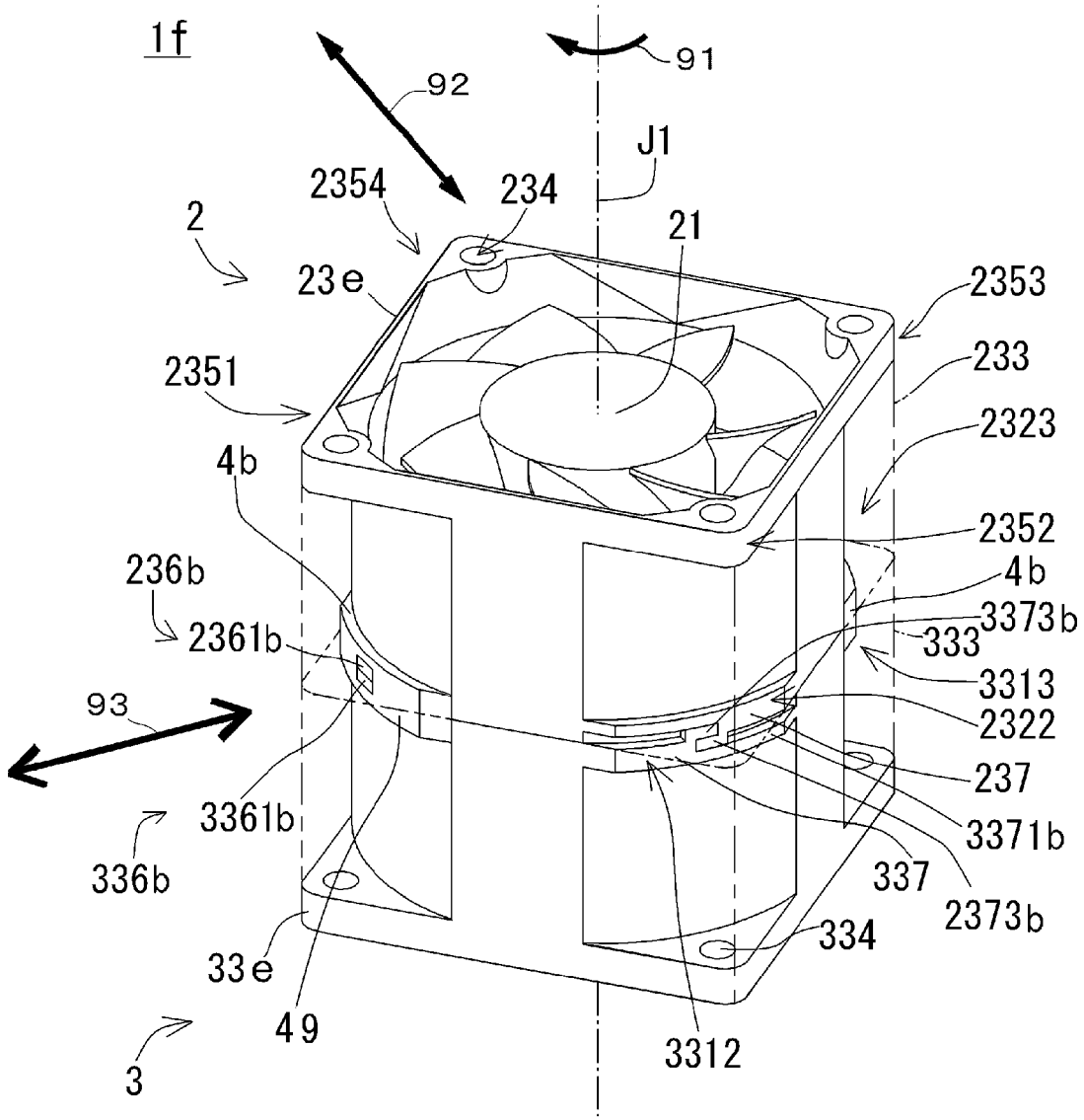
FIG. 27 is a perspective view showing a serially connected axial flow fan unit in accordance with a seventh preferred embodiment of the present invention.

FIG. 27 is a perspective view showing a serially connected axial flow fan unit 1*f* in accordance with a seventh preferred embodiment of the present invention. A first housing 23*e* and a second housing 33*e* are kept in contact with each other and are fixed together by fixing members 4*b*.

Figure 28:
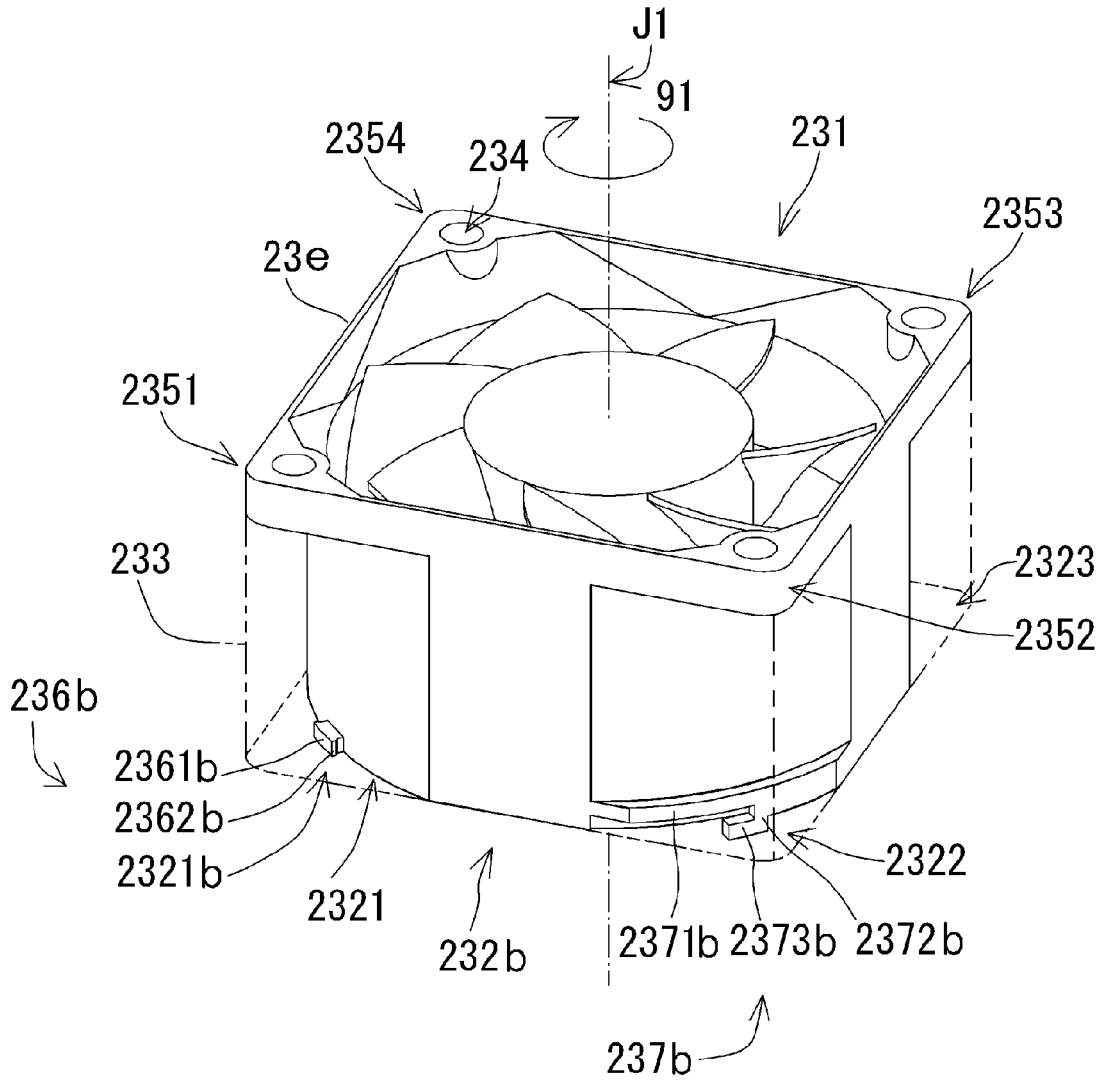
FIG. 28 is a perspective view showing a first housing employed in the axial flow fan unit of the seventh preferred embodiment of the present invention.

FIG. 28 is a perspective view showing the first housing 23*e*. As depicted in FIGS. 27 and 28, arc portions 2321 to 2324 are located in the lower end portion 232*b* of the first housing 23*e*. The contour of the lower end portion 232*b* preferably has a generally octagonal shape when seen in a plan view and lies inside the contour 233 of the first housing 23*e*.

Figure 29:
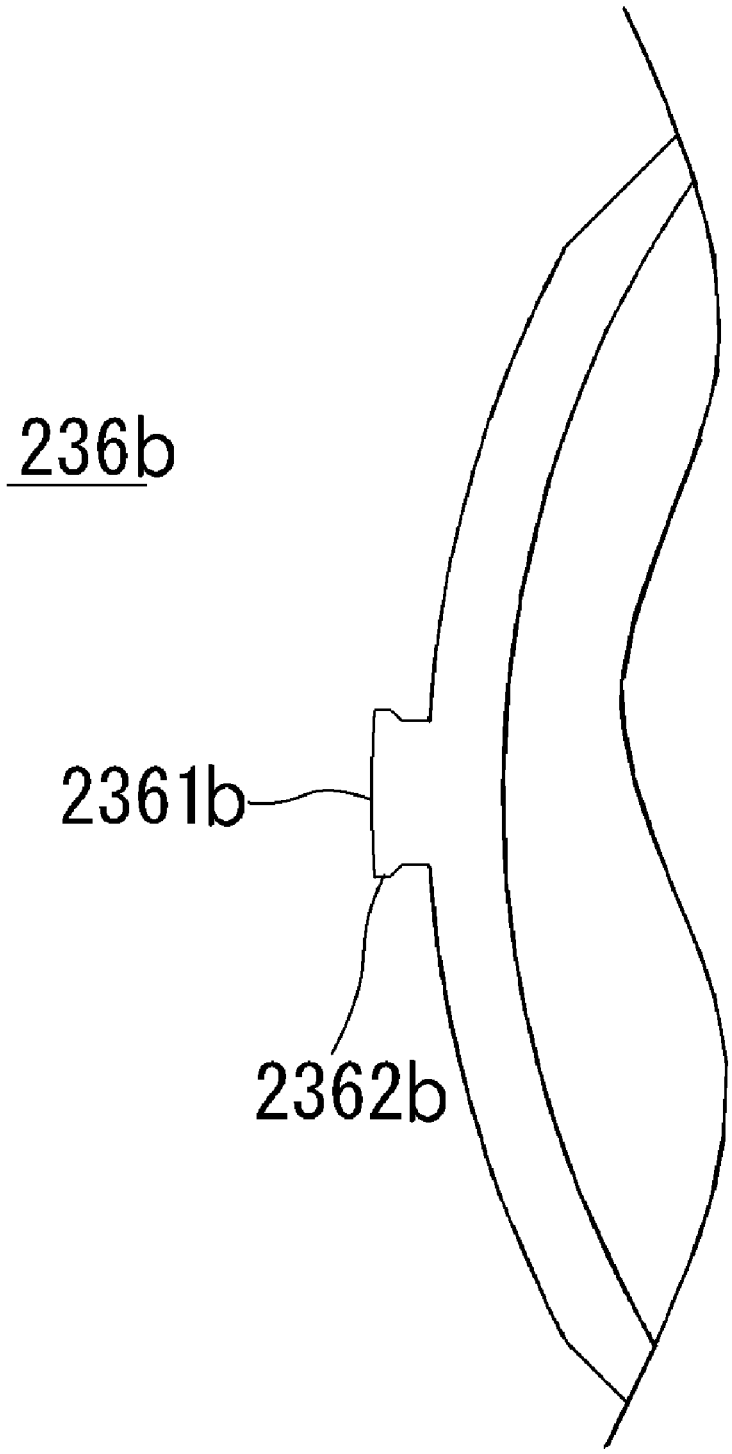
FIG. 29 is a plan view showing a third protrusion employed in the axial flow fan unit of the seventh preferred embodiment of the present invention.

FIG. 29 is a plan view showing a third protrusion 236*b* formed in the arc portion 2321. As shown in FIGS. 28 and 29, the arc portions 2321 and 2323 are diametrically opposed to each other with respect to the axis J1, each of which has a third protrusion 236*b* protruding radially outwards. The third protrusion 236*b* is provided with a radially outwardly extending tip end 2361*b* that has an increased width portion 2362*b* whose width increases in the circumferential direction.

As shown in FIG. 28, the arc portions 2322 and 2324 are diametrically opposed to each other with respect to the axis J1, each of which has a ninth axially extending locking portion 237*b*.

The ninth locking portion 237*b* is preferably provided with a flange portion 2371*b*, a raised portion 2372*b* and a first pressing portion 2373*b*.

The flange portion 2371*b* protrudes radially outwards and is positioned axially above the lower end surface of the arc portion 2322 by a distance corresponding to the axial height of the first pressing portion 2373*b*. The radially outer surface of the flange portion 2371*b* has a substantially cylindrical shape. The raised portion 2372*b* protrudes axially downwards from the flange portion 2371*b*. The first pressing portion 2373*b* is arranged at the lower end of the raised portion 2372*b* to extend in the circumferential direction.

At the trailing side of the arc portion 2322 from the raised portion 2372*b* along the direction indicated by an arrow 91 in FIG. 28, the flange portion 2371*b* protrudes axially downwards. The outer surface of the flange portion 2371*b* is positioned radially outwards of the corresponding through-hole 234. The through-hole 234 and the flange portion 2371*b* do not overlap with each other when seen in the axial direction.

As shown in FIG. 28, the radially outer surfaces of the raised portions 2372*b* and the first pressing portion 2373*b* are configured to define a portion of the cylindrical outer surface of the flange portion 2371*b*. In the arc portion 2322, the lower end surface of the flange portion 2371*b* positioned at the right side of the raised portion 2372*b* is substantially flush with the lower end surface of the arc portion 2322.

Figure 30:
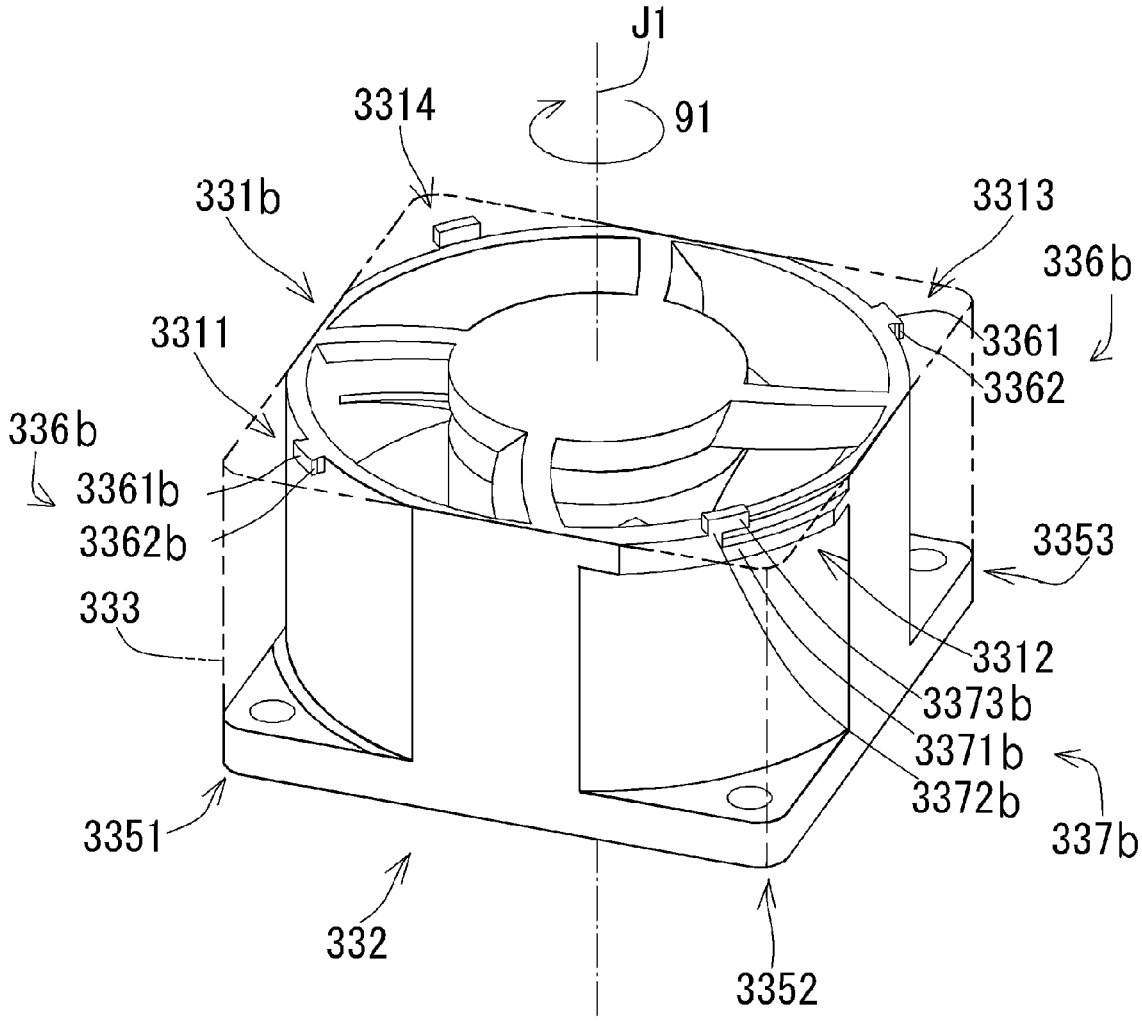
FIG. 30 is a perspective view showing a second housing employed in the axial flow fan unit of the seventh preferred embodiment of the present invention.

FIG. 30 is a perspective view showing the second housing 33*e*. The second housing 33*e* includes an upper end portion 331*b* whose plan-view contour has a generally octagonal shape and lies inside the contour 333 of the second housing 33*e*.

A fourth protrusion 336*b* that makes contact with the third protrusion 236*b* is preferably provided in each of the arc portions 3311 and 3313. A tenth locking portion 337*b* that engages with the ninth locking portion 237*b* is preferably provided in each of the arc portions 3312 and 3314.

The fourth protrusion 336*b* is generally identical in shape with the third protrusion 236*b*. The fourth protrusion 336*b* is provided with a radially outwardly protruding tip end 3361*b* having an increased width portion 3362*b* whose width increases in the circumferential direction.

As shown in FIG. 30, the tenth locking portion 337*b* preferably includes a flange portion 3371*b*, a raised portion 3372*b* and a second pressing portion 3373*b*.

The flange portion 3371*b* is positioned axially below the upper end surface of the arc portion 3312 by a distance corresponding to the axial height of the second pressing portion 3373*b*. The radially outer surface of the flange portion 3371*b* forms a portion of the cylindrical surface of the arc portion 3312 extending about the axis J1.

The raised portion 3372*b* protrudes axially upwards from the flange portion 3371*b*. The second pressing portion 3373*b* is arranged at the upper end of the raised portion 3372*b* to extend in the circumferential direction.

As shown in FIG. 30, the flange portion 3371*b* protrudes axially upwards at the leading side of the arc portion 3312 from the raised portion 3372*b* along the direction indicated by the arrow 91. The outer surface of the flange portion 3371 is positioned radially outwards of the corresponding through-hole 334 so as not to overlap with the through-hole 334 when seen in the axial direction.

The radially outer surfaces of the raised portion 3372*b* and the second pressing portion 3373*b* are configured to form a portion of the cylindrical outer surface of the flange portion 3371*b*. At the leading side of the flange portion 3371*b* from the raised portion 3372*b* along the direction indicated by the arrow 91, the upper end surface of the flange portion 3371*b* is flush with the upper end surface of the arc portion 3312.

Referring to FIG. 27, the first pressing portion 2373*b* is fitted to the gap between the second pressing portion 3373*b* and the flange portion 3371*b* in the arc portions 2322, 2324, 3312 and 3314. The surface of the first pressing portion 2373*b* facing toward the first housing 23*e* and the surface of the second pressing portion 3373*b* facing toward the second housing 33*e* are pressed against each other, thereby preventing the first housing 23*e* from moving relative to the second housing 33*e* in the axial direction.

Figure 31:
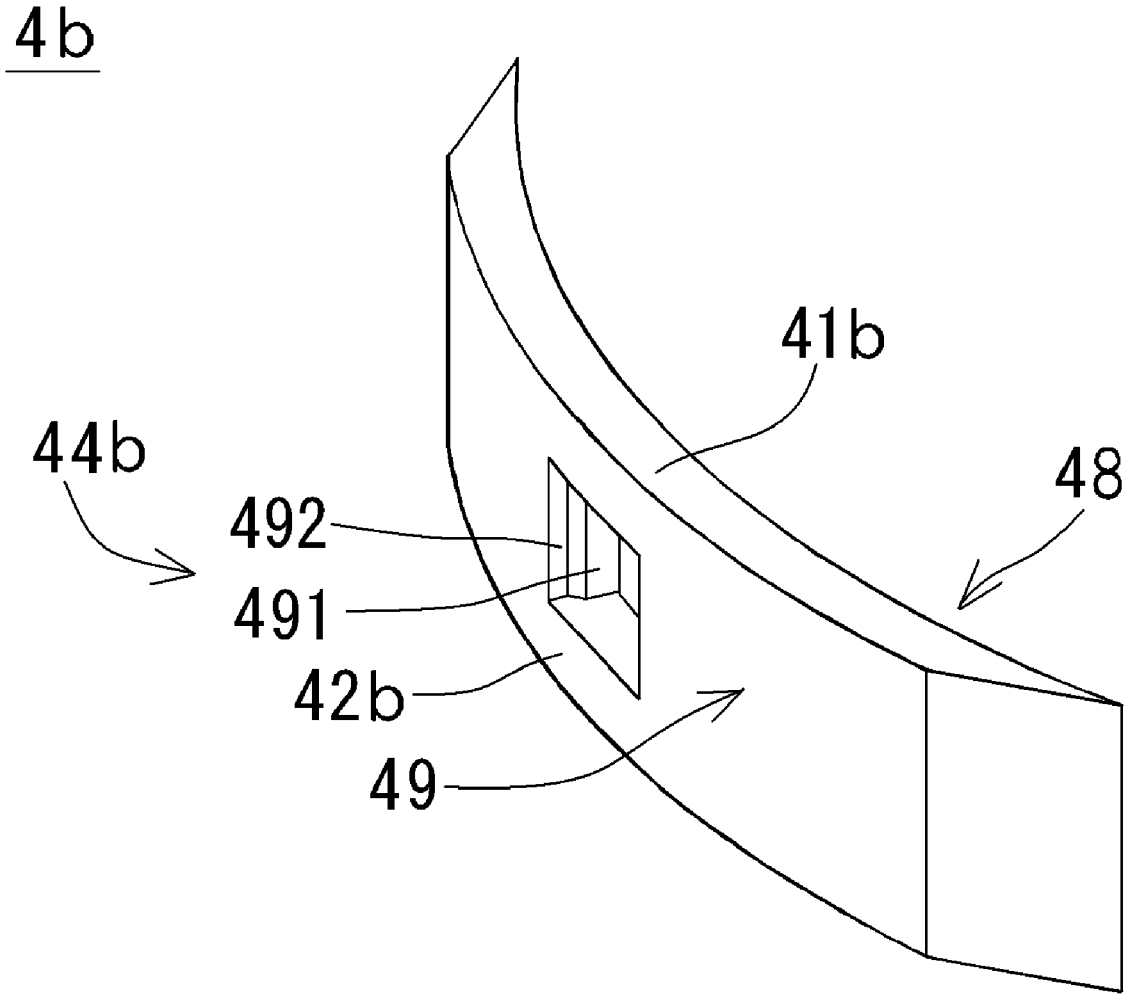
FIG. 31 is a perspective view showing a fixing member employed in the axial flow fan unit of the seventh preferred embodiment of the present invention.
Figure 32:
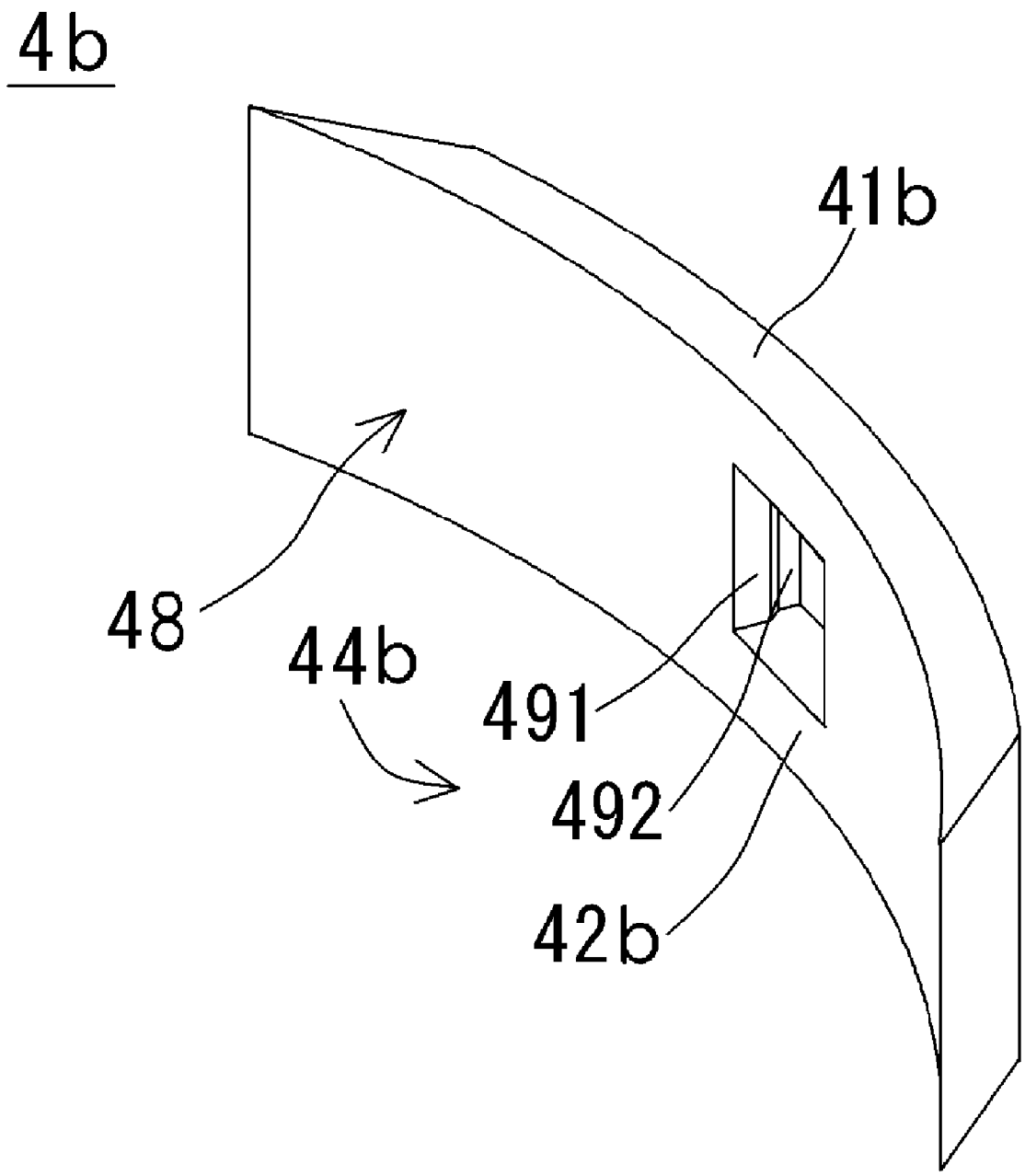
FIG. 32 is another perspective view showing the fixing member employed in the axial flow fan unit of the seventh preferred embodiment of the present invention.

FIG. 31 is a perspective view depicting the fixing member 4*b* shown in FIG. 27. FIG. 32 is another perspective view of the fixing member 4*b*, in which view the fixing member 4*b* is horizontally inverted from the state depicted in FIG. 31.

The fixing member 4*b* is preferably made of resin and has a generally arc-like shape when seen in a plan view. The fixing member 4*b* has a contact surface 48 that makes contact with the outer surfaces the arc portions 2321 and 3311 in the radial direction when assembling the axial flow fan unit 1*f*.

As shown in FIGS. 27 and 31, the radius of curvature of the contact surface 48 is substantially the same as that of the outer surfaces of the flange portions 2371*b* and 3371*b*. It can be seen in FIG. 27 that the fixing member 4*b* is positioned radially inwards of the corresponding through-hole 234 so as not to overlap with the through-hole 234 when seen in the axial direction.

Referring to FIGS. 31 and 32, a hole portion 44*b* extending through the convex surface 49 and the contact surface 48 is formed in the central region of the fixing member 4*b*. The hole portion 44*b* has an increased width portion 492 formed at the side of the convex surface 49 and a reduced width portion 491 formed at the side of the contact surface 48, the reduced width portion 491 having a circumferential width smaller than that of the increased width portion 492. The circumferential width of the reduced width portion 491 is preferably smaller than the maximum width of the increased width portions 2362*b* and 3362*b* mentioned earlier.

Therefore, when attached to the first and second housings 23*e* and 33*e*, the fixing member 4*b* is capable of restraining the first housing 23*e* from making movement relative to the second housing 33*e* in the directions indicated by the arrows 91 and 93.

The radius of curvature of the contact surface 48 is preferably smaller than that of the outer surfaces of the arc portions 2321 and 3311. During the course of attaching the fixing member 4*b* to the first and second housings 23*e* and 33*e*, the fixing member 4*b* is deformed is such a direction that the radius of curvature of the contact surface 48 becomes greater. This creates internal stresses in the fixing member 4*b*. In other words, when attaching the fixing member 4*b*, an elastic force acting radially outwards relative to the third and fourth protrusions 236*b* and 336*b* is generated in the fixing member 4*b*. At this time, the longitudinal opposite end portions of the fixing member 4*b* serves as fulcrums. Under the action of this elastic force, the fixing member 4*b* is attached to the third and fourth protrusions 236*b* and 336*b*.

This makes it possible for the inner circumferential surface of the hole portion 44*b* of the fixing member 4*b* to fix the third and fourth protrusions 236*b* and 336*b* in the radial direction as well as in the axial and circumferential directions.

This also prevents the first and second housings 23*e* and 33*e* from making relative movement in the axial direction and in the direction perpendicular to the axis J1.

As shown in FIGS. 31 and 32, the fixing member 4*b* has a symmetrical shape in both the longitudinal direction and the vertical direction. This means that either the upper portion 41*b* or the lower portion 42*b* may be positioned at the side of the first housing 233 when attaching the fixing member 4*b* to the third and fourth protrusions 236*b* and 336*b*. Furthermore, it does not matter which one of the longitudinal end portions of the fixing member 4*b* is positioned at the left side or the right side in FIG. 27. In other words, no particular restriction is imposed on the direction in which the fixing member 4*b* is attached to the first and second housings 23*e* and 33*e*. This makes it possible to reduce the number of steps and the time required in attaching the fixing member 4*b* to the first and second housings 23*e* and 33*e*.

The third protrusion 236*b* and the ninth locking portion 237*b* are preferably defined by a single unitary member including the first housing 23*e*, which is preferably formed, e.g., by resin injection molding. The third protrusion 236*b* and the ninth locking portion 237*b* preferably are located substantially in the same radial position from the axis J1. This reduces warpage of the first housing 23*e* which may be generated in the axial upward or downward direction when the first housing 23*e* is molded with resin. This holds true in case of the second housing 33*e*.

With the seventh preferred embodiment, it is possible to mount the axial flow fan unit 1*f* to a specified device, e.g., by penetrating a single screw through the through-holes 234 and 334. No portion present between the through-holes 234 and 334 impedes penetration of the screw. This makes it easy to penetrate a screw or other fastening element through the through-holes 234 and 334.

Since the through-holes 234 and 334 are not used in coupling the first and second housings 23*e* and 33*e* together, there is no need to exactly align the positions of the through-holes 234 and 334. This eliminates the need to design the molds for resin injection molding with high dimensional accuracy, which leads to reduction in the manufacturing cost and the number of fabrication steps of the axial flow fan unit 1*f*.

Figure 33A:
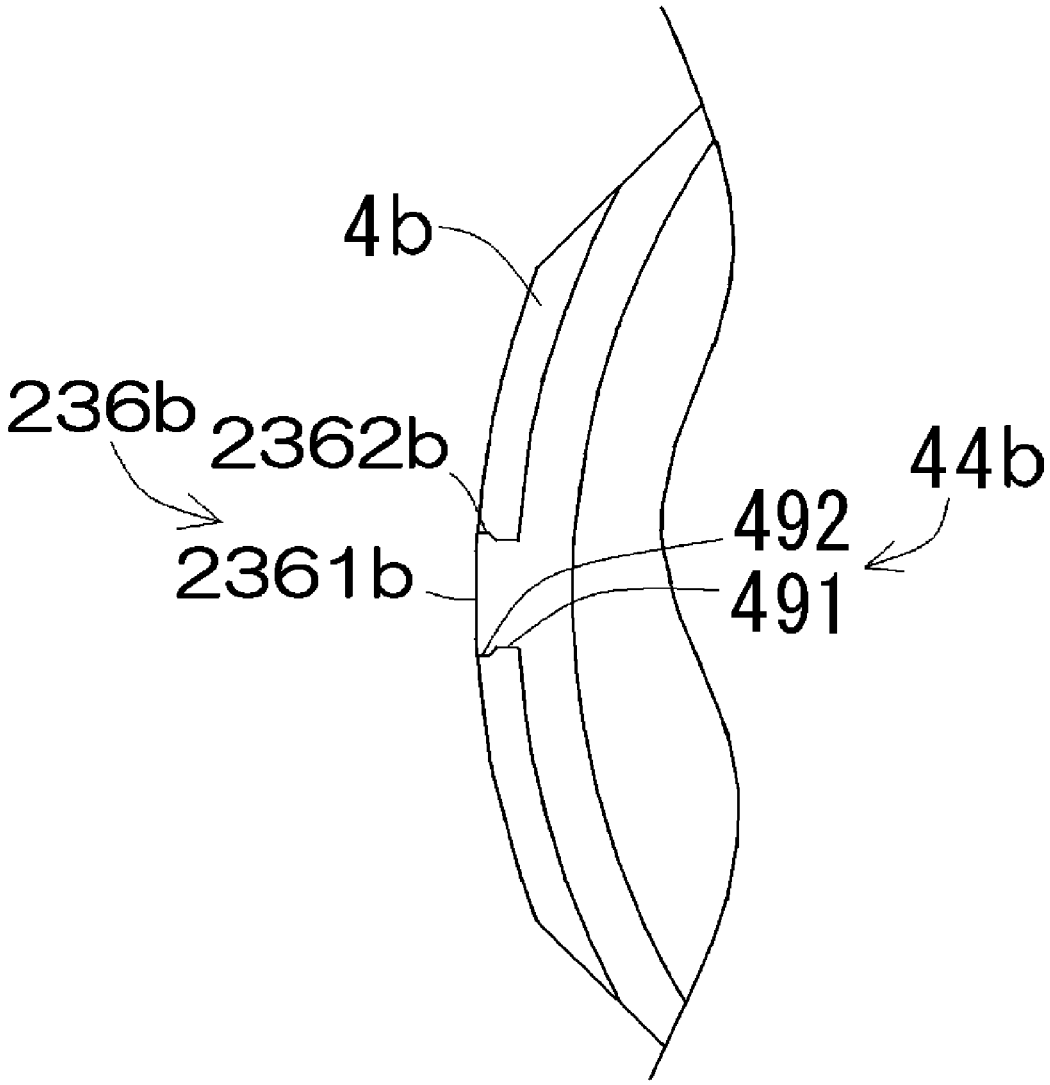
FIG. 33A is a plan view showing an arc portion to which the fixing member is attached.
Figure 33B:
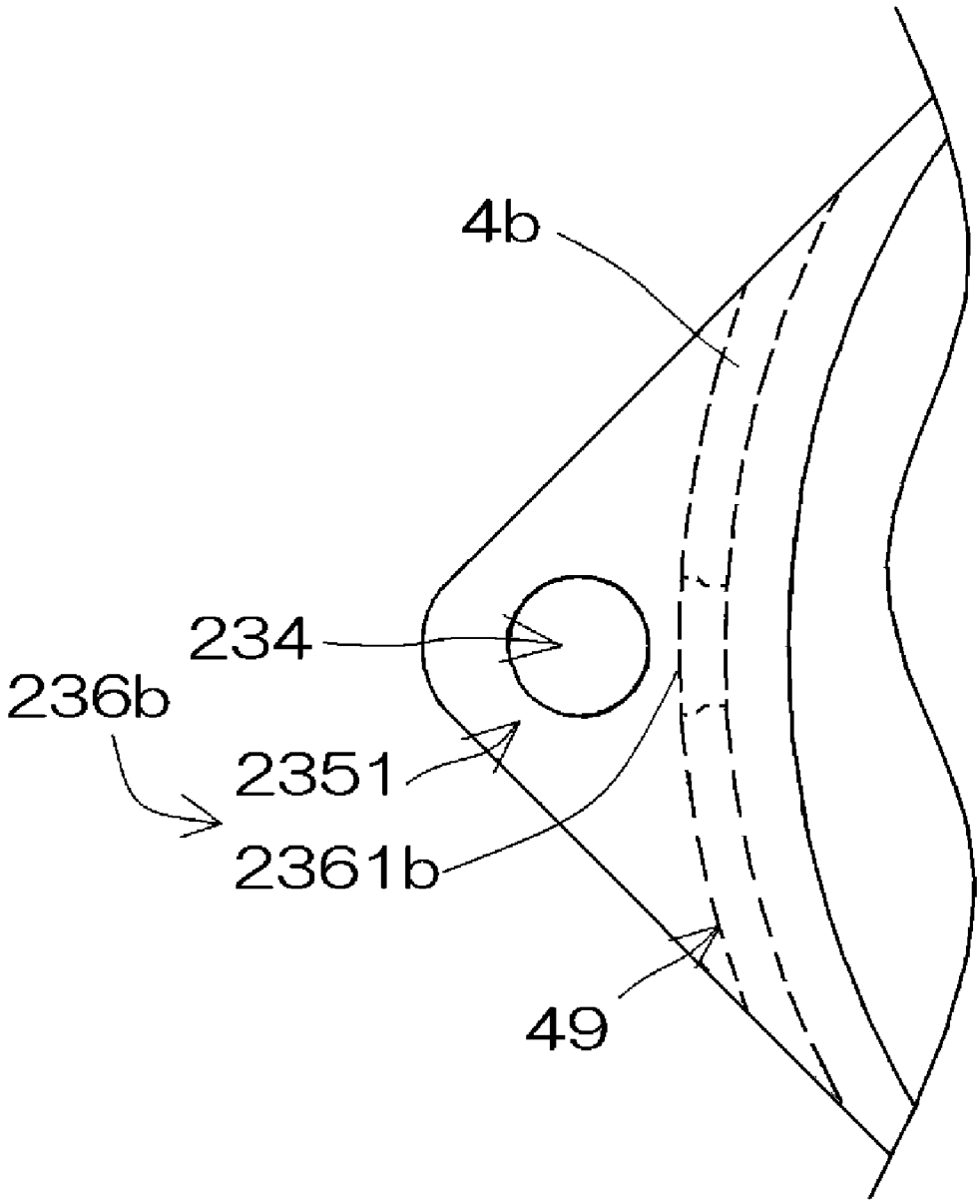
FIG. 33B is another plan view showing the arc portion to which the fixing member is attached.

FIGS. 33A and 33B are plan views showing the arc portions 2321 and 3311 to which the fixing member 4*b* is attached. As shown in FIG. 33A, the increased width portion 2362*b* is locked against the step difference between the increased width portion 492 and the reduced width portion 491. As shown in FIG. 33B, the tip end 2361*b* and the convex surface 49 do not overlap with the through-hole 234 in the axial direction.

This eliminates the possibility that the fixing member 4*b* and the third protrusion 236*b* may impede penetration of a screw, e.g., when the screw is penetrated through the through-hole 234. Therefore, it becomes easy to attach the axial flow fan unit 1*f* to an electronic device or the like.

Next, description will be provided of an example of the process flow for fabrication of the axial flow fan unit 1*f*. First, the first housing 23*e* is brought into an axially opposing relationship with the second housing 33*e*. At this time, the arc portions 2321 to 2324 are arranged out of alignment with the corresponding arc portions 3311 to 3314 in the circumferential direction.

Figure 34:
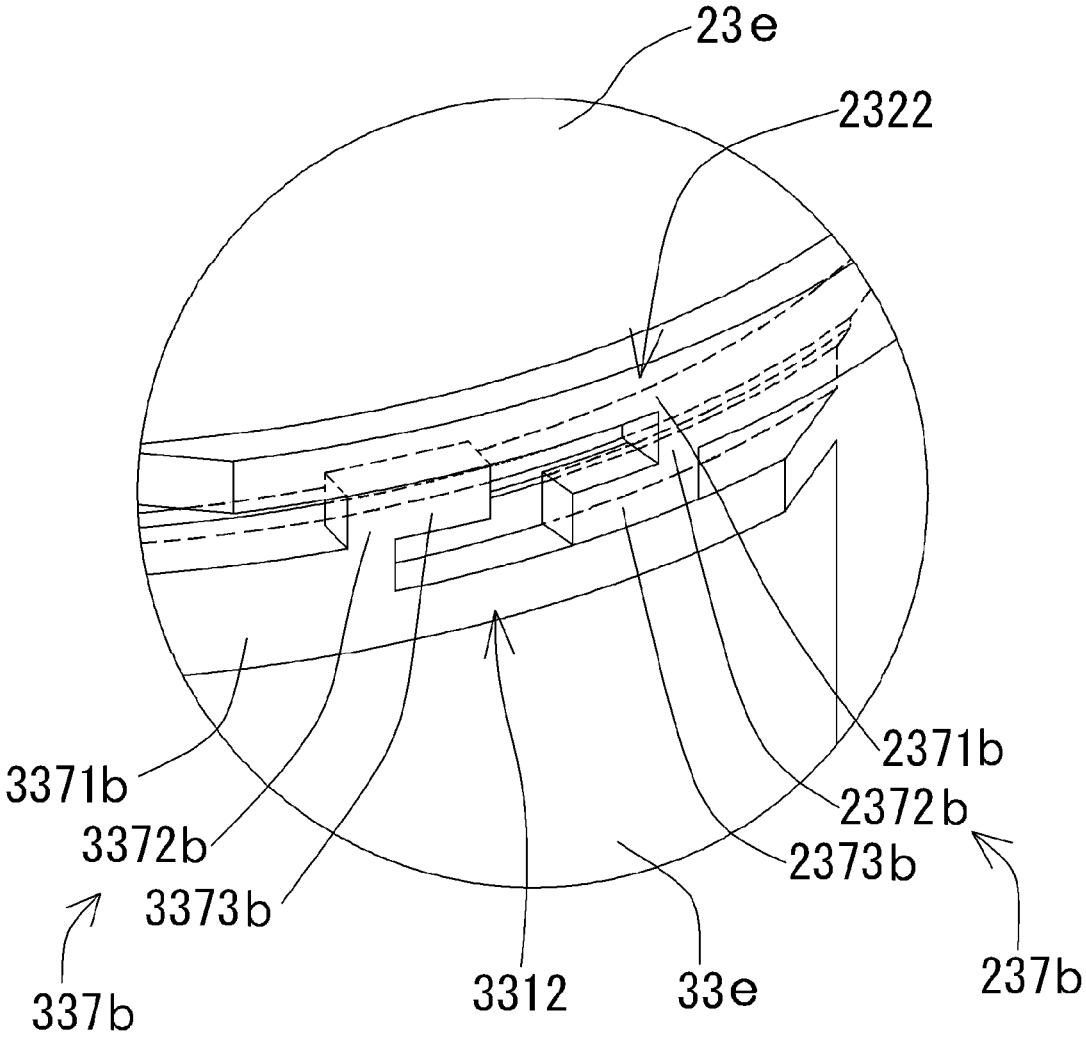
FIG. 34 is a perspective view showing a lower end portion of the first housing and an upper end portion of the second housing employed in the axial flow fan unit of the seventh preferred embodiment of the present invention.

Thereafter, the first housing 23*e* is moved toward the second housing 33*e* so that the lower end portion 232*b* can axially oppose the upper end portion 331*b*. At this time, the first pressing portion 2373*b* is in a circumferentially opposing relationship with the second pressing portion 3373*b* as shown in FIG. 34.

Figure 35:
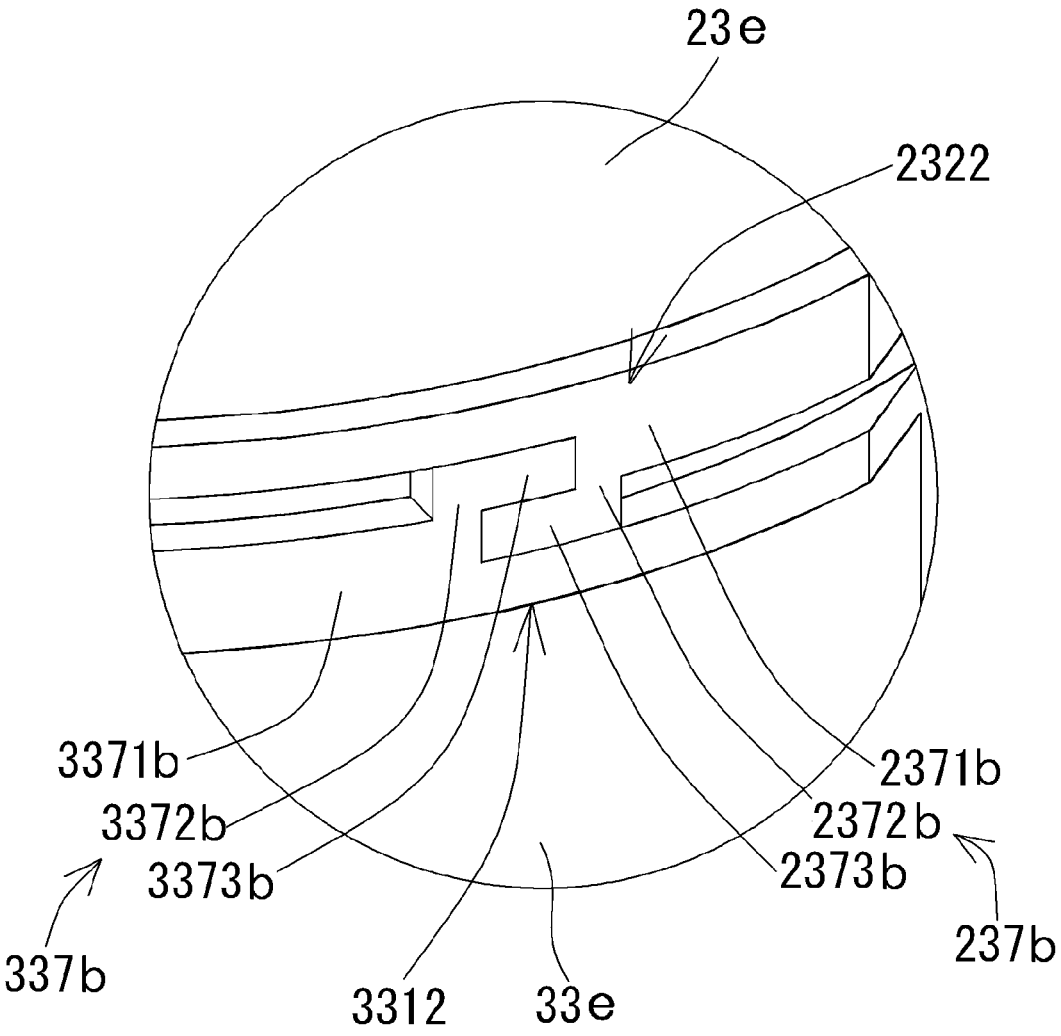
FIG. 35 is another perspective view showing a lower end portion of the first housing and an upper end portion of the second housing employed in the axial flow fan unit of the seventh preferred embodiment.

Then, if the lower end portion 232*b* is rotated relative to the upper end portion 331*b* in the direction indicated by the arrow 91, the ninth locking portion 237*b* and the tenth locking portion 337*b* come into engagement with each other in the axial direction and in the rotational direction as shown in FIG. 35. More specifically, in the arc portions 2322 and 3312, the circumferential tip end of the first pressing portion 2373*b* makes contact with the raised portion 3372*b* while the tip end of the second pressing portion 3373*b* comes into contact with the raised portion 2372*b*. The same engagement structure is available in the arc portions 2324 and 3314.

In the manner as set forth above, the lower end portion 232*b* is tentatively fixed relative to the upper end portion 331*b*. Thus the lower end portion 232*b* is prevented from moving relative to the upper end portion 331*b* in the axial direction and in the direction indicated by the arrow 91. This makes it easy to align the first housing 23*e* with the second housing 33*e* when attaching the fixing member 4*b*.

With the engagement structures mentioned above, the first housing 23*e* and the second housing 33*e* can be separated from each other by rotating the first housing 23*e* relative to the second housing 33*e* in the direction opposite to the direction indicated by the arrow 91.

Figure 36:
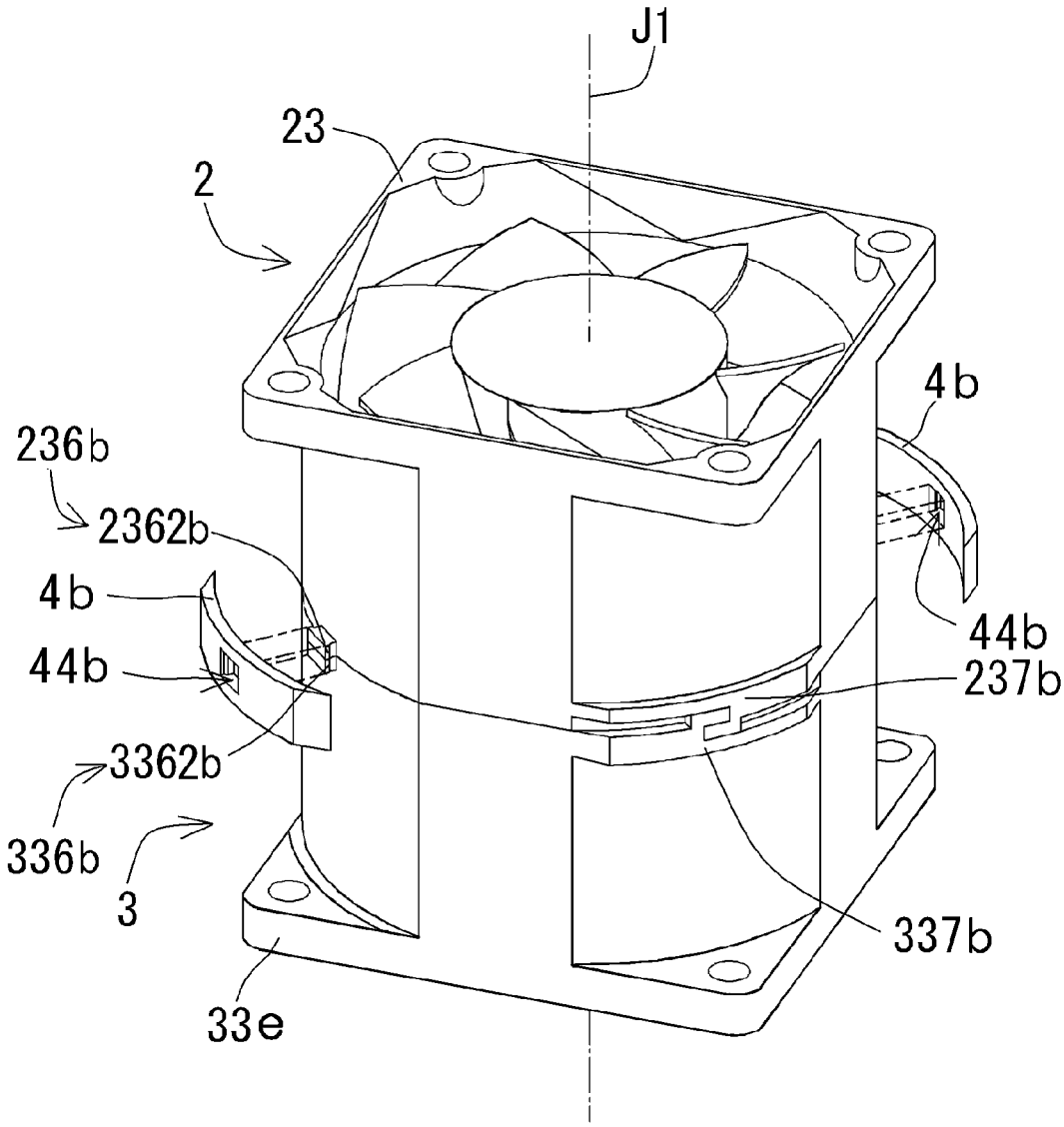
FIG. 36 is a view showing the manner in which the fixing members are attached to the first and second axial flow fans employed in the axial flow fan unit of the seventh preferred embodiment of the present invention.

FIG. 36 is a view showing the manner in which the fixing members 4*b* are attached to the first and second axial flow fans 2 and 3. In the arc portions 2321, 2323, 3311 and 3313, the fixing members 4*b* are slid toward the third and fourth protrusions 236*b* and 336*b* overlapping with each other and are attached thereto while being elastically deformed.

More specifically, the increased width portion 492 of the hole portion 44*b* engages with the tip ends 2361*b* and 3361*b*, thereby holding the third and fourth protrusions 236*b* and 336*b* at the circumferential opposite sides thereof. In addition, the third and fourth protrusions 236*b* and 336*b* are axially interposed between the upper portion 41*b* and the lower portion 42*b*.

This prevents the lower end portion 232*b* from moving relative to the upper end portion 331*b* in the axial direction and in the direction indicated by the arrow 93. The fixing members 4*b* are elastically deformed and attached to the third and fourth protrusions 236*b* and 336*b* under the action of the restoration force thereof. This assures firm attachment of the fixing members 4*b*. The convex surface 49 is arranged substantially flush with the tip ends 2361*b* and 3361*b*.

The axial flow fan unit 1*f* is completely assembled through the operation described above.

When dismantling the axial flow fan unit 1*f* shown in FIG. 27, the fixing members 4*b* are first detached from the first and second housings 23*e* and 33*e*. Then the ninth locking portion 237*b* and the tenth locking portion 337*b* are disengaged from each other by rotating the ninth locking portion 237*b* relative to the tenth locking portion 337*b* in the direction opposite to the engaging direction.

This makes it possible to easily separate the first and second housings 23*e* and 33*e* from each other and to reuse the first and second housings 23*e* and 33*e*. This also prevents (or restrains) the engagement structures of the first and second housings 23*e* and 33*e* from being damaged in the separating process.

In this preferred embodiment, the fixing members 4*b*, the third and fourth protrusions 236*b* and 336*b* and the ninth and tenth locking portions 237*b* and 337*b* are positioned radially inwards of the through-holes 234 and 334. This makes it possible to secure a space radially inwards of the contours 233 and 333. The space may accommodate, e.g., lead wires or the like.

The outer diameter of the respective arc portions of the first and second housings 23*e* and 33*e* is smaller than the outer diameter of the contours 233 and 333. This makes it easy for the operator to hold the axial flow fan unit 1*f* during the operation of assembling the axial flow fan unit 1*f* and mounting the same to an electronic device or the like, thereby enabling the operator to efficiently perform the operation.

Eighth Preferred Embodiment

Figure 37:
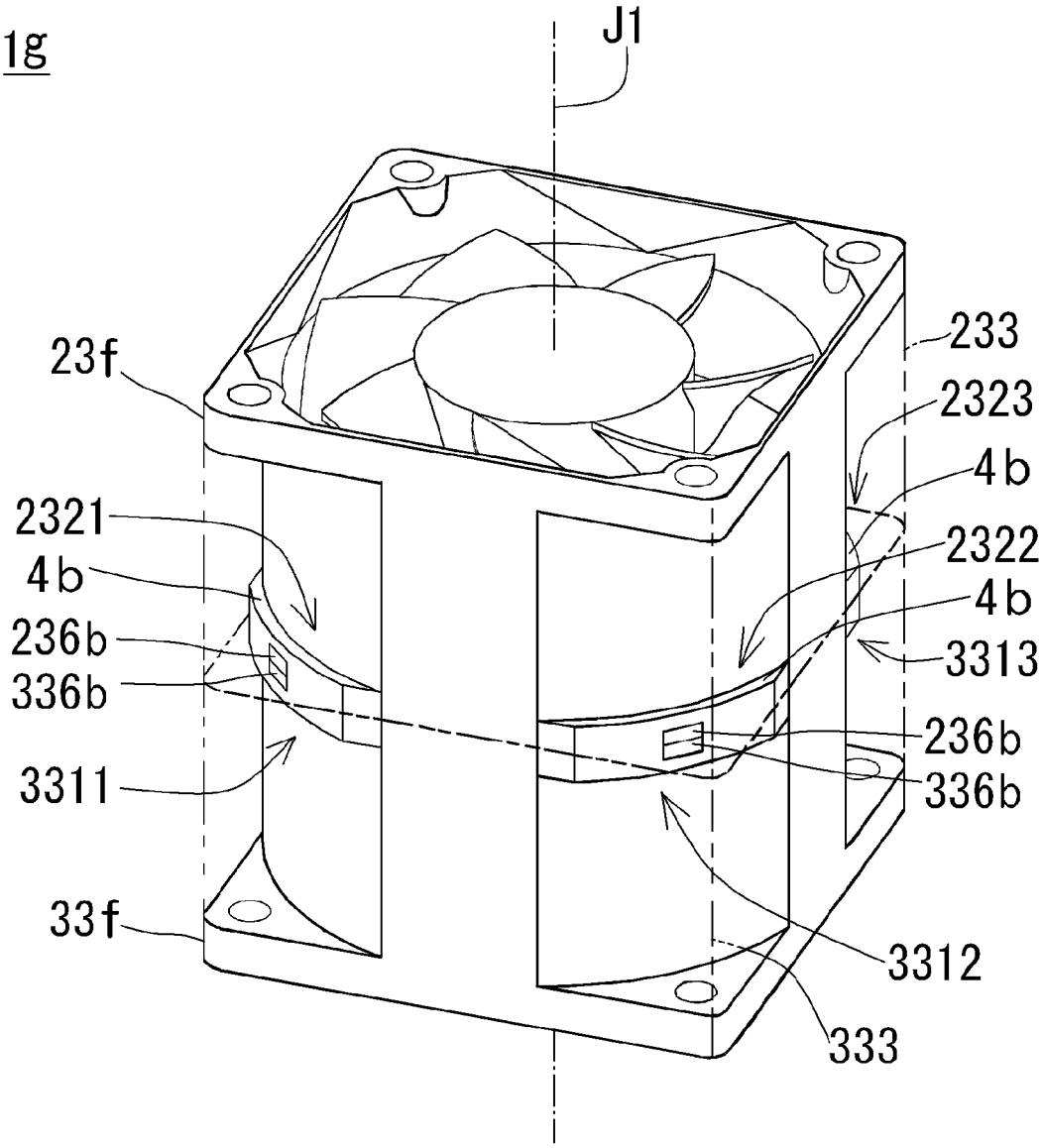
FIG. 37 is a perspective view showing a serially connected axial flow fan unit in accordance with an eighth preferred embodiment of the present invention.

FIG. 37 is a perspective view showing a serially connected axial flow fan unit 1*g* in accordance with an eighth preferred embodiment of the present invention. The first housing 23*f* has third and fourth protrusions 236*b* and 336*b* formed in the respective arc portions 2321 to 2324 and 3311 to 3314. The third and fourth protrusions 236*b* and 336*b* make contact with each other. A fixing member 4*b* is attached to the third and fourth protrusions 236*b* and 336*b*.

Therefore, the first housing 23*f* is firmly and stably fixed relative to the second housing 33*f* in the axial direction and in the direction perpendicular to the axis J1.

Preferred Modified Examples

Figure 38:
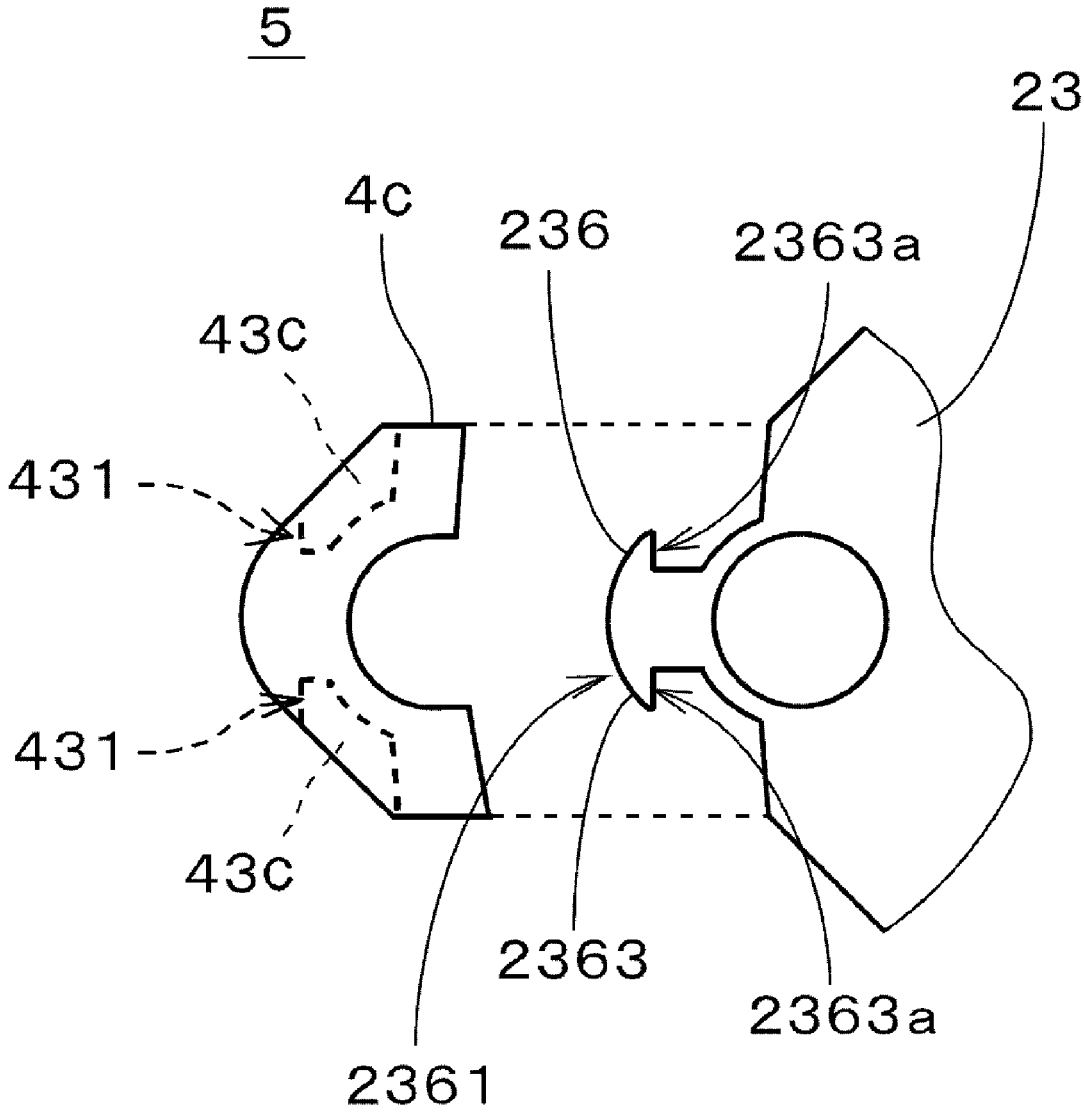
FIG. 38 is a plan view showing one preferred embodiment of the axial flow fan unit.

FIG. 38 is a plan view showing one preferred modified example of the axial flow fan unit 1 in accordance with another preferred embodiment of the present invention. A flange portion 5 having a fixing member 4*c* is shown in FIG. 38. The fixing member 4*c* and the first housing 23 are depicted in a separated state in FIG. 38. The tip end 2361 of the first protrusion 236 is provided with increased width portions 2363 at the lateral opposite ends thereof. The increased width portions 2363 have two surfaces 2363*a* extending in the axial direction and facing radially inwards. Although not shown in FIG. 38, the tip end of the second protrusion 336 is provided with increased width portions having the same shape as that of the increased width portions 2363. The side portions 43*c* of the fixing member 4*c* have surfaces 431 extending in the axial direction and facing radially outwards.

When assembling the axial flow fan unit 1, the fixing member 4*c* is elastically deformed and attached to the first and second protrusions 236 and 336 in the same manner as mentioned above. At this time, the surfaces 431 of the side portions 43*c* make contact with the surfaces 2363*a* of the first protrusion 236 and the like surfaces of the second protrusion 336 in the radial direction.

With this structure, the lower end portion 232 is prevented from moving relative to the upper end portion 331 in the axial direction and in the direction perpendicular or substantially perpendicular to the axis J1.

The first and second housings 23 and 33 can be separated from each other by breaking the fixing member 4*c*. Even in that case, the first and second housings 23 and 33 are protected from damage, which makes it possible to reuse the first and second housings 23 and 33 thus separated.

The strength with which the fixing member 4*c* is fixed to the first and second housings 23 and 33 is set substantially equal to the breaking strength of the fixing member 4*c*. This prevents the fixing member 4*c* from being inadvertently removed from the first and second housings 23 and 33.

In case the first and second housings 23 and 33 are fixed together by the fixing member 4*c*, it may be possible to omit the first locking portion 237 of the corner portions 2352 and 2354 and the second locking portion 337 of the corner portions 3352 and 3354.

Figure 39:
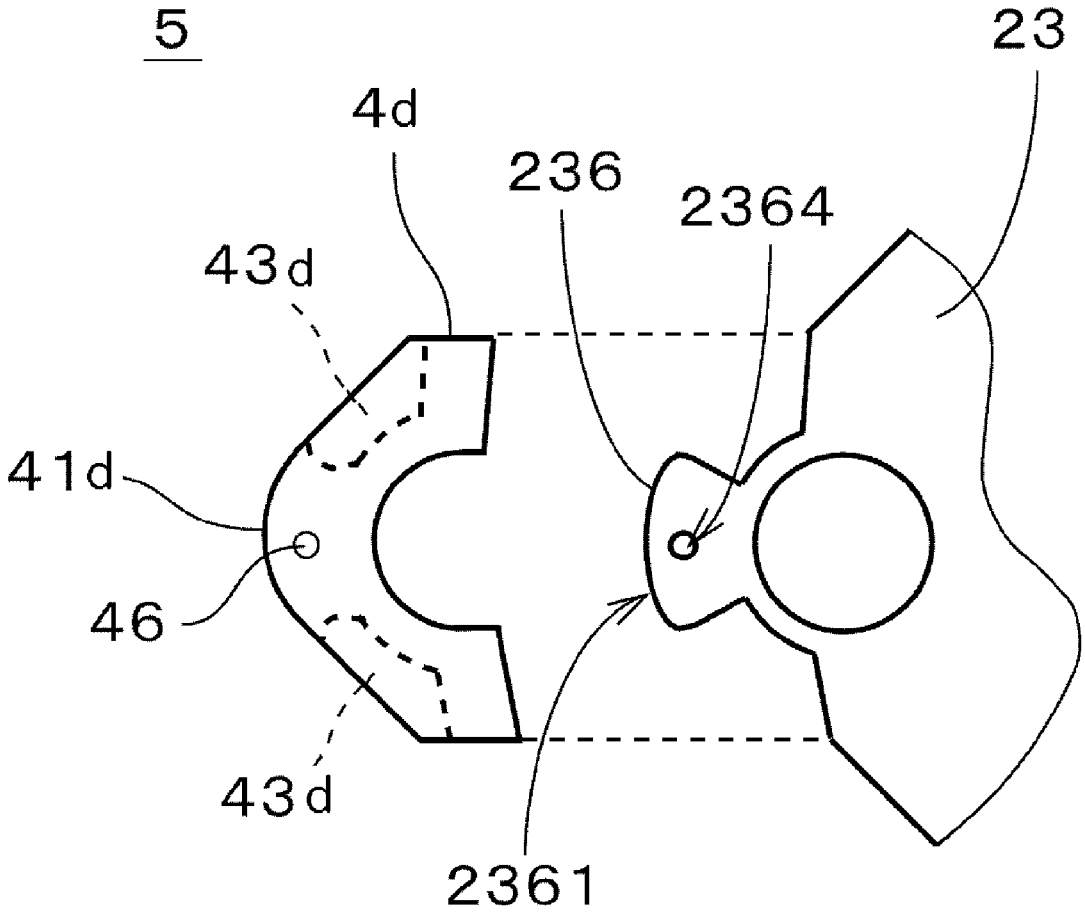
FIG. 39 is a plan view showing another preferred embodiment of the axial flow fan unit.

FIG. 39 is a plan view showing another preferred modified example of the axial flow fan unit 1 in accordance with the preferred embodiment. A flange portion 5 having a fixing member 4*d* including side portions 43*d* is shown in FIG. 39. A recessed portion 2364 is formed on each of the upper surface of the tip end 2361 and the lower surface of the tip end 3361. A raised portion 46 is formed on each of the lower surface of the upper portion 41*d* and the upper surface of the lower portion 42*d*.

Figure 40:
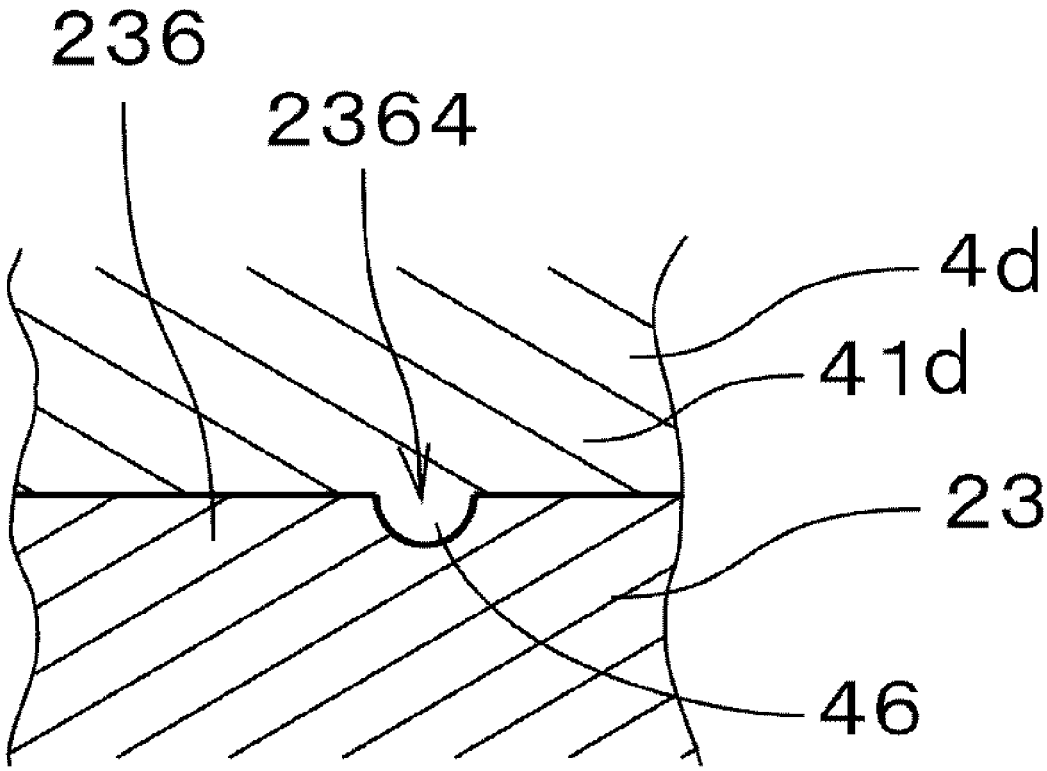
FIG. 40 is a section view of the upper portion of the fixing member and the first protrusion taken along a plane perpendicular to the circumferential direction.

FIG. 40 is a section view of the upper portion 41*d* of the fixing member 4*d* and the first protrusion 236 taken along a plane perpendicular to the circumferential direction. In FIG. 40, the fixing member 4*d* is attached to the first and second housings 23 and 33.

When assembling the axial flow fan unit 1, the raised portion 46 engages with the recessed portion 2364 of each of the first and second protrusions 236 and 336.

This makes it possible to fix the first and second housings 23 and 33 together with ease and to prevent the first housing 23 from making movement relative to the second housing 33 in the direction perpendicular to the axis J1.

Figure 41:
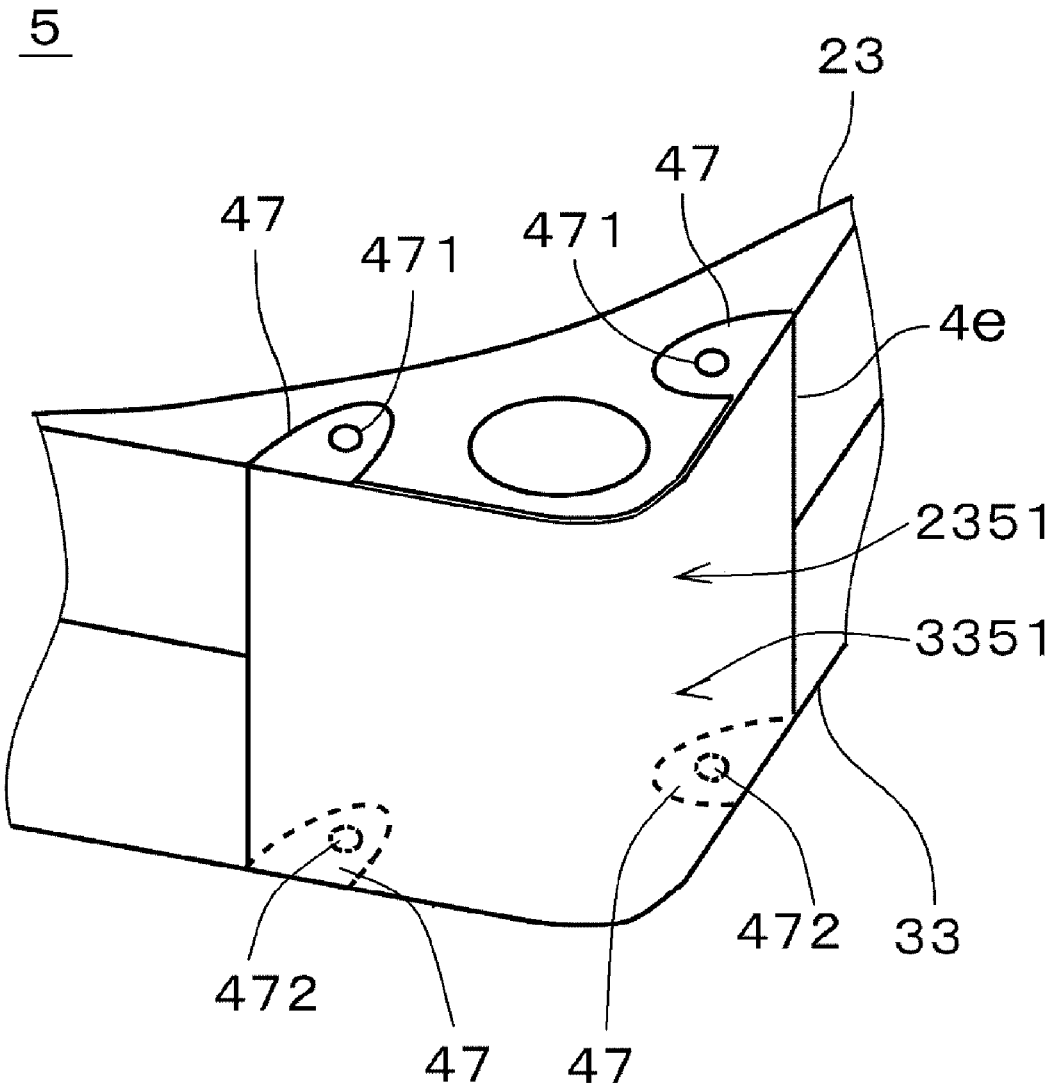
FIG. 41 is a perspective view showing a further preferred embodiment of the axial flow fan unit.

FIG. 41 is a perspective view showing a further preferred modified example of the axial flow fan unit 1. A flange portion 5 having a fixing member 4*e* is shown in FIG. 41.

As shown in FIG. 41, the outer surface of the flange in the corner portions 2351 and 2353 has a shape conforming to the contour 233. Similarly, the outer surface of the flange in the corner portions 3351 and 3353 has a shape conforming to the contour 333.

The fixing member 4*e* preferably is a generally rectangular metallic plate curved along the outer surfaces of the corner portions 2351 and 3351. Similarly, a fixing member 4*e* preferably having the same shape is attached to the corner portions 2353 and 3353.

The fixing member 4*e* has a plurality of (e.g., four) protrusions 47. The protrusions 47 protrude along the upper surface of the flange of the first housing 23 and the lower surface of the flange of the second housing 33. Each of the protrusions 47 has a downwardly protruding raised portion 471 or an upwardly protruding raised portion 472.

Figure 42:
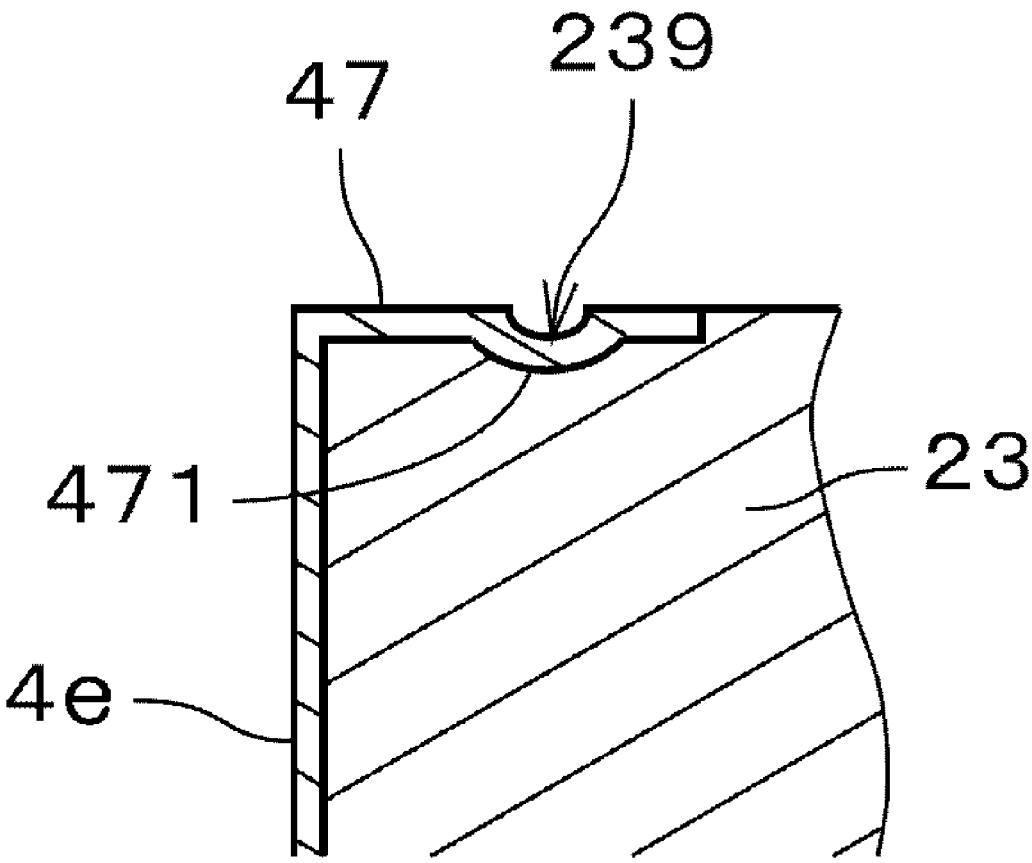
FIG. 42 is a section view of the protrusion positioned at the left upper side in FIG. 41 and the first housing.

FIG. 42 is a section view of the protrusion 47 positioned at the left upper side in FIG. 41 and the first housing 23, which view is taken along a plane perpendicular to the outer surface of the first housing 23 but parallel to the axis J1 (see FIG. 1). A downwardly recessed portion 239 and an upwardly recessed portion (not shown) are formed in the first and second housings 23 and 33 in such positions corresponding to the raised portions 471 and 472. As the fixing member 4*e* is attached to the first and second housings 23 and 33, the raised portions 471 and 472 are fitted to the respective recessed portions.

This makes it possible to easily and firmly fix the first housing 23 relative to the second housing 33 against movement in the axial direction and in the direction perpendicular or substantially perpendicular to the axis J1.

Figure 43:
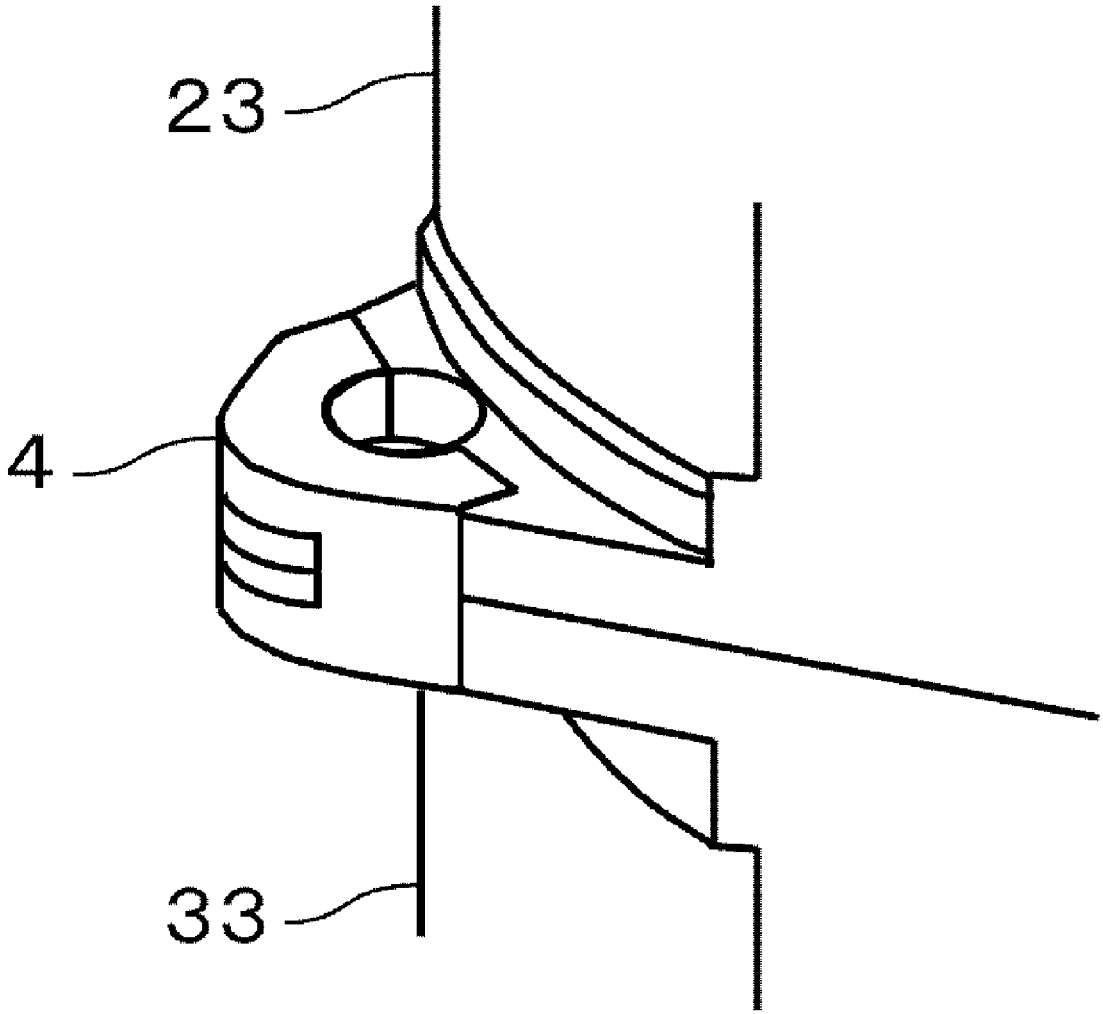
FIG. 43 is a perspective view of a still further preferred modified example of the axial flow fan unit.

The present invention is not limited to the preferred embodiments and the preferred modified examples described above but may be changed in many different forms. For example, as shown in FIG. 43, the axial height of the fixing member 4 may be set equal to the axial height of the corner portions of the first and second housings 23 and 33. The axial height of the fixing member is not particularly limited but may be arbitrarily changed in the preferred embodiments and the preferred modified examples.

The number of the fixing members used herein is not particularly limited and one or more fixing members may be used depending on the circumstances. For example, in case of the first preferred embodiment, the first and second housings 23 and 33 may be fixed at one side by the engagement structure of the first and second locking portions 237 and 337 instead of the fixing member 4.

In other words, the corner portions 3351 and 3353 may be axially fixed relative to the corner portions 2351 and 2353 through the use of a single fixing member 4 in combination with the first and second locking portions 237 and 337.

This holds true in case of the other preferred embodiments and the preferred modified examples. Provision of at least one fixing member realizes easy and secure fixing of the first and second housings.

The shape and size of the fixing member is not particularly limited to the ones described above. For example, the first and second housings 23 and 33 may be fixed together in the corner portions 2351, 2353, 3351 and 3353 using other clip-like axial fixing members instead of the fixing member 4.

In this case, axially extending protrusions and substantially cylindrical hole portions for engagement with the protrusions are preferably formed in two or more corner portions of the first housing 23 and in the corresponding corner portions of the second housing 33. Through the engagement of the protrusions and the hole portions, the first housing 23 is fixed relative to the second housing 33 in the direction perpendicular or substantially perpendicular to the axis J1. These alternative structures may be suitably used in the other preferred embodiments and the preferred modified examples.

As another alternative example of the fixing member, each of the first and second protrusions 236 and 336 may be provided with a radially extending slit in case of the first preferred embodiment. In this case, the increased width portions 2362 and 3362 are elastically deformed toward each other in the circumferential direction when the fixing member 4 is fitted to the first and second protrusions 236 and 336. As a consequence, the fixing member 4 is fixed to the first and second housings 23 and 33. These alternative structures may be suitably used in the other preferred embodiments and the preferred modified examples.

The shape and size of the respective locking portions may be arbitrarily changed. For example, in case of the second preferred embodiment, the first and second locking portions 237*a* and 337*a* may have other shapes insofar as at least one of the first and second locking portions 237*a* and 337*a* is elastically deformable during the engagement process thereof.

In addition, an axially extending slit may be formed in the tip end 3373 of the second locking portion 337*a*. The first and second locking portions 237*a* and 337*a* may engage with each other through the elastic deformation of the second locking portion 337*a*.

In case of the fifth preferred embodiment, no particular restriction is imposed on the position where the first and second housings 23*d* and 33*d* are fixed together by the fixing member 4*d*. For example, the attachment position of the fixing member 4*d* may be far away from the through-holes 64 and 74. The arrangement of the locking portions and the protrusions and the position of the fixing member may be suitably changed in the other preferred embodiments and the preferred modified examples.

The number of the fixing members is not particularly limited and may be, e.g., three or more in case of the fifth preferred embodiment.

When fixing the first and second housings together, the fixing member may be used in combination with the engagement structures included in the other preferred embodiments and the preferred modified examples. Even in that case, an error-proofing mechanism is provided so as to ensure correction positioning of the first housing with respect to the second housing.

The ribs 24 and 34 for supporting the motor units 22 and 32 of the first and second axial flow fans 2 and 3 may be provided at the intake side, too. In the preferred embodiments described above, the first axial flow fan 2 may be arranged at the exhaust side of the axial flow fan unit, with the second axial flow fan 3 arranged at the intake side thereof. The number of the axial flow fans constituting the axial flow fan unit may be three or more. Likewise, the fan frame may be constructed by combining three or more housings.

The shape and size of the respective protrusions to which the fixing member is attached may be suitably changed. For example, a plurality of protrusions formed in a single housing may differ in shape and size from one another. Even in that case, it is possible to fix the housings together and to realize an error-proofing mechanism.

In the preferred embodiments and the preferred modified examples described above, a duct rather than the second axial flow fan may be fixed to the first axial flow fan using the afore-mentioned engagement structures.

The number of the corner portions and the arc portions provided in the housings is not particularly limited. The number of the corner portions and the arc portions of the first housing may be different from that of the second housing. The contour of the housings and the shape and contour of the upper and lower end portions are not particular limited.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A fan frame comprising:

a first housing including a first end portion on which a first protrusion is arranged;

a second housing including a second end portion on which a second protrusion opposing the first protrusion along an axis is arranged, the second end portion being in an axially opposing relationship with the first end portion; and a fixing member attached to the first protrusion and the second protrusion to fix the first housing and the second housing together; wherein the fixing member includes an axially lower surface and an axially upper surface, the axially lower surface of the fixing member being arranged to directly oppose an axially uppermost surface of the first protrusion and the axially upper surface of the fixing member being arranged to directly oppose an axially lowermost surface of the second protrusion.

2. The fan frame of claim 1, further comprising a first locking portion arranged in the first end portion and a second locking portion engaging with the first locking portion arranged in the second end portion.

3. The fan frame of claim 2, wherein the first locking portion and the second locking portion are configured to engage with each other as the first housing is moved relative to the second housing in a predetermined direction, and to disengage from each other as the first housing is moved relative to the second housing in a direction opposite to the predetermined direction.

4. The fan frame of claim 3, wherein the predetermined direction is one of an axial direction, a rotational direction about the axis, and a direction perpendicular or substantially perpendicular to the axis.

5. The fan frame of claim 2, wherein the first end portion includes a corner portion in which the first locking portion is arranged and the second end portion includes a corner portion in which the second locking portion is arranged.

6. The fan frame of claim 2, wherein the first end portion includes an arc portion in which the first locking portion is arranged and the second end portion includes an arc portion in which the second locking portion is arranged.

7. The fan frame of claim 1, wherein the first end portion includes a corner portion on which the first protrusion is arranged and the second end portion includes a corner portion on which the second protrusion is arranged.

8. The fan frame of claim 7, wherein the first and second housing include a flange portion including the corner portion having the first protrusion arranged thereon and a flange portion including the corner portion having the second protrusion arranged thereon, and the fixing member is attached to the first and second protrusions at the flange portions.

9. The fan frame of claim 8, wherein an axially extending through-hole is located in the first end portion or the second end portion and the through-hole and the flange portion do not overlap with each other when seen in an axial direction.

10. The fan frame of claim 1, wherein the first end portion includes an arc portion on which the first protrusion is arranged and the second end portion includes an arc portion on which the second protrusion is arranged.

11. The fan frame of claim 1, wherein the fixing member includes a hole into which the first protrusion and the second protrusion are inserted.

12. The fan frame of claim 1, wherein the fixing member includes side portions arranged to contact with the first protrusion and the second protrusion in a direction perpendicular or substantially perpendicular to the axis.

13. The fan frame of claim 1, wherein the fixing member includes a third protrusion extending along a contour of the first housing and a fourth protrusion extending along a contour of the second housing.

14. The fan frame of claim 13, wherein the third protrusion includes a raised portion fitted to a recessed portion provided in the first end portion and the fourth protrusion includes a raised portion fitted to a recessed portion provided in the second end portion.

15. The fan frame of claim 1, wherein the fixing member is made of a resin material or a metallic material.

16. The fan frame of claim 1, wherein an upper portion of the fixing member includes a raised portion fitted to a recessed portion arranged in the first end portion and a lower portion of the fixing member includes a raised portion fitted to a recessed portion arranged in the second end portion.

17. The fan frame of claim 1, wherein each of the first protrusion and the second protrusion has a circumferentially extending increased width portion.

18. The fan frame of claim 1, wherein the fixing member lies inside a contour of the first housing and a contour of the second housing when attached to the first protrusion and the second protrusion.

19. The fan frame of claim 1, wherein at least one of the first housing and the second housing includes a duct.

20. The fan frame of claim 1, wherein the first protrusion and the second protrusion are overlapped on each other and an axial height as that of the fixing member is substantially equal to a height of the first and second protrusions overlapped on each other.

21. A fan unit comprising:

a first housing arranged to accommodate a first impeller rotatable about an axis, the first housing having a first end portion on which a first protrusion is arranged;

a second housing arranged to accommodate a second impeller rotatable about the axis, the second housing having a second end portion on which a second protrusion axially opposing the first protrusion is arranged, the second end portion being in an axially opposing relationship with the first end portion; and a fixing member attached to the first protrusion and the second protrusion to fix the first housing and the second housing together; wherein the fixing member includes an axially lower surface and an axially upper surface, the axially lower surface of the fixing member being arranged to directly oppose an axially uppermost surface of the first protrusion and the axially upper surface of the fixing member being arranged to directly oppose an axially lowermost surface of the second protrusion.

22. The fan unit of claim 21, further comprising a first locking portion arranged in the first end portion and a second locking portion engaging with the first locking portion arranged in the second end portion.

23. The fan unit of claim 22, wherein the first locking portion and the second locking portion are configured to engage with each other as the first housing is moved relative to the second housing in a predetermined direction, and to disengage from each other as the first housing is moved relative to the second housing in a direction opposite to the predetermined direction.

24. The fan unit of claim 21, wherein the first impeller and the second impeller rotate in different directions from each other.

* * * * *